US010824110B2

(12) United States Patent
Sugimoto et al.

(10) Patent No.: US 10,824,110 B2
(45) Date of Patent: Nov. 3, 2020

(54) PROCESS CARTRIDGE AND IMAGE FORMING APPARATUS

(71) Applicant: CANON KABUSHIKI KAISHA, Tokyo (JP)

(72) Inventors: Sohta Sugimoto, Yokohama (JP); Masaaki Sato, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/720,252

(22) Filed: Dec. 19, 2019

(65) Prior Publication Data

US 2020/0125028 A1 Apr. 23, 2020

Related U.S. Application Data

(60) Division of application No. 16/118,703, filed on Aug. 31, 2018, now Pat. No. 10,534,313, which is a continuation of application No. PCT/JP2017/009632, filed on Mar. 3, 2017.

(30) Foreign Application Priority Data

Mar. 4, 2016 (JP) ..... 2016-042554

(51) Int. Cl.
*G03G 21/18* (2006.01)

(52) U.S. Cl.
CPC ..... *G03G 21/1857* (2013.01); *G03G 21/1825* (2013.01)

(58) Field of Classification Search
CPC ..... G03G 21/18; G03G 21/1817; G03G 21/1825; G03G 21/1857; G03G 21/186
See application file for complete search history.

(56) References Cited

U.S. PATENT DOCUMENTS

| | | | |
|---|---|---|---|
| 5,331,373 | A | 7/1994 | Nomura et al. |
| 5,452,056 | A | 9/1995 | Nomura et al. |
| 5,528,341 | A | 6/1996 | Shishido et al. |
| 5,585,889 | A | 12/1996 | Shishido et al. |
| 5,870,654 | A | 2/1999 | Sato et al. |
| 5,911,096 | A | 6/1999 | Batori et al. |
| 5,940,658 | A | 8/1999 | Yokoi et al. |
| 5,966,566 | A | 10/1999 | Odagawa et al. |
| 5,974,288 | A | 10/1999 | Sato |
| 6,075,957 | A | 6/2000 | Batori et al. |

(Continued)

FOREIGN PATENT DOCUMENTS

| | | | |
|---|---|---|---|
| JP | H08-6368 | A | 1/1996 |
| JP | 2001-337511 | A | 12/2001 |

(Continued)

OTHER PUBLICATIONS

Office Action in Taiwanese Patent Application No. 106107064, dated Oct. 18, 2018.

(Continued)

*Primary Examiner* — Sophia S Chen
(74) *Attorney, Agent, or Firm* — Venable LLP

(57) ABSTRACT

Control to drive and stop developing roller is effected. A cartridge includes a drive transmission member movable between a transmitting position capable of transmitting the driving force toward a developing roller and a blocking position capable of blocking the transmission of the driving force to the developing roller.

6 Claims, 47 Drawing Sheets

(56) References Cited

U.S. PATENT DOCUMENTS

| | | | |
|---|---|---|---|
| 6,104,894 | A | 8/2000 | Sato et al. |
| 6,131,007 | A | 10/2000 | Yamaguchi et al. |
| 6,185,390 | B1 | 2/2001 | Higata et al. |
| 6,188,856 | B1 | 2/2001 | Sato |
| 6,381,420 | B1 | 4/2002 | Sato et al. |
| 6,640,066 | B2 | 10/2003 | Sato |
| 6,714,749 | B2 | 3/2004 | Sato et al. |
| 6,795,671 | B2 | 9/2004 | Matsuoka |
| 6,895,199 | B2 | 5/2005 | Sato et al. |
| 6,898,399 | B2 | 5/2005 | Morioka et al. |
| 6,937,832 | B2 | 8/2005 | Sato et al. |
| 7,149,457 | B2 | 12/2006 | Miyabe et al. |
| 7,155,140 | B2 | 12/2006 | Arimitsu et al. |
| 7,155,141 | B2 | 12/2006 | Sato et al. |
| 7,158,736 | B2 | 1/2007 | Sato et al. |
| 7,200,349 | B2 | 4/2007 | Sato et al. |
| 7,218,882 | B2 | 5/2007 | Toba et al. |
| 7,224,925 | B2 | 5/2007 | Sato et al. |
| 7,283,766 | B2 | 10/2007 | Arimitsu et al. |
| 7,349,657 | B2 | 3/2008 | Sato et al. |
| 7,412,193 | B2 | 8/2008 | Sato et al. |
| 7,499,663 | B2 | 3/2009 | Sato et al. |
| 7,660,550 | B2 | 2/2010 | Mori et al. |
| 7,689,146 | B2 | 3/2010 | Sato et al. |
| 7,720,408 | B2 | 5/2010 | Ueno et al. |
| 7,813,668 | B2 | 10/2010 | Ueno et al. |
| 7,885,554 | B2 | 2/2011 | Shirokoshi et al. |
| 9,134,696 | B2 | 9/2015 | Sato et al. |
| 9,429,877 | B2 | 8/2016 | Sato et al. |
| 9,429,906 | B2 | 8/2016 | Yoshimura et al. |
| 9,529,298 | B2 | 12/2016 | Sato et al. |
| 9,632,451 | B2 | 4/2017 | Hayashi et al. |
| 9,804,560 | B2 | 10/2017 | Sato et al. |
| 9,836,020 | B2 | 12/2017 | Yoshimura et al. |
| 9,885,974 | B2 | 2/2018 | Sato et al. |
| 10,139,777 | B2 | 11/2018 | Sato et al. |
| 10,168,664 | B2 | 1/2019 | Yoshimura et al. |
| 10,228,652 | B2 | 3/2019 | Sato et al. |
| 10,254,712 | B2 | 4/2019 | Uneme et al. |
| 2006/0008289 | A1 | 1/2006 | Sato et al. |
| 2008/0181669 | A1 | 7/2008 | Kwon |
| 2010/0209138 | A1 | 8/2010 | Tani |
| 2010/0272470 | A1 | 10/2010 | Tomatsu et al. |
| 2015/0093146 | A1 | 4/2015 | Sato et al. |
| 2016/0370757 | A1 | 12/2016 | Sato et al. |
| 2017/0026193 | A1 | 1/2017 | Thompson et al. |
| 2017/0261926 | A1 | 9/2017 | Kashiide et al. |
| 2017/0261927 | A1 | 9/2017 | Sato et al. |
| 2018/0046129 | A1* | 2/2018 | Sim ..... G03G 21/1647 |
| 2018/0074454 | A1 | 3/2018 | Uneme et al. |
| 2018/0253057 | A1 | 9/2018 | Koishi et al. |
| 2018/0321637 | A1 | 11/2018 | Sato et al. |
| 2019/0064732 | A1 | 2/2019 | Sato et al. |
| 2019/0146410 | A1 | 5/2019 | Sato et al. |
| 2019/0171157 | A1 | 6/2019 | Yoshimura et al. |
| 2019/0179258 | A1 | 6/2019 | Kashiide et al. |
| 2019/0219966 | A1 | 7/2019 | Uneme et al. |
| 2019/0286051 | A1 | 9/2019 | Sugimoto et al. |

FOREIGN PATENT DOCUMENTS

| | | | |
|---|---|---|---|
| JP | 2003-208024 | A | 7/2003 |
| JP | 2004-126006 | A | 4/2004 |
| JP | 2005-076734 | A | 3/2005 |
| WO | 2015083842 | A1 | 6/2015 |

OTHER PUBLICATIONS

International Search Report and Written Opinion for International Patent Application No. PCT/JP2017/009632.

* cited by examiner

PROCESS CARTRIDGE AND IMAGE FORMING APPARATUS

TECHNICAL FIELD

The present invention relates to a cartridge mountable to and dismountable from a apparatus main assembly of an electrophotographic image forming apparatus (hereinafter referred to as an image forming apparatus).

Here, the image forming apparatus forms an image on a recording material using an electrophotographic image forming process. Examples of the image forming apparatus include an electrophotographic copying machine, an electrophotographic printer (for example, a laser beam printer, a LED printer, etc.), a facsimile machine, a word processor, and the like.

Further, the cartridge is mountable to and dismountable from the image forming apparatus. As a cartridge, a device in which an electrophotographic photosensitive drum (hereinafter referred to as a drum) which is an image bearing member and a developer carrying member (hereinafter referred to as a developing roller) are integrated into a cartridge, a drum and devices in which the drum and the developing roller are made into separate cartridges are available. Particularly, in the device in which the drum and developing roller are separately made into cartridges, the portion including the drum is called a drum cartridge, and the portion including the developing roller is called a developing cartridge.

Further, the image forming apparatus main assembly is the remaining part of the image forming apparatus excluding the cartridge.

BACKGROUND ART

Conventionally, an image forming apparatus employs a process cartridge system in which process means acting on a drum and a drum are integrated into a cartridge, and this cartridge is dismountably mountable to the main assembly of the image forming apparatus.

In this process cartridge system, the maintenance of the image forming apparatus can be carried out by the user himself or herself without depending on the service person, the operability can be remarkably improved.

Therefore, this process cartridge system is widely used with image forming apparatuses.

Here, a process cartridge (JP 2001-337511, for example) and an image forming apparatus (JP 2001-337511, for example) including a clutch for switching the drive transmission to the developing roller during image formation between on-state (during image forming operation) and off-state (during non-image-forming operation) have been proposed.

SUMMARY OF THE INVENTION

Problems to be Solved by the Invention

In JP 2001-337511, a spring clutch for the drive switching is provided at the end of the developing roller.

In addition, in JP 2003-208024, a clutch for switching the driving to the developing roller is provided in the image forming apparatus.

An object of the present invention is to improve a structure for performing drive switching to a developing roller.

Means for Solving the Problem

The typical structure of the present invention is a process cartridge detachably mountable to a main assembly of an image forming apparatus, said process cartridge comprising a photosensitive member; a developing roller movable a developing position for developing a latent image on said photosensitive member and a spaced position where said developing roller is more remote from said photosensitive member than in the developing position; a drive transmission member movable between a transmission position capable of transmitting a driving force toward said developing roller and a blocking position capable of blocking the transmission of the driving force to said developing roller; an elastic member for urging said drive transmission member toward the blocking position from the transmission position; and a maintaining member movable between a maintenance position for maintaining said drive transmission member in the transmission position against an elastic force of said elastic member and a permitting position for permitting said drive transmission member to move to the blocking position by the elastic force.

Effect of the Invention

According to the present invention, drive switching for the developing roller can be appropriately carried out.

DESCRIPTION OF THE EMBODIMENTS

Embodiment 1

[General Description of Electrophotographic Image Forming Apparatus]

Hereinafter, Embodiment 1 of the present invention will be described with reference to the drawings.

In the following embodiment, a full-color image forming apparatus in which four process cartridges can be mounted and dismounted is illustrated as an image forming apparatus.

The number of process cartridges to be mounted in the image forming apparatus is not limited to this. It is appropriately selected as necessary.

For example, in the case of an image forming apparatus which forms a monochrome image, the number of process cartridges mounted in the image forming apparatus is one. In addition, in the embodiment described below, a printer is exemplified as an example of the image forming apparatus.

[Schematic Structure of the Image Forming Apparatus]

Figure 2:
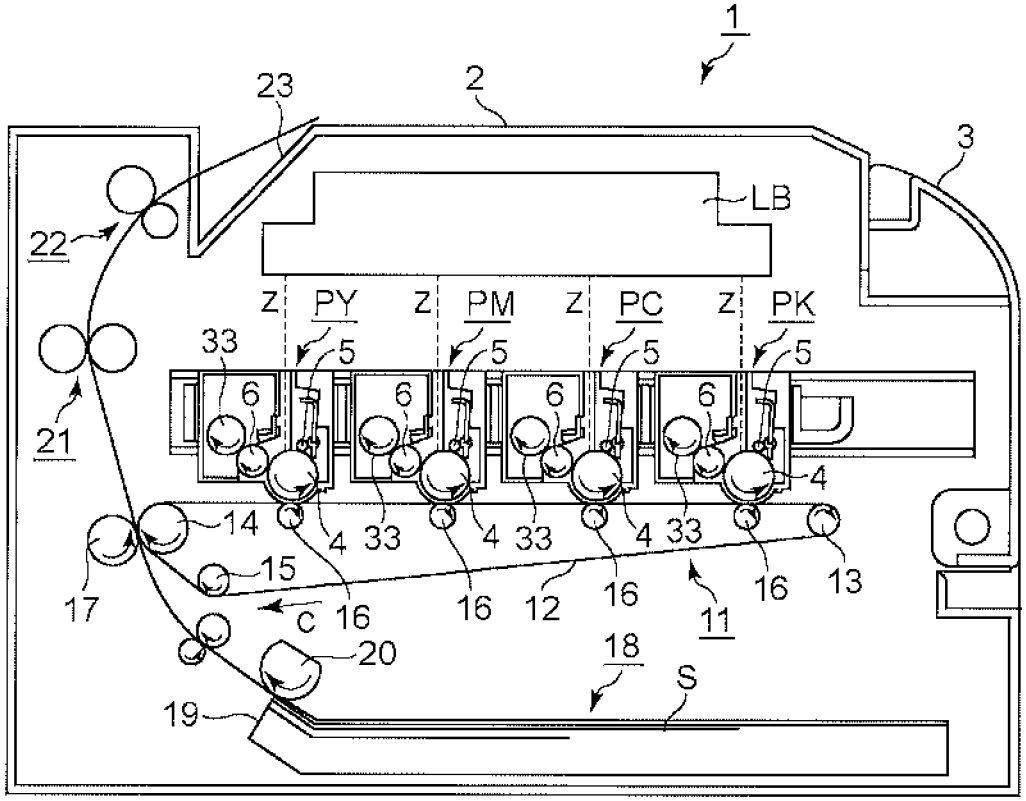
FIG. 2 is a sectional view of the image forming apparatus according to Embodiment 1.
Figure 3:
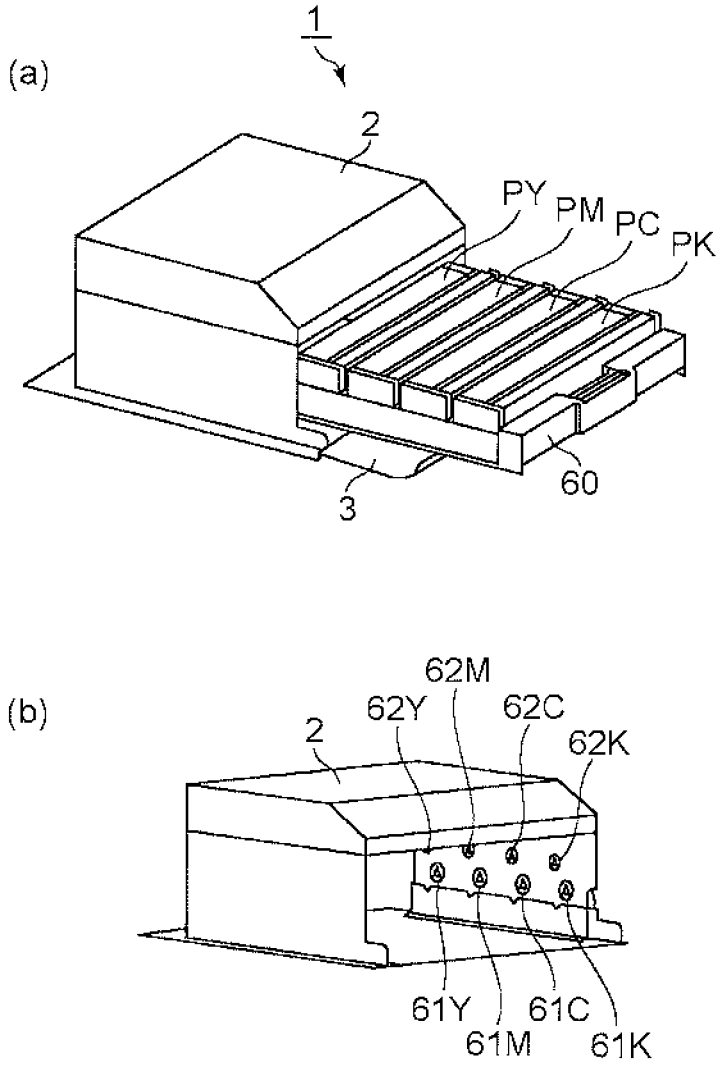
FIG. 3 is a perspective view of the image forming apparatus according to Embodiment 1.
Figure 4:
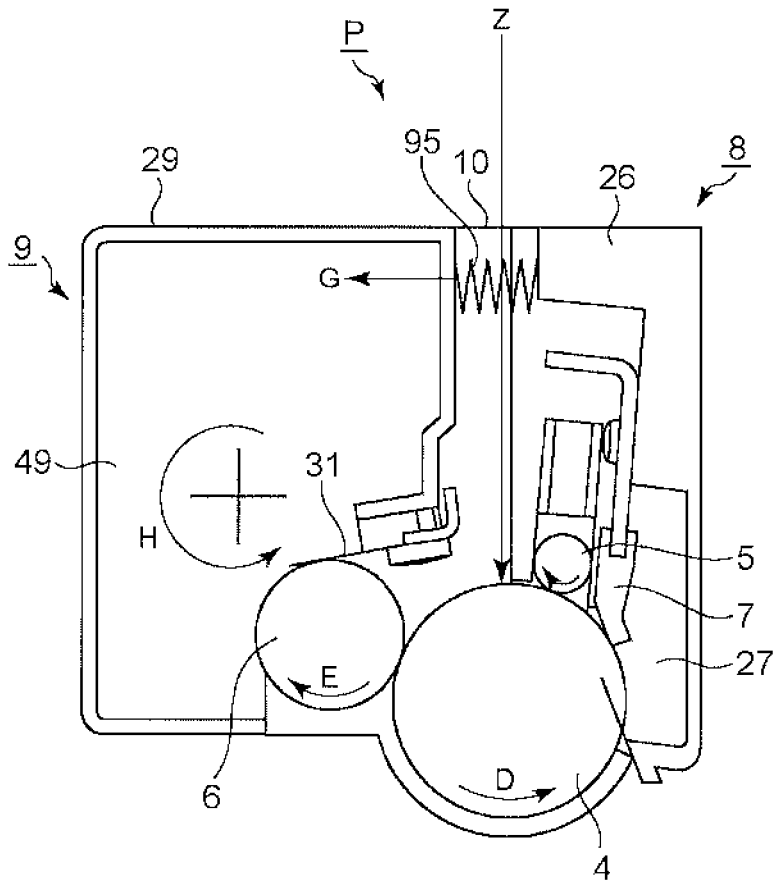
FIG. 4 is a sectional view of the process cartridge according to Embodiment 1.
Figure 5:
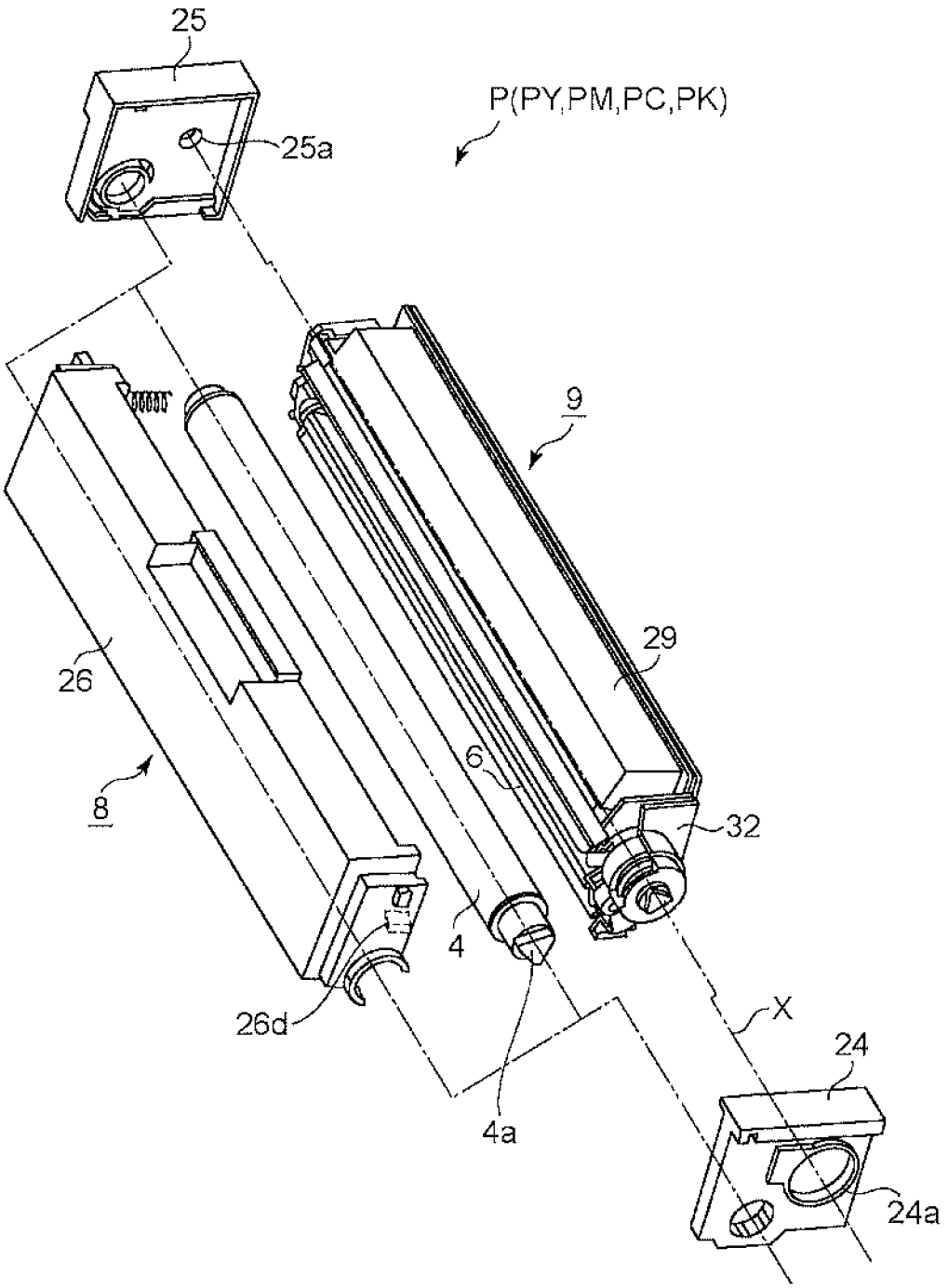
FIG. 5 is a perspective view of the process cartridge according to Embodiment 1.
Figure 6:
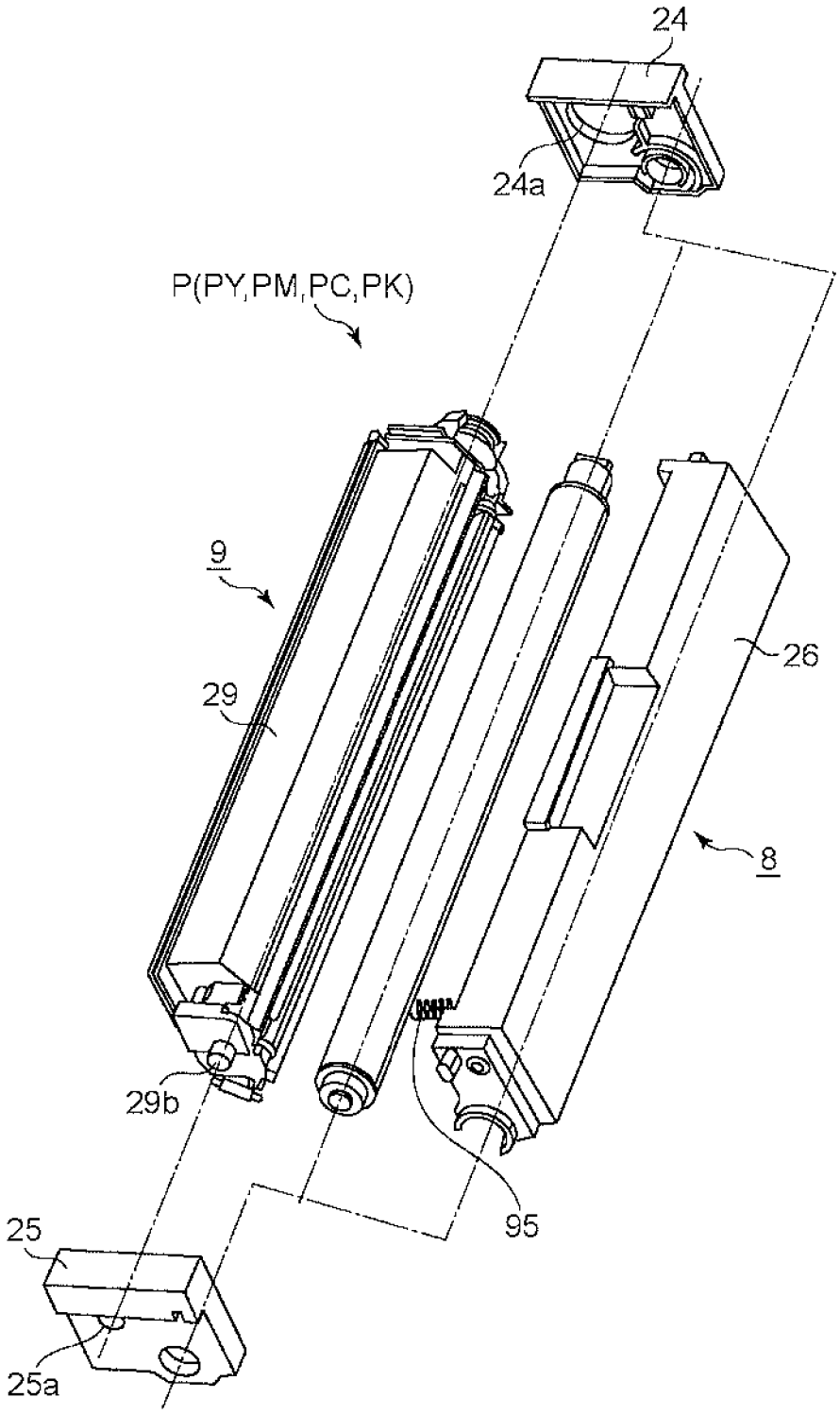
FIG. 6 is a perspective view of the process cartridge according to Embodiment 1.

FIG. 2 is a schematic sectional view of the image forming apparatus of this embodiment. Also, part (a) of FIG. 3 and part (b) of FIG. 3 are perspective views of the image forming apparatus of this embodiment. Also, FIG. 4 is a sectional view of the process cartridge P of this embodiment. FIG. 5 is a perspective view of the process cartridge P of this embodiment as viewed from the driving side, and FIG. 6 is a perspective view of the process cartridge P of this embodiment as viewed from the non-driving side.

As shown in FIG. 2, the image forming apparatus 1 is a four-color full-color laser printer using an electrophotographic image forming process, and forms a color image on a recording material S. The image forming apparatus 1 is of a process cartridge type, in which a process cartridge is dismountably mounted to the electrophotographic image forming apparatus main assembly 2 to form a color image on the recording material S.

Here, regarding the image forming apparatus 1, a side on which the front door 3 is provided is a front (front) side, and a side opposite the front is a rear (rear) side. When viewing the image forming apparatus 1 from the front, a right side is referred to as the driving side and a left side is referred to as the non-driving side. FIG. 2 is a sectional view of the image forming apparatus 1 as viewed from the non-driving side. The front side of the page is the non-driving side of the image forming apparatus 1, the right side of the drawing sheet is the front side of the image forming apparatus 1, and the back side of the drawing sheet is the driving side of the image forming apparatus 1.

In an image forming apparatus main assembly 2, four process cartridges P (PY, PM, PC, PK) are disposed in the horizontal direction. The four cartridges are the first process cartridge PY (yellow), the second process cartridge PM (magenta), the third process cartridge PC (cyan), and the fourth process cartridge PK (black).

The first to fourth process cartridges P (PY, PM, PC, PK) have the same electrophotographic image forming process mechanisms, and the colors of the developer (toner) contained therein is different. The rotational driving forces are transmitted from the drive output portions of the image forming apparatus main assembly 2 to the first to fourth process cartridges P (PY, PM, PC, PK). Details will be described hereinafter.

Bias voltages (charging bias, developing bias, etc.) are supplied from the image forming apparatus main assembly 2 (not shown) to each of the first to fourth process cartridges P (PY, PM, PC, PK).

As shown in FIG. 4, each of the first to fourth process cartridges P (PY, PM, PC, PK) of this embodiment has a photosensitive drum unit (photosensitive unit, image bearing member unit) 8. Photoconductor unit 8 is provided with photosensitive drum 4, charging means and cleaning means as process means acting on drum 4.

Each of the first to fourth process cartridges P (PY, PM, PC, PK) has a developing unit 9 provided with developing means for developing the electrostatic latent image on the drum 4.

The first process cartridge PY accommodates the yellow (Y) developer in the developing frame 29, and forms a yellow developer image on the surface of the drum 4.

In the second process cartridge PM, a magenta (M) developer is contained in the developing frame 29, and a magenta developer image is formed on the surface of the drum 4.

In the third process cartridge PC, a cyan (C) developer is contained in the developing frame 29, and a cyan developer image is formed on the surface of the drum 4.

The fourth process cartridge PK contains a black (K) developer in the developing frame 29, and forms a black developer image on the surface of the drum 4.

Above the first to fourth process cartridges P (PY, PM, PC, PK), a laser scanner unit LB as exposure means is provided. The laser scanner unit LB outputs a laser beam Z corresponding to image information. Then, the laser beam Z passes through an exposure window portion 10 of the cartridge P and scans and exposes the surface of the drum 4.

Below the first to fourth cartridges P (PY, PM, PC, PK), a intermediary transfer belt unit 11 as a transfer member is provided. The intermediary transfer belt unit 11 has a driving roller 13, tension rollers 14, 15, and a transfer belt 12 having flexibility is wrapped around them.

The lower surface of the drum 4 of each of the first to fourth cartridges P (PY, PM, PC, PK) is in contact with the upper surface of the transfer belt 12. The contact part is the primary transferring portion. Inside the transfer belt 12, the primary transfer roller 16 is provided so as to face the drum 4.

Further, the secondary transfer roller 17 is disposed at a position facing the tension roller 14 via the transfer belt 12. The contact portion between the transfer belt 12 and the secondary transfer roller 17 is the secondary transfer portion.

Below the intermediary transfer belt unit 11, a feeding unit 18 is provided. The feeding unit 18 has a sheet feeding tray 19 and a sheet feeding roller 20, on which the recording material S is stacked and stored.

A fixing unit 21 and a discharge unit 22 are provided on the upper left side in the apparatus main assembly 2 as shown in FIG. 2. The upper surface of the main assembly 2 is a discharge tray 23.

The recording material S to which the developer image has been transferred is subjected to a fixing operation by the fixing means provided in the fixing unit 21 and then is discharged to the discharge tray 23.

The cartridge P is constituted to be mountable to and dismountable from the apparatus main assembly 2 via a drawable cartridge tray 60. Part (a) of FIG. 3 shows a state in which the cartridge tray 60 and the cartridge P are drawn out of the apparatus main assembly 2. Part (b) of FIG. 3 shows a state in which the cartridge tray 6 is dismounted from the apparatus main assembly 2.

[Image Forming Operation]

The operation of forming a full color image is as follows.

The drum 4 of each of the first to fourth cartridges P (PY, PM, PC, PK) is rotationally driven at a predetermined speed (the direction of the arrow D in FIG. 4, counterclockwise in FIG. 2).

The transfer belt 12 is also rotationally driven at a speed corresponding to the speed of the drum 4 in the forward direction (direction of the arrow C in FIG. 2).

The laser scanner unit LB is also driven. In synchronism with the driving of the scanner unit LB, the surface of the drum 4 is uniformly charged to a predetermined polarity and potential by a charging roller 5. The laser scanner unit LB scans and exposes the surface of each drum 4 with the laser beam Z in accordance with the image signal for each color.

By this, an electrostatic latent image corresponding to the image signal of the corresponding color is formed on the surface of each drum 4. The electrostatic latent image is developed by a developing roller 6 driven to rotate at a predetermined speed (in the direction of the arrow E in FIG. 4, clockwise in FIG. 2).

By such an electrophotographic image forming process, a yellow developer image corresponding to the yellow component of the full-color image is formed on the drum 4 of the first cartridge PY. Then, the developer image is primarily transferred onto the transfer belt 12.

Similarly, a magenta developer image corresponding to the magenta component of the full-color image is formed on the drum 4 of the second cartridge PM. Then, the developer image is primarily transferred superimposedly on the yellow developer image already transferred on the transfer belt 12.

Likewise, a cyan developer image corresponding to the cyan component of the full-color image is formed on the drum 4 of the third cartridge PC. Then, the developer image is primarily transferred superimposedly on the yellow and magenta developer images already transferred on the transfer belt 12.

Likewise, a black color developer image corresponding to the black component of the full color image is formed on the drum 4 of the fourth cartridge PK. Then, the developer image is primarily transferred superimposedly on the yellow, magenta, and cyan developer images already transferred on the transfer belt 12.

In this manner, unfixed developer images of four colors of yellow, magenta, cyan, and black are formed on the transfer belt 12.

On the other hand, the recording material S is separated and fed one by one at a predetermined control timing. The recording material S is introduced into a secondary transfer portion which is a contact portion between the secondary transfer roller 17 and the transfer belt 12 at a predetermined control timing.

By this, in a process in which the recording material S is being fed to the secondary transfer portion, the four color superimposed developer images on the transfer belt 12 are sequentially and collectively transferred onto the surface of the recording material S.

[Overall Structure of Process Cartridge]

In this embodiment, the first to fourth cartridges P (PY, PM, PC, PK) have the same electrophotographic image forming process mechanism, and the color of the accommodated developer and the filling amount of the developer are different from each other.

The cartridge P includes a drum 4 as a photosensitive member and a process means acting on the drum 4. Here, the process means includes the charging roller 5, the developing roller 6, the cleaning blade 7 and the like. The charging roller is a charging means (charging member, charging device) for charging the drum 4. The developing roller 6 is a developing means (developing member, developer carrying member) for developing a latent image formed on the drum 4. The cleaning blade 7 is cleaning means for removing residual developer remaining on the surface of the drum 4. The cartridge P is divided into a drum unit 8 and a developing unit 9.

[Structure of Drum Unit]

As shown in FIGS. 4, 5 and 6, the drum unit 8 includes a drum 4 as a photosensitive member, a charging roller 5, a cleaning blade 7, a cleaning container 26 as a photosensitive member frame, and a waste developer storing portion 27. The drum unit 8 also includes a cartridge cover member (the driving side cartridge cover member 24 and the non-driving side cartridge cover member 25 in FIGS. 5 and 6). Incidentally, the photosensitive member frame in a broad sense includes the waste developer storing portion 27, the driving side cartridge cover member 24, and the non-driving side cartridge cover member 25, in addition to the cleaning container 26 which is a photosensitive member frame in a narrow sense (the same applies to the following embodiments). When the cartridge P is mounted to the apparatus main assembly 2, the photosensitive member frame is fixed to the apparatus main assembly 2.

The drum 4 is rotatably supported by cartridge cover members 24, 25 provided at both longitudinal ends of the cartridge P. Here, the axial direction of the drum 4 is defined as the longitudinal direction.

The cartridge cover members 24 and 25 are fixed to the cleaning container 26 at both end sides in the longitudinal direction of the cleaning container 26.

As shown in FIG. 5, a coupling member 4*a* for transmitting a driving force to the drum 4 is provided on one end side in the longitudinal direction of the drum 4. Part (b) of FIG. 3 is a perspective view of the apparatus main assembly 2, in which the cartridge tray 60 and the cartridge P are not shown. The respective coupling members 4*a* of the cartridges P (PY, PM, PC, PK) are engaged with the drum drive output member 61 (61Y, 61M, 61C, 61K) as the main body side drive transmission members of the apparatus main body 2 shown in part (b) of FIG. 3. By this, the driving force of the drive motor (not shown) of the apparatus main body is transmitted to the drum 4 of each cartridge.

The charging roller 5 is supported by the cleaning container 26 so that it can contact and can be rotated by the drum 4.

Further, the cleaning blade 7 is supported by the cleaning container 26 so as to contact the peripheral surface of the drum 4 with a predetermined pressure.

The transfer residual developer removed from the circumferential surface of the drum 4 by the cleaning means 7 is stored in the waste developer storing portion 27 in the cleaning container 26.

Supporting portions 24*a*, 25*a* for rotatably supporting the developing unit 9 are provided on the driving side cartridge cover member 24 and the non-driving side cartridge cover member 25 (FIG. 6).

[Configuration of Developing Unit]

Figure 1:
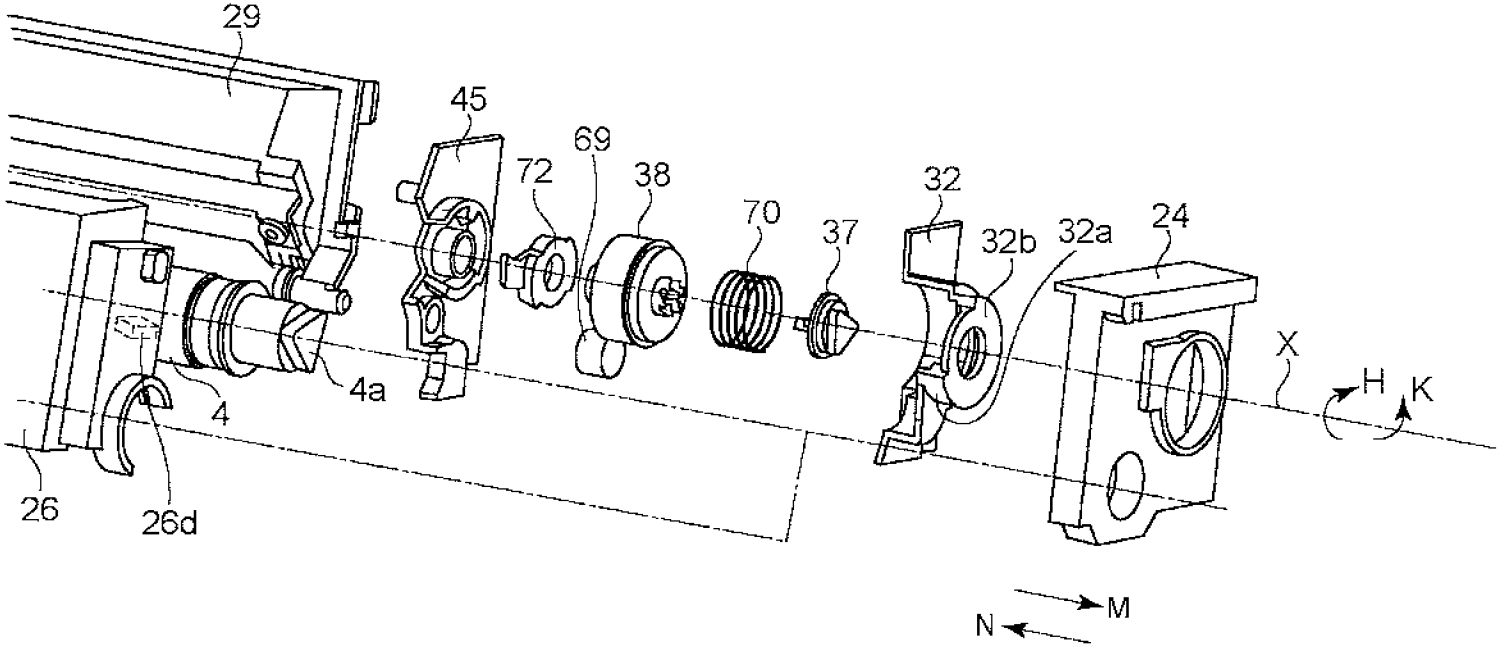
FIG. 1 is a perspective view of a process cartridge according to Embodiment 1.

As shown in FIG. 1, the developing unit 9 includes a developing roller 6, a developing blade 31, a developing frame 29, a bearing member 45, a developing cover member 32, and so on. Here, the developing frame body in a broad sense includes the developing frame 29, the bearing member 45, the developing cover member 32 and so on (this also applies to the following embodiments). When the cartridge P is attached to the apparatus main assembly 2, the developing frame 29 can move with respect to the apparatus main assembly 2.

Further, the cartridge frame in a broad sense includes the above-described photosensitive unit frame in a broad sense and the developing frame in a broad sense (this also applies to the following embodiments).

The developing frame 29 has a developer accommodating portion 49 for storing the developer to be supplied to the developing roller 6 and a developing blade 31 for regulating the layer thickness of the developer on the circumferential surface of the developing roller 6.

As shown in FIG. 1, the bearing member 45 is fixed to one end side in the longitudinal direction of the developing frame 29. The bearing member 45 rotatably supports the developing roller 6. The developing roller 6 has a developing roller gear 69 at the longitudinal end portion thereof. Details will be described hereinafter. The upstream drive transmission member (upstream transmission member) 37 provided at the driving side end of the developing unit 9 is connected to the main assembly side drive transmission member (main assembly side (62 Y, 62 M, 62 C and 62 K) as the developing drive output member 62 (transmission member). As a result, the driving force from a drive motor (not shown) provided in the main assembly 2 is transmitted to the upstream drive transmission member 37.

[Structure of Developing Unit]

Then, the developing cover member 32 is fixed to the outside of the bearing member 45 with respect to the longitudinal direction of the cartridge P. The developing cover member 32 is constituted so as to cover the developing roller gear 69 and the like.

[Assembly of Drum Unit and Development Unit]

FIG. 5 and FIG. 6 show how the developing unit 9 and drum unit 8 are assembled. At one longitudinal end side of the cartridge P, the outer diameter portion 32*a* of the cylindrical portion 32*b* of the developing cover member 32 is rotatably fitted to the supporting portion 24*a* of the driving side cartridge cover member 24. At the other longitudinal end of the cartridge P, the projecting portion 29*b* projecting from the developing frame 29 is rotatably fitted in the supporting hole portion 25*a* of the non-driving side cartridge cover member 25. By this, the developing unit 9 is rotatably supported relative to the drum unit 8. Here, the rotation center (rotation axis) of the developing unit 9 with respect to the drum unit is referred to as the rotation center (rotation axis) X. This rotation center X is the axis line connecting the center of the support hole 24*a* and the center of the support hole 25*a*.

[Contact Between Developing Roller and Drum]

As shown in FIGS. 4, 5, and 6, the developing unit 9 is urged by an urging spring 95 which is an elastic member (urging member), and rotates about the rotation center X. By this rotation, the developing roller 6 approaches the drum 4 and makes contact thereto. In other words, the developing unit 9 is urged in the direction of the arrow G in FIG. 4 by an urging force of an urging spring 95, and the moment in the direction of the arrow H acts about the rotational center X as the center.

By this, the developing roller 6 is brought close to the drum 4 and can be brought into contact with the drum 4 at a predetermined pressure. The position of the developing unit 9 with respect to the drum unit 8 at this time is a close position (contact position, developing position). The position of the developing roller 6 with respect to the drum 4 at this time may be referred to as a proximity position (contact position, developing position) in some cases. When the developing roller 6 is in the close position, it is possible to supply the toner (developer) to the drum 4 and develop the latent image (electrostatic latent image) formed on the drum 4.

Further, when the developing unit 9 is moved in the direction opposite to the direction of the arrow G against the urging force (elastic force) of the pressure spring 95, the developing roller 6 can be separated from the drum 4. In other words, the developing roller 6 is constituted to be able to approach to and separate from the drum 4.

[Distance Between Developing Roller and Drum]

Figure 7:
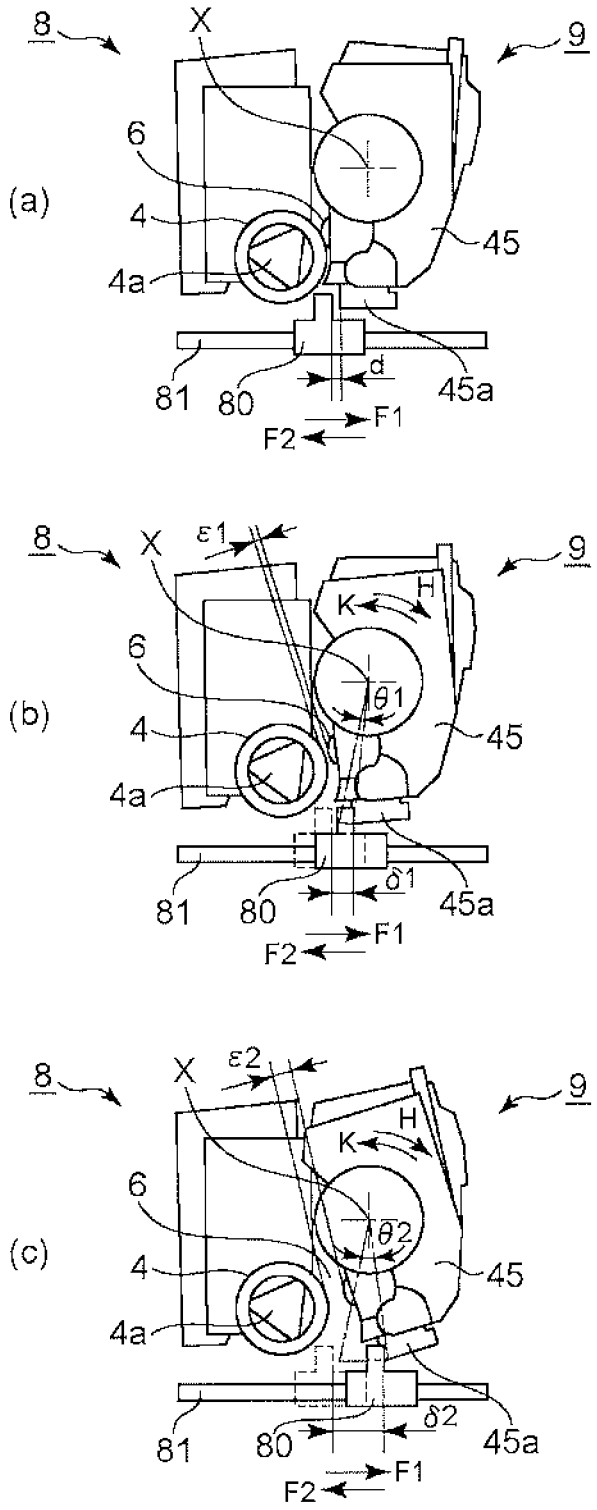
FIG. 7 is a side view of the process cartridge according to Embodiment 1.

FIG. 7 is a side view of the cartridge P as seen from the driving side. In this Figure, some parts are not shown for the sake of easiness of illustration. When the cartridge P is mounted to the main assembly 2, the drum unit 8 is positioned in the main assembly 2.

In this embodiment, the force receiving portion 45*a* is provided on the bearing member 45. The force receiving portion 45*a* may be provided on other than the bearing member 45 (a developing frame, for example) of the cartridge P. The force receiving portion 45*a* as the urging force receiving portion (separation force receiving portion) can be engaged with the main assembly separating member 80 as the main assembly side urging member (separation force applying member) provided in the main assembly 2.

The main assembly spacing member 80 as the main assembly side urging member receives a driving force from a motor (not shown) to move along the rails 81 in directions of arrows F1 and F2.

Part (a) of FIG. 7 shows a state in which the drum 4 and the developing roller 6 are in contact with each other. At this time, the force receiving portion 45*a* and the main assembly separating member 80 are spaced apart with a gap d therebetween.

Part (b) of FIG. 7 shows a state in which the main assembly spacing member 80 has moved by the distance δ1 in a direction of arrow F1 with reference to the state of part (a) of FIG. 7. At this time, the force receiving portion 45*a* is engaged with the main assembly separating member 80. By this, the force receiving portion 45*a* receives a force from the main assembly separating member 80.

As described above, the developing unit 9 is rotatable relative to the drum unit 8. Therefore, by the force received by the force receiving portion 45*a*, the developing unit 9 in the part (b) of FIG. 7 is in a state of having been rotated by the angle θ81 in the direction of the arrow K about the rotation center X as the center. At this time, the drum 4 and the developing roller 6 are spaced from each other by a distance ε1.

Part (c) of FIG. 7 shows a state in which the main assembly spacing member 80 has moved by δ2 (>δ1) in the direction of the arrow F1 with reference to the state of part (a) of FIG. 7. The developing unit 9 is rotated about the rotational center X by the angle θ2 in the direction of the arrow K. At this time, the drum 4 and the developing roller 6 are spaced from each other by a distance ε2.

The distance between the force receiving portion 45*a* and the rotation center of the drum 4 is in the range of 13 mm to 33 mm in this embodiment (the dimension range also applies to the following embodiments).

Further, in this embodiment, the distance between the force receiving portion 45*a* and the rotation center X is in the range of 27 mm to 32 mm (the dimension range also applies to the following embodiments).

[Configuration of Drive Connecting Portion]

Figure 8:
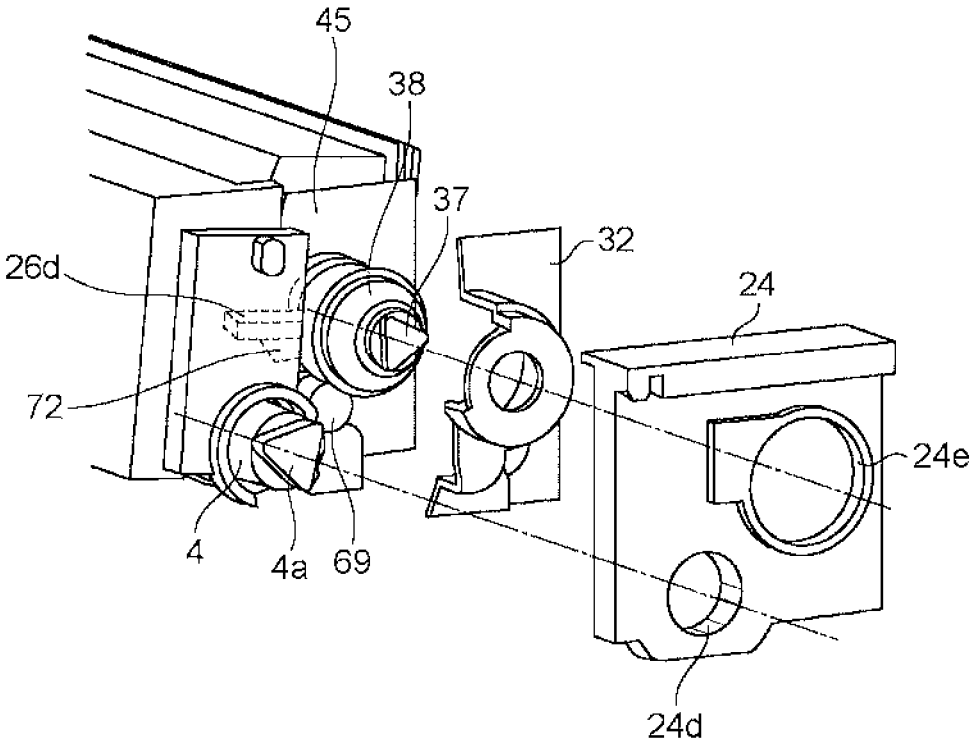
FIG. 8 is a perspective view of the drive connecting portion according to Embodiment 1.

Referring to FIGS. 1 and 8, the structure of the drive connecting portion will be described. Here, the drive connecting portion is a mechanism which receives the drive from the development drive output member 62 of the apparatus main assembly 2 shown in FIG. 3 and transmits and does not transmits the drive to the developing roller 6.

First, the outline will be described.

FIG. 8 is a perspective view of the process cartridge P as viewed from the driving side, showing a state in which the driving side cartridge cover member 24 and the development cover member 32 are removed. The drive side cartridge cover member 24 is provided with openings 24*d* and 24*e*. Through the opening 24*d*, the coupling member 4*a* provided at the end portion of the photosensitive drum 4 is exposed, and the upstream side drive transmission member 37 is exposed through the opening 24*e*. As described above, the coupling member 4*a* is engaged with the drum drive output member 61 (61Y, 61M, 61C, 61K) of the apparatus main assembly 2 shown in part (b) of FIG. 3 to receive the driving force from the drive motor (unshown) of the main assembly. In addition, the upstream side drive transmission member 37 is engaged with the development drive output member 62 (62Y, 62M, 62C, 62K) as the main assembly side drive transmission member of the device main assembly 2 shown in part (b) of FIG. 3, and the driving force from the driving motor (not shown) provided in the apparatus main assembly 2 is transmitted.

At the end of the developing unit 9, an upstream side drive transmission member (upstream side transmission member) 37 as a first drive transmission member, and a downstream side drive transmission member (downstream side transmission member) 38 as a second drive transmission member are rotatably provided. As will be described in detail hereinafter, when the upstream side drive transmission member 37 and the downstream side drive transmission member 38 are engaged with each other by the claw portions, the drive can be transmitted from the upstream side drive transmission member 37 to the downstream side drive transmission member 38. In addition, the gear portion 38 *g* provided on the downstream drive transmission member 38 as the second drive transmission member also engages with the developing roller gear 69. By this, the drive transmitted to the downstream drive transmission member 38 is transmitted to the developing roller 6 via the developing roller gear 69.

Figure 9:
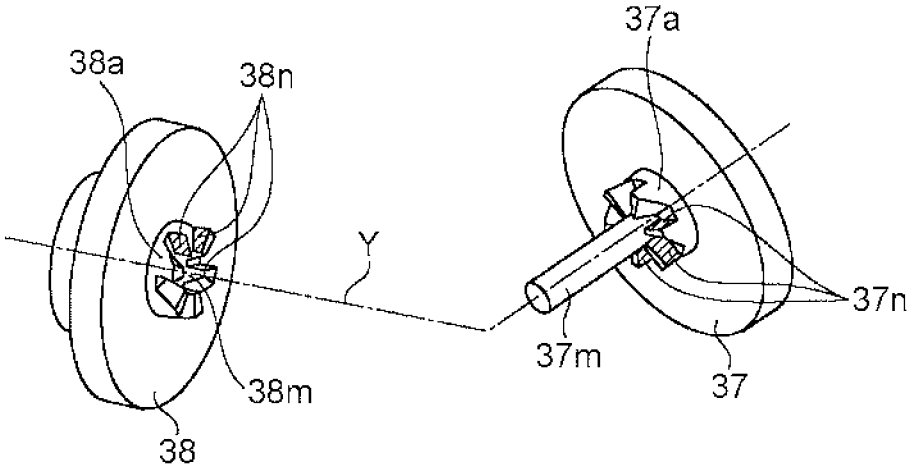
FIG. 9 is a perspective view of the drive connecting portion according to Embodiment 1.
Figure 10:
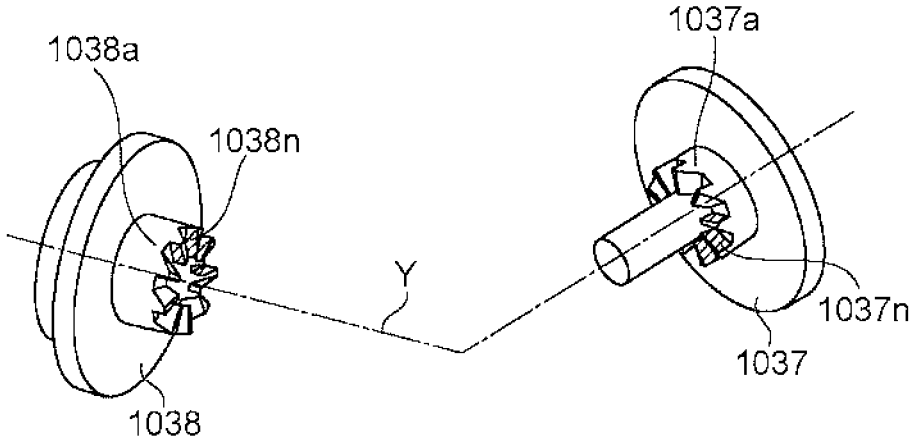
FIG. 10 is a perspective view of the drive connecting portion according to Embodiment 1.

Referring to FIG. 9, the structure of the upstream drive transmission member 37 and the downstream drive transmission member 38 will be described. The upstream drive transmission member 37 has a claw portion 37*a* as an engagement portion (coupling portion), and the downstream drive transmission member 38 has a claw portion 38*a* as an engagement portion (coupling portion). The claw portion 37*a* and the claw portion 38*a* are constituted to be engageable with each other. In other words, the upstream drive transmission member 37 can be connected to the downstream drive transmission member 38. In this embodiment, each of the claw portion 37*a* and the claw portion 38*a* has six claws. In this embodiment, the claw portions 37*a* and claw portions 38*a* each include six claws, but the number is not limited thereto. For example, FIG. 10 shows a case where the numbers of claw portions 1037*a* and the claw portions 1038*a* of the upstream side drive transmission member 1037 are nine. The larger the number of claws, the smaller the load acting on one claw is, and the smaller the deformation and wear of the claw. On the other hand, if the outer diameter of the coupling is made constant, increasing the number of claws may reduce the size of the shape of the claw, and therefore there arises a concern that the rigidity of the claw will be reduced. The number of claws is desirably decided at an appropriate level, taking into consideration the load acting on one claw and the necessary rigidity.

Further, the claw 37*a* is employed as the engaging portion (projecting portion) provided in the upstream side drive transmission member 37, and the claw 38*a* is employed as the engaging portion (projecting portion) provided in the downstream side drive transmission member 38. However, the shape of each engaging portion is not limited to the claw shape. It is only necessary to be able to transmit the drive when the engagement portions are engaged (interfered) with each other.

As shown in FIG. 9, a hole 38*m* is provided at the center of the downstream drive transmission member 38. This hole portion 38*m* is engaged with the small diameter cylindrical portion (circular column portion, shaft portion) 37*m* of the upstream side drive transmission member 37. In other words, the cylindrical portion 37*m* passes through the hole 38*m*. By this, the upstream drive transmission member 37 is rotatably supported relative to the downstream drive transmission member 38 and is slidably supported in the direction of the respective axes.

Figure 11:
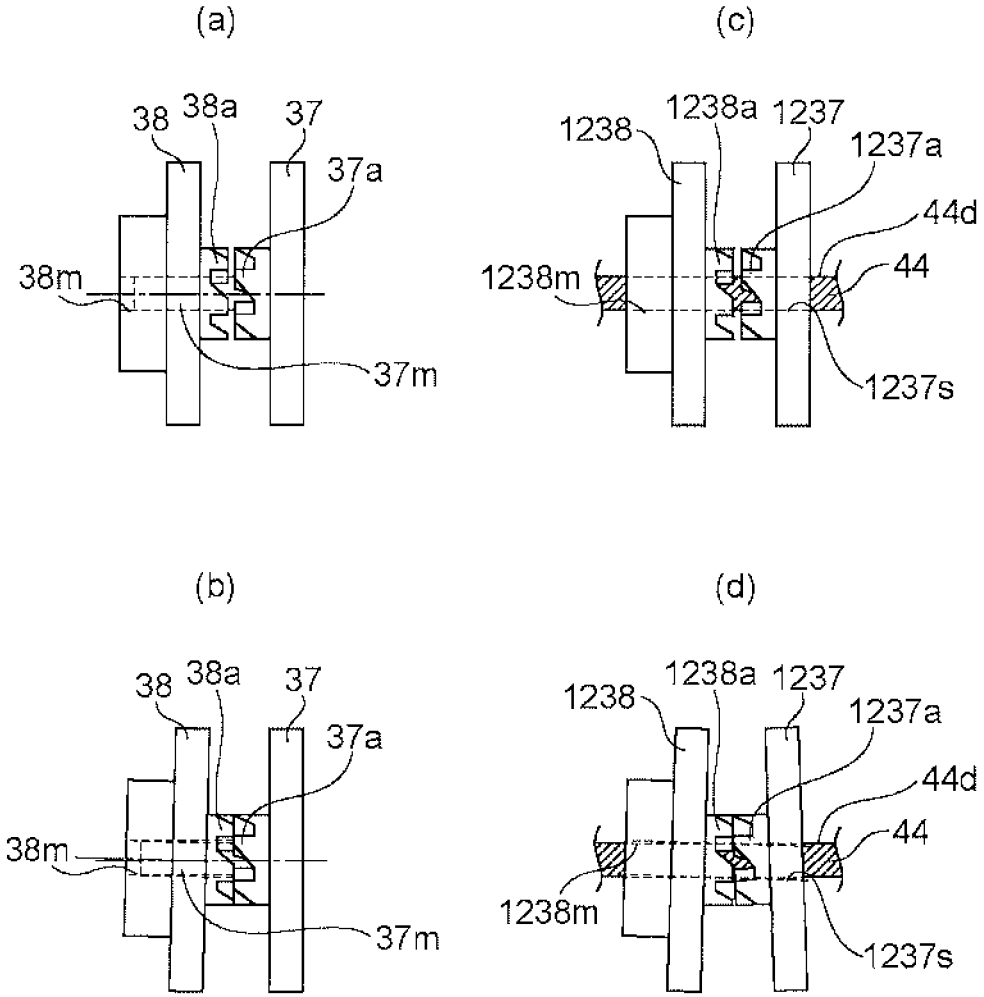
FIG. 11 is a perspective view of the drive connecting portion according to Embodiment 1.

In FIG. 11, the upstream side drive transmission member 37 and the downstream side drive transmission member 38 have different positioning structures. In part (a) of FIG. 11, the hole 38*m* of the downstream side drive transmission member 38 as shown in FIG. 9 and the small diameter cylindrical portion 37*m* of the upstream side drive transmission member 37 are directly engaged with each other, (structure of this embodiment) to properly position them.

On the other hand, it is also possible to employ a structure different from this embodiment. In part (c) of FIG. 11, the upstream side drive transmission member 1237 and the downstream side drive transmission member 1238 are positioned via a shaft (pillar part, shaft part) 44 which is a separate member from the drive transmission members. Specifically, the hole portion 1238*m* of the upstream side drive transmission member 1237 supports the outer peripheral portion 44*d* of the shaft 44 so as to be rotatable and slidable along the axis thereof. The hole portion 1037*s* of the upstream side drive transmission member 1037 supports the outer peripheral portion 44*d* of the shaft 44 so as to be rotatable and slidable along the axis thereof. By this, positioning of the downstream drive transmission member 1038 relative to the upstream drive transmission member 1037 is effected.

Either of the structure of part (a) of FIG. 11 and the structure of part (c) of FIG. 11 can be employed. On the other hand, the structure shown in part (a) of FIG. 11 has advantages compared with the structure of part (c), in that the number of parts for determining relative position between the upstream drive transmission member 37 and the downstream drive transmission member 38 can be reduced. By this, the rotation accuracy of each drive transmission member can be easily maintained.

Part (b) of FIG. 11 illustrates a state in which the upstream side drive transmission member 37 and the downstream side drive transmission member 38 shown in part (a) of FIG. 11 did not properly shift from a drive disconnection state to the drive transmission state. The drive transmission and disconnecting operations will be described in detail hereinafter. There is fit looseness (play) between the hole portion 38*m* of the downstream side drive transmission member 38 and the small diameter cylindrical portion 37*m* of the upstream side drive transmission member 37. In the Figure, the fitting play (play) is intentionally exaggerated for better understanding. If the aforementioned play in the fitting is large and when the upstream side drive transmission member 37 and the downstream side drive transmission member 38 are engaged with each other, these two parts may be misaligned relative to each other and cannot engage with each other (Part (b) of FIG. 11). Therefore, it is necessary to limit such fitting play within the allowable range. In the structure of part (a) of FIG. 11, the downstream drive transmission member 38 and the upstream drive transmission member 37 directly engage. Therefore, it is easy to reduce the fitting play between the downstream side drive transmission member 38 and the upstream side drive transmission member 37.

On the other hand, part (d) of FIG. 11 shows the state between the upstream side drive transmission member 1037 as the first drive transmission member and the downstream side drive transmission member 1038 as the second drive transmission member, when the engagement therebetween did not properly shift from the drive disconnection state shown in part (c) of FIG. 11 to the drive transmission state. As shown in the Figure, the upstream side drive transmission member 1037 and the downstream side drive transmission member 1038 are relatively misaligned due to the influence of the number of parts and the dimensional error of parts. The relative misalignment amount at this time may be larger in the structure shown in FIG. 11 (*d*) than in the structure shown in part (b) of FIG. 11. When the claw portion 1037*a* and the claw portion 1038*a* of the coupling are brought into engagement with each other in a state in which the upstream side drive transmission member 1037 and the downstream side drive transmission member 1038 are relatively misaligned in this manner, To change from the drive disconnection state to the drive transmission state, The following possibilities may arise. As shown in part (d) of FIG. 11, there is a possibility that the claw portion 1037*a* of the coupling and the claw portion 1038*a* are likely to be brought into contact only at their respective free ends, which may adversely affect the drive transmission.

From the above viewpoint, it is preferable that the upstream drive transmission member 37 and the downstream drive transmission member 38 are directly positioned with each other (FIG. 9, part (a) of FIG. 11). In the structure shown in part (a) of FIG. 11, effects such as reduction in the number of parts and reduction in assembly steps can be provided.

However, it is not impossible to employ the structure of FIG. 11 (*c*), but if the dimensions of each member are strictly controlled, the fitting play can be restricted within an allowable range, and drive transmission can be stably e.

Between the bearing member 45 and the driving side cartridge cover member 24, the following members are provided in the order from the bearing member 45 toward the driving side cartridge cover member 24. As shown in FIG. 1, a release cam 72, the downstream side drive transmission member 38 as a second coupling member, a spring 70 as an elastic member as an urging member, the upstream side drive transmission member 37 as a first coupling member, and the development cover member are provided. These members are provided coaxially with the upstream drive transmission member 37. In other words, the upstream drive transmission member, the spring 70, and the downstream drive transmission member 38 are disposed coaxially along the same rotation axis and are rotatable about the same axis.

In this embodiment, the drive connecting portion is constituted by the bearing member 45, the release cam 72, the downstream side drive transmission member 38, the spring 70, the upstream side drive transmission member 37, the development cover member 32, and the driving side cartridge cover member 24. The release cam (cam member) 72 is a part of the release mechanism, it is also a coupling releasing member, and it is also an acting member.

Figure 12:
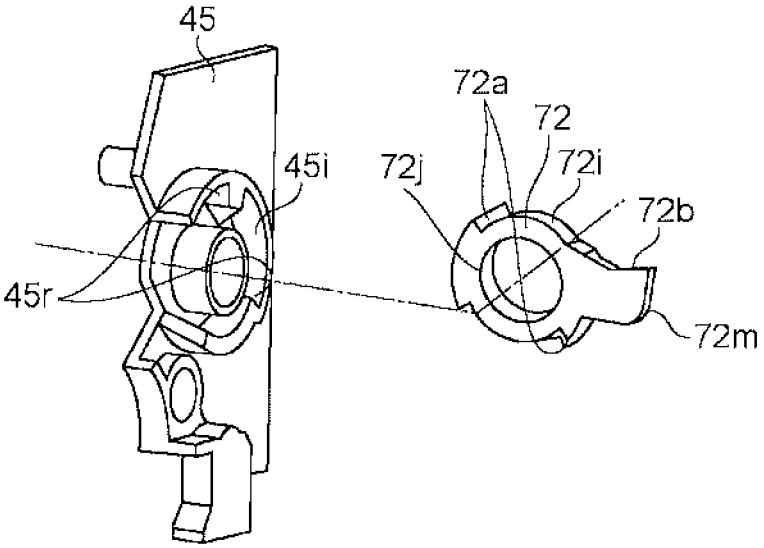
FIG. 12 is a perspective view of a releasing member and peripheral components according to Embodiment 1.

FIG. 12 shows the relationship between the release cam 72 and the bearing member 45. The release cam 72 has a substantially ring-shaped portion 72*j*. The ring portion 72*j* has an outer peripheral surface 72*i* as a second guided portion, and the bearing member 45 has an inner peripheral surface 45*i* as a part of the second guide portion. The inner peripheral surface 45*i* is constituted to engage with the outer peripheral surface 72*i*. The outer peripheral surface 72*i* of the release cam 72 and the inner peripheral surface 45*i* of the bearing member 45 are both disposed on the same straight line (coaxial) as the rotation center X. In other words, the release cam 72 can slide (translate) with respect to the bearing member 45 and the developing unit 9 along the rotation axis X (axial direction). The release cam 72 is supported also rotatably relative to the developing unit 9 in the rotational direction about the axis X.

Further, the ring portion 72*j* of the release cam 72 as a coupling releasing member has a contact portion (inclined surface, cam portion) 72*a* as a force receiving portion. The bearing member 45 has a contact portion (inclined surface, cam portion) 45*r* as a force applying portion for applying a force to the contact portion 72*a*. The contact portion 72*a* and the contact portion 45*r* are inclined portions inclined with respect to the direction in which the developing unit 4 moves relative to the drum unit 8.

The contact portion 72*a* of the release cam 72 and the contact portion 45*r* of the bearing member 45 are constituted to be in contact with each other. As will be described in detail hereinafter, the release cam 72 and the bearing member 45 constitute a cam mechanism, and this cam mechanism is operated by the movement of the developing unit 9.

Figure 13:
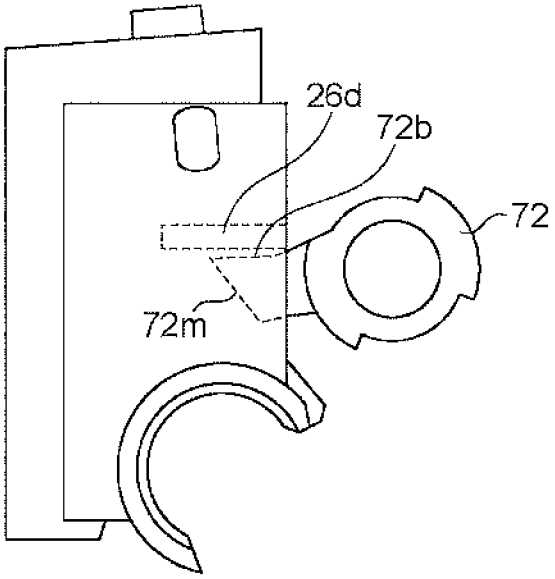
FIG. 13 is a perspective view of the releasing member and the peripheral components according to Embodiment 1.

FIG. 13 shows the structure of the release cam 72 and a regulating portion 26*d* provided in the cleaning container 26. In this embodiment, the regulating portion 26*d* provided on the cleaning container 26 is provided inside the cleaning container, but it may be placed anywhere in the cleaning container 26 depending on the shape of the cleaning container 26. The release cam 72 has a projecting portion 72*m* projecting from the ring portion 72*j*. This projecting portion has a force receiving portion 72*b* as a second guided portion. The force receiving portion 72*b* receives a force from the cleaning container 26 by engaging with the regulating portion 26*d* as a part of the second guide portion of the cleaning container 26. The force receiving portion 72*b* projects from the developing cover member 32 to engage with the regulating portion 26*d* of the cleaning container 26. Because the regulating portion 26*d* and the force receiving portion 72*b* are engaged with each other, the releasing cam 72 can slide relative to the driving side cartridge cover member 24 only in the axial direction (the arrow M and N directions). In other words, the rotation of the release cam 72 is regulated (limited) relative to the drum unit (cleaning container 26).

In addition, the outer diameter portion 32*a* of the cylindrical portion 32*b* of the developing device cover member 32 is constituted to slide relative to the sliding portion 24*a* (cylindrical inner surface) of the driving side cartridge cover member 24. In other words, the outer diameter portion 32*a* is rotatably coupled with the sliding portion 24*a*.

In the drive switching operation which will be described hereinafter, when the release cam 72 slides in the axial direction (arrows M and N directions), the axis may tilt relative to the axial direction. Due to the occurrence of axis tilting, deterioration of drive switching performance such as timing difference of drive connection and disconnecting operation is concerned. In order to suppress the axis tilting of the release cam 72, the sliding resistance between the outer peripheral surface 72*i* of the release cam 72 and the inner peripheral surface 45*i* of the bearing member 45, and the sliding resistance between the force receiving portion 72*b* of the release cam 72 and the regulating portion 26*d* of the cleaning container 26 is preferably reduced.

From the foregoing, the release cam 72 is engaged with both the inner peripheral surface 45*i* of the bearing member 45 and the regulating portion 26*d* of the cleaning container 26. In other words, the release cam 72 is slidable (rotatable) in the rotational direction about the axis X and the axial direction (arrows M and N directions) relative to the developing unit 9. On the other hand, the release cam 72 is constituted to be slidable in the axial direction (the arrow M and N directions) relative to the drum unit 8 (driving side cartridge cover member 24).

Figure 15:
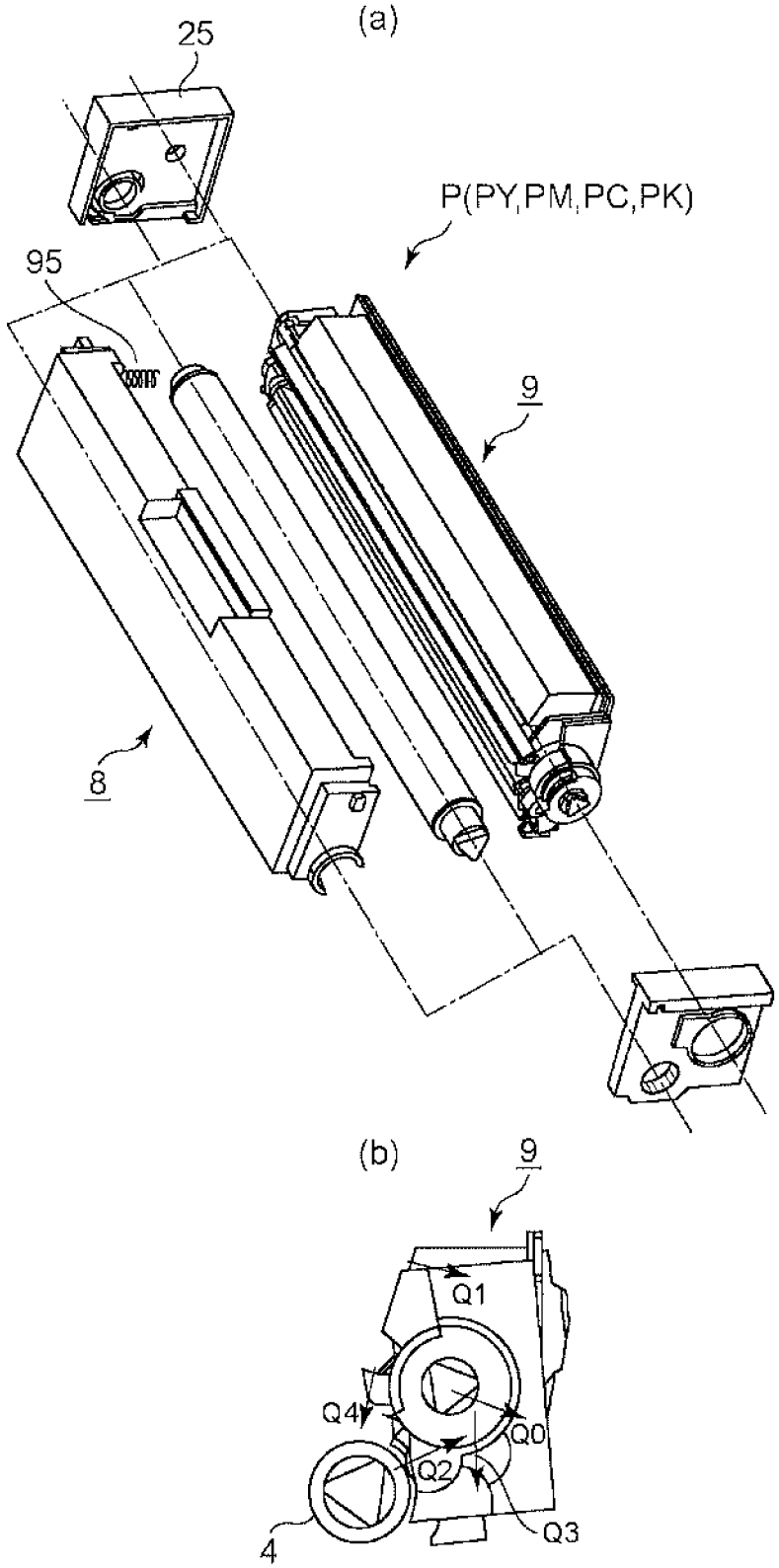
FIG. 15 is a perspective view of the process cartridge according to Embodiment 1.

Here, part (a) of FIG. 15 is a perspective view of the cartridge P schematically showing the force acting on the developing unit 9. Part (b) of FIG. 15 shows a part of a side view of the cartridge P as viewed along the axis X direction.

A reaction force Q1 from the pressure spring 95, a reaction force Q2 received from the drum 4 via the developing roller 6, a weight Q3 of itself, and the like are applied to the developing unit 9. In addition to this, the release cam 72 is engaged with the cleaning container 26 to receive the reaction force Q4 (the details will be described hereinafter) during the drive coupling operation. The resultant force Q0 of the reaction forces Q1, Q2, Q4 and the self weight Q3 applies to the supporting holes 24*a* and 25*a* of the driving side and non-driving side cartridge cover members 24 and 25 that rotatably support the developing unit 9.

Figure 14:
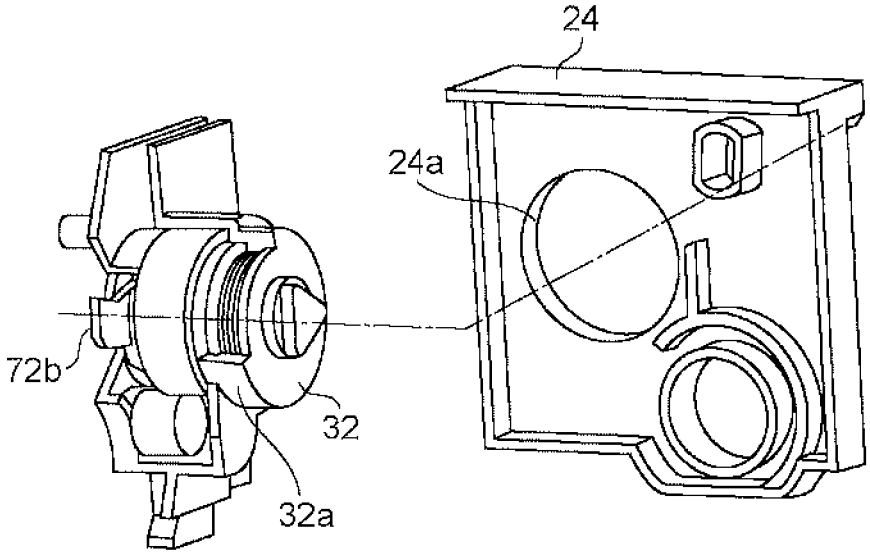
FIG. 14 is a perspective view of the drive connecting portion according to Embodiment 1.

That is, when the cartridge P is viewed along the axial direction (part (b) of FIG. 15), the sliding portion 24*a* of the driving side cartridge cover member 24 which contacts the developing device cover member 32 is required in the direction of the resultant force Q0. In other words, the sliding portion 24*a* of the driving side cartridge cover member 24 is provided with a resultant force receiving portion 24*a*1 which receives the resultant force Q0 (see FIG. 14). On the other hand, the cylindrical portion 32*b* of the developing device cover member 32 and the sliding portion 24*a* of the driving side cartridge cover member 24 are not necessarily required except in the direction of the resultant force Q0. In this embodiment, in view of the above, the opening 32*c* is provided in a part of the cylindrical portion 32*b* which slides relative to the driving side cartridge cover member 24 of the developing cover member 32 in a direction which is not the direction of the resultant force Q0 (In this embodiment, on the side opposite to the resultant force Q0). In addition, a release cam 72 which engages with the regulating portion 26*d* of the cleaning container 26 is disposed in the opening 32*c*.

Figure 16:
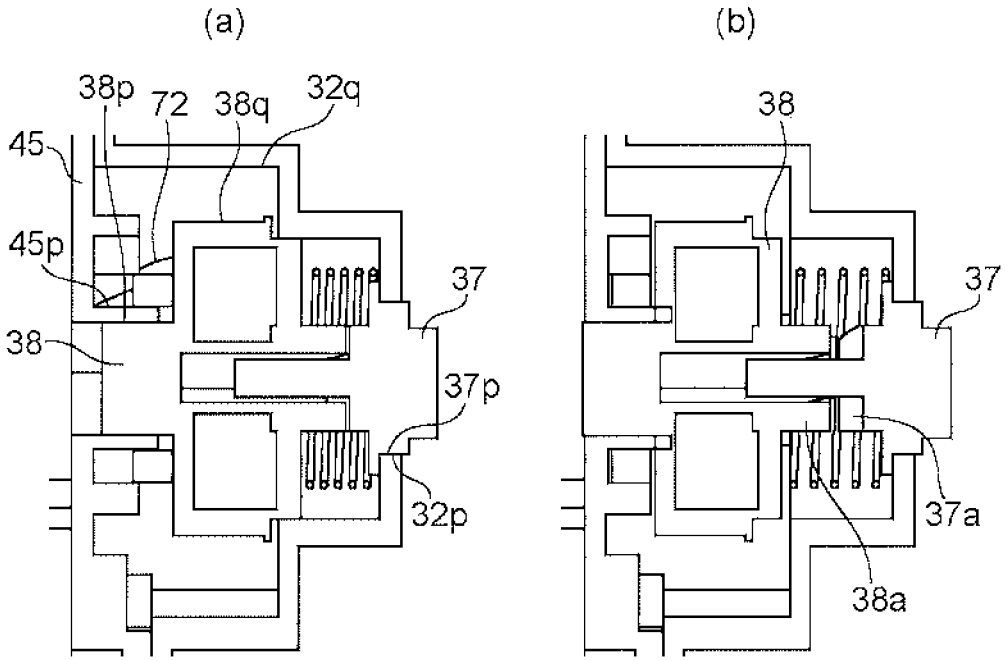
FIG. 16 is a cross-sectional view of the drive connecting portion according to Embodiment 1.

Parts (a) of FIG. 16 and part (b) thereof are cross-sectional views of the drive connecting portion.

The cylindrical portion 38*p* (cylindrical inner surface) of the downstream side drive transmission member 38 and the first bearing portion 45*p* (cylindrical outer surface) of the bearing 45 are engaged with each other. The cylindrical portion 38*q* (cylindrical outer surface) of the downstream side drive transmission member 38 and the inner diameter portion 32*q* of the developing cover member 32 are engaged with each other. "$in" In other words, both ends of the downstream side drive transmission member 38 are rotatably supported by the bearing member 45 and the developing cover member 32.

Further, the cylindrical portion 37*p* (cylindrical outer surface) of the upstream side drive transmission member 37 and the hole portion 32*p* of the developing cover member 32 are engaged with each other. By this, the upstream drive transmission member 37 is slidably (rotatably) supported relative to the development cover member 32.

Further, the first bearing portion 45*p* (the cylindrical outer surface) of the bearing member 45, the inner diameter portion 32*q* of the developing cover member 32, and the hole portion 32*p* are disposed coaxially with the rotation center X of the developing unit 9. In other words, the upstream drive transmission member 37 is supported rotatably about the rotation center X of the development unit 9. As described above, the cylindrical portion 37*m* of the upstream drive transmission member 37 and the hole portion 38*m* of the downstream drive transmission member 38 are engaged with each other (FIG. 9). By this, the downstream drive transmission member 38 is also supported so as to be rotatable about the rotation center X of the developing unit 9, as a result.

In the sectional view of the drive connecting portion shown in part (a) of FIG. 16, the claw 38*a* of the downstream side drive transmission member 38 and the claw 37*a* of the upstream side drive transmission member 37 are engaged with each other.

Further, in the cross-sectional view of the drive connecting portion shown in part (b) of FIG. 16, the claw 38*a* of the downstream side drive transmission member 38 and the claw 37*a* of the upstream side drive transmission member 37 are separated from each other.

[Drive Release Operation]

Hereinafter, the operation of the drive connecting portion when the developing roller 6 and the drum 4 change from the contact state to the separated state will be described.

[State 1]

Figure 17:
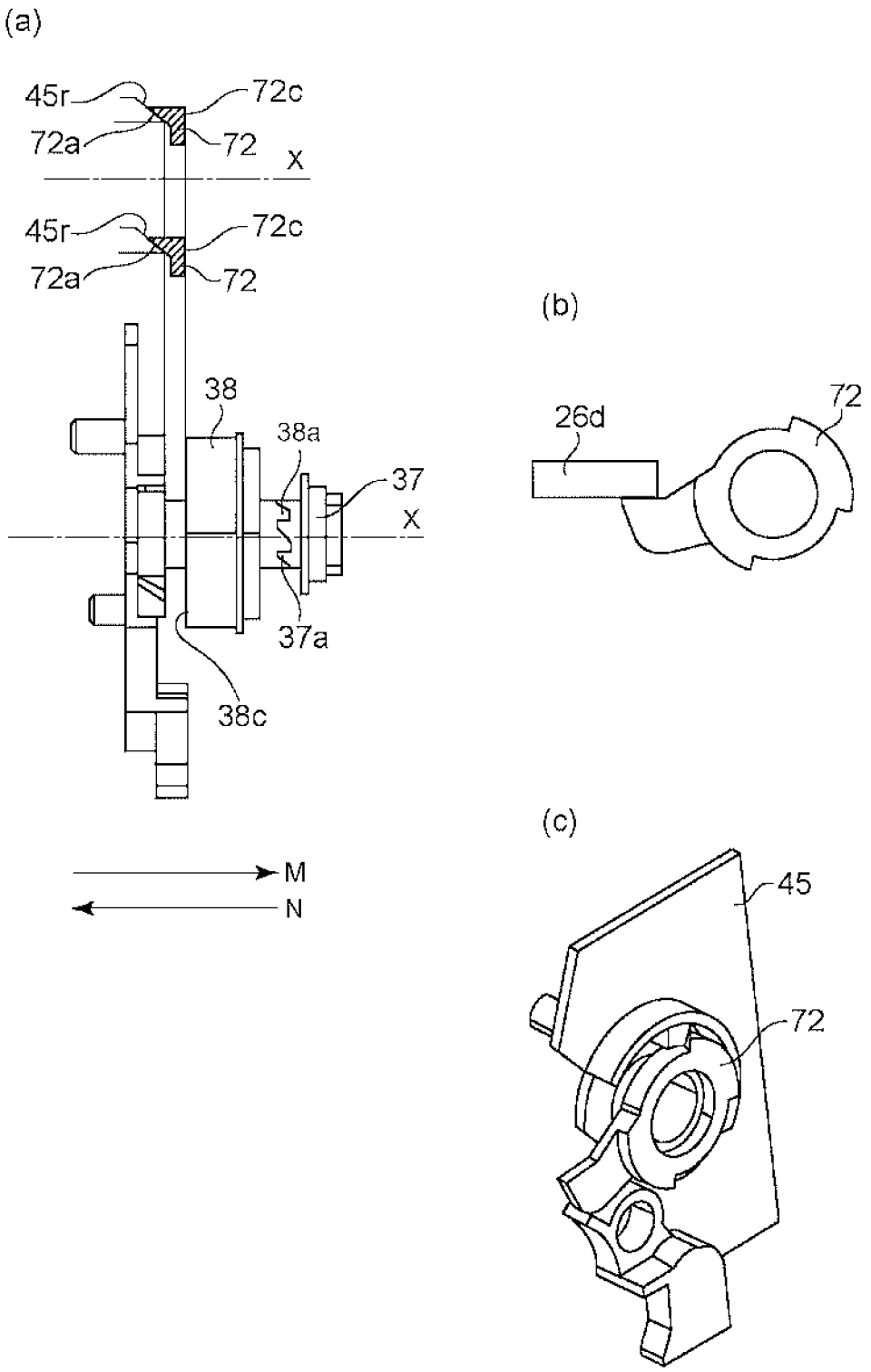
FIG. 17 is a schematic view and a perspective view of the drive connecting portion according to Embodiment 1.

As shown in part (a) of FIG. 7, the main assembly separating member 80 and the force receiving portion 45*a* of the bearing member 45 are separated from each other by a gap d. At this time, the drum 4 and the developing roller 6 are in contact with each other. This state is defined as the state 1 of the main assembly separating member 80. The structure of the drive connecting portion at this time is schematically shown in part (a) of FIG. 17 and part (b) of FIG. 17. In addition, part (c) of FIG. 17 is a perspective view of the structure of the drive connecting part. Parts (a), (b) and part (c) of FIG. 17 does not shown some parts for the sake of better illustration. In Part (a) of FIG. 17, the pair of the upstream side drive transmission member 37 and the downstream side drive transmission member 38, and the pair of the release cam 72 and the bearing member 45 are shown separately. In part (a) of FIG. 17, only a part including the contact portion 45*r* is shown in the bearing member 45, and only a part including the regulating portion 26*d* is shown in the cleaning container 26. At this time, the claws 37*a* of the upstream side drive transmission member 37 and the claws 38*a* of the downstream side drive transmission member 38 are engaged with each other with the engagement amount q so that the drive transmission can be carried out. As described above, the downstream drive transmission member 38 is engaged with the developing roller gear 69 (FIG. 59). Therefore, the drive force inputted from the main assembly 2 to the upstream drive member 37 is transmitted to the developing roller gear 69 by way of the downstream drive transmission member 38. By this, the developing roller 6 is driven. The above state of each part is referred to as contact position, and it is called development contact and drive transmission state.

Further, the position of the downstream side drive transmission member 38 at this time is particularly called a transmission position (connection position, engagement position). The position of the release cam 72 at this time is particularly called a maintaining position (urging position). When the release cam 72 is in the maintaining position, it urges the downstream side drive transmission member 38 against the elastic force of the spring 70 toward the upstream side drive transmission member 37. By this, the release cam 72 holds the downstream drive transmission member 38 in the transmission position.

That is, the release cam 72 functions as a maintaining member (urging member) for urging the downstream side drive transmission member 38 to maintain it in the transmission position.

[State 2]

As shown in part (b) of FIG. 7, when the main assembly separating member 80 moves by δ1 in the direction of the arrow F1 in the drawing from the developing contact and the driving transmission state, as described above, the developing unit 9 rotates about the rotational center X in the direction of the arrow K by an angle θ1. As a result, the developing roller 6 is spaced from the drum 4 by a distance ε1. The bearing member 45 incorporated in the developing unit 9 rotates in the direction of the arrow K by an angle θ1 in interrelation with the rotation of the developing unit 9. On the other hand, the release cam 72 is incorporated in the developing unit 9, but as shown in FIG. 13, the force receiving portion 72*b* is engaged with the engaging portion 26*d* of the cleaning container 26. Therefore, even if the developing unit 9 rotates, the release cam 72 does not rotate.

Here, the release cam 72 and the bearing member 45 constitute a cam mechanism for moving the downstream side drive transmission member 38 in interrelation with the movement (rotation) of the developing unit 9. When the bearing member 45 rotates relative to the release cam 72, the release cam 72 moves along the X axis. As the release cam 72 moves along the X axis, the downstream drive transmission member 38 also moves along the X axis together with the release cam 72.

When the developing unit 9 rotates in the direction of the arrow k1 (see part (b) of FIG. 7), the abutment portion 45*r* of the bearing member 45 relatively moves with respect to the abutment portion 72*a* of the release cam 72. At this time, the release cam 72 is pressed by the spring 70 by way of the downstream side drive transmission member 38. Therefore, the contact portion 72*a* slides and moves relative to the contact portion 45*r* using the force of the spring 70. The release cam 72 itself also slides in the N direction of the X axis relative to the bearing member 45 using the force of the spring 70. In other words, the release cam 72 retracts away from the downstream side drive transmission member 38.

When the release cam 72 retracts, the downstream side drive transmission member 38 moves in the N direction while pushing the release cam 72 in the N direction by the force of the spring 70.

Figure 18:
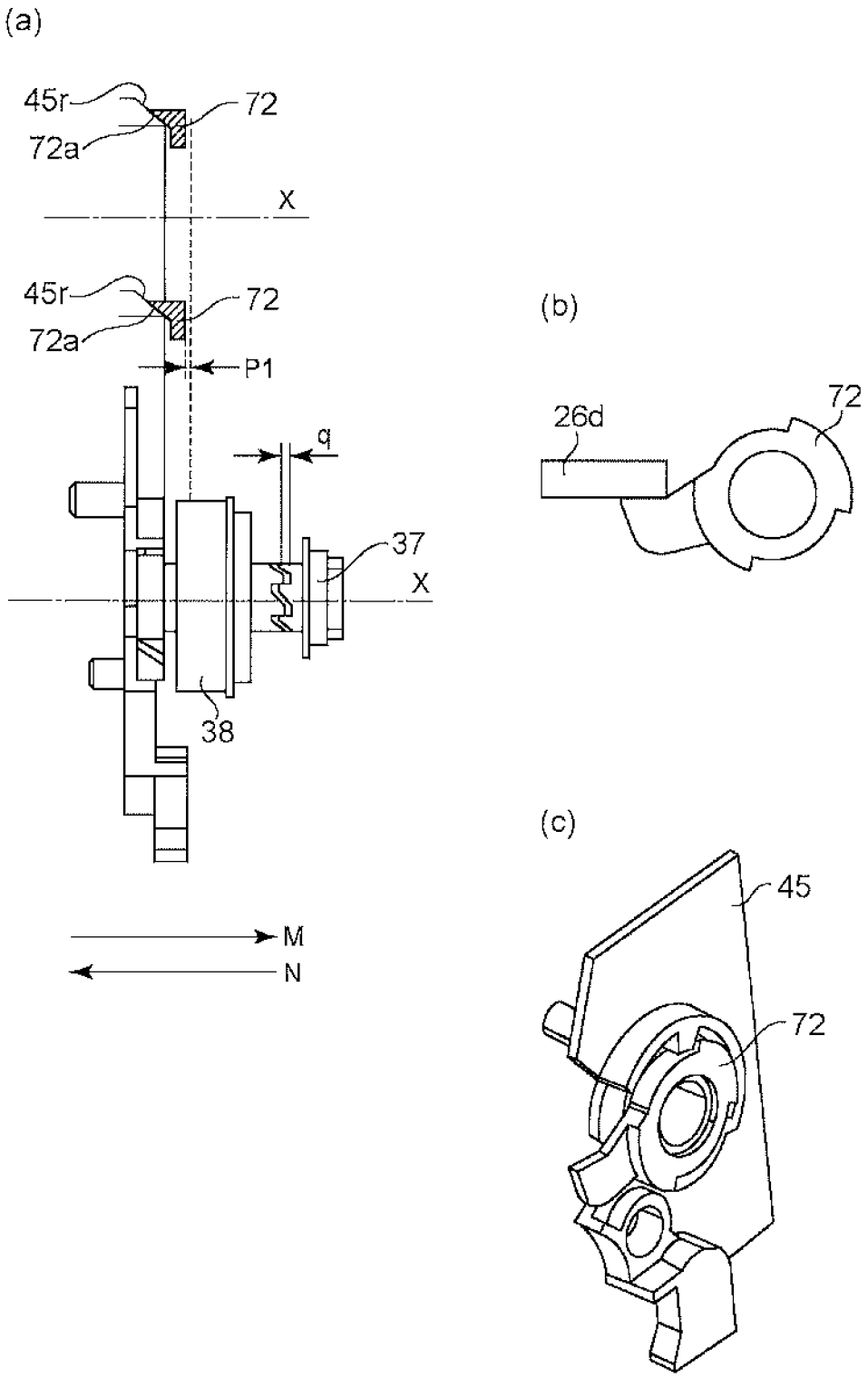
FIG. 18 is a schematic view and a perspective view of the drive connecting portion according to Embodiment 1.

In a state (see part (b) of FIG. 7) in which the developing unit 9 is rotated by the angle θ1 in the direction of the arrow K, as shown in part (a), part (b), and part (c) of FIG. 18, the contact portion 72*a* of the release cam 72 is moved by p1 in the arrow N direction relative to the contact portion 45*r* of the bearing member 45. At this time, the downstream drive transmission member 38 also moves in the arrow N direction by p1. Since this movement amount p1 is smaller than q, the claw 37*a* of the upstream side drive transmission member 37 and the claw 38*a* of the downstream side drive transmission member 38 are kept in a state of engagement with each other (part (a) of FIG. 18). In other words, it can be said downstream side drive transmission member 38 is still in the transmission position.

Therefore, the driving force inputted from the apparatus main assembly 2 to the upstream side drive transmission member 37 is transmitted to the developing roller 6 by way of the downstream side drive transmission member 38 and the developing roller gear 69. The above state of each part is called development separation and drive transmission state. In the state 1 described above, the force receiving portion 72*b* does not necessarily have to be in contact with the engaging portion 26*d* of the cleaning container 26. In other words, in the state 1, the force receiving portion 72*b* may be disposed with a clearance from the engaging portion 26*d* of the cleaning container 26. In this case, the gap between the force receiving portion 72*b* and the engaging portion 26*d* of the cleaning container 26 disappears during the operation from the state 1 to the state 2, and the force receiving portion 72*b* comes into contact with the engaging portion 26*d* of the cleaning container 26.

[State 3]

Figure 19:
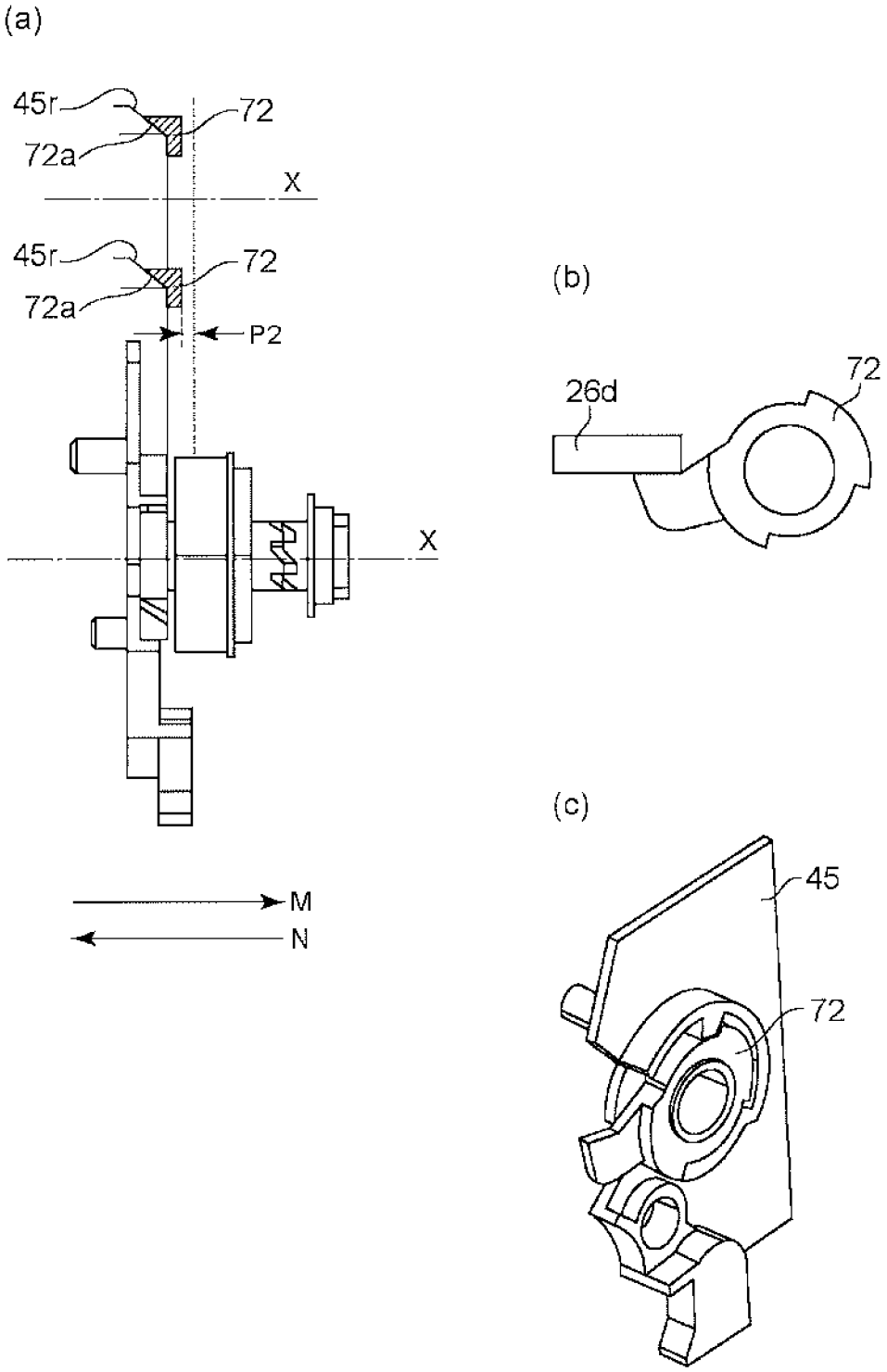
FIG. 19 is a schematic view and a perspective view of the drive connecting portion according to Embodiment 1.

The structure of the drive coupling part is shown in part (a) of FIG. 19 and part (b) of FIG. 19, when the main assembly separating member 80 moves by δ2 in the direction of the arrow F1 in the Figure as shown in FIG. 7 (c) from the developing separation and driving transmission state. The bearing member 45 rotates in interrelation with the rotation of the developing unit 9 to the angle θ2 (>θ1). At this time, the release cam 72 is restricted so as to be movable only in the axial direction (the arrows M and N directions) (FIG. 13) by the engagement of the force receiving portion 72*b* thereof with the engaging portion 26*d* of the cleaning container 26. The contact portion 72*a* of the release cam 72 slides relative to the contact portion 45*r* of the bearing member 45. By this, the release cam 72 and the downstream drive transmission member 38 slide by the movement amount p2 in the direction of the arrow N by the pressing force of the spring 70 (FIG. 19 and part (b) of FIG. 16).

at this time, since the amount of movement p2 is larger than the engagement amount q between the claw 37*a* of the upstream drive transmission member 37 and the claw 38*a* of the downstream drive transmission member 38, the engagement of the claw 37*a* and the claw 38*a* is broken. Following this, the upstream drive transmission member 37 continues to rotate because the driving force is inputted from the main assembly 2, whereas the downstream drive transmission member 38 stops. By this, the rotation of the developing roller gear 69 and the developing roller 6 stops. The above state of each part is referred to as a separation position and is referred to as development separation and drive shut-off state.

Further, the position of the downstream side drive transmission member 38 at this time is particularly referred to as a blocking position (release position). The position of the release cam 72 at this time is particularly referred to as a permitting position. The release cam 72 moves from the maintaining position to the permitting position, thereby allowing the downstream drive transmission member 38 to move to the blocking position by the force of the spring 70.

If the drive transmission is blocked when the downstream drive transmission member 38 is in the blocking position, a structure is possible in which the claw 37*a* is intermittently brought into contact with the claw 38*a* when the upstream drive transmission member 37 rotates. Even in this state, it can be regarded that the connection of the upstream side and the downstream side drive transmission member has been broken. However, in order to suppress the wearing of the claws 37*a* and the claws 38*a*, or to suppress the occurrence of the noise in the state in which the drive transmission is disconnectedin, Claw 38*a* of the downstream drive transmission member 38 and the claw 37*a* of the upstream drive transmission member 37*a* are preferably not in contact with each other when the drive connection is released.

The operation of shutting off the drive to the developing roller 6 in interrelation with the rotation of the developing unit 9 in the direction of the arrow K has been described. In summary, the process cartridge has a drive transmission member (downstream drive transmission member 38) which is rotatable and movable along the axial direction. This downstream drive transmission member 38 is movable between A transmission position (part (a) of FIG. 16) for drivingly connecting with the upstream side transmission member (upstream side drive transmission member 37) and a blocking position (part (b) of FIG. 16) where the drive connection is broken.

As the developing roller 6 separates from the state in which it is close to the photosensitive drum 4 (that is, as the developing roller moves from the close position to the separated position), the downstream side drive transmission member 38 moves from the transmission position to the blocking position.

By employing the above structure, the developing roller 6 can be separated from the drum 4 while rotating, and it is possible to shut off the drive to the developing roller 6 in accordance with the distance between the developing roller 6 and the drum 4.

At this time, the downstream drive transmission member 38 is moved by utilizing the elastic force of the spring 70 disposed between the downstream side drive transmission member 38 and the upstream side drive transmission member 37. Since the downstream drive transmission member 38 can be stably moved from the transmission position to the blocking position by utilizing the elastic force, it is possible to reliably shut off the drive transmission in response to the separation of the developing roller 6.

When the developing roller 6 is not in use, the developing roller 6 is separated from the drum 4 and the driving of the developing roller 6 is stopped, whereby it is possible to reduce the load applied to the toner and the like carried on the developing roller 6 and to the developing roller 6.

[Drive Coupling Operation]

Next, the operation of the drive connecting portion when the developing roller 6 and the drum 4 change from a state in which they are separated from each other to a state in which they are in contact with each other will be described. This operation is the reverse of the above-described operation from the developing contact state to the development separated state. As the developing roller 6 approaches to the close position from the state where it is separated from the photosensitive drum 4 (that is, as the developing roller 6 moves from the separated position to the close position), The downstream drive transmission member 38 moves from the blocking position (part (b) of FIG. 16) to the transmission position (part (a) of FIG. 16).

In the development separated state (the state in which the developing unit 9 has rotated by the angle θ2 as shown in FIG. 7 (*c*)), the drive connecting portion is as shown in parts (a), part (b) and part (c) of FIG. 19. In other words, the engagement between the claw 37*a* of the upstream drive transmission member 37 and the claw 38*a* of the downstream drive transmission member 38 are out of engagement from each other.

When the developing unit 9 is gradually rotated in the direction of the arrow H shown in FIG. 7 from the above state, the state in which the developing unit 9 is rotated by the angle θ1 (part (b) of FIG. 7 and FIG. 18 The state shown in part (a), part (b), part (c) of FIG. 7).

In this state, the force receiving portion 72*d* of the release cam 72 is engaged with the engagement portion 26*d* of the cleaning container 26 and does not rotate. Therefore, the bearing member 45 moves relative to the release cam 72. By this, the abutment portion 45*r* of the bearing member 45 urges the abutment portion 72*a* while sliding relative to the abutment portion 72*a* of the releasing cam 72. The release cam 72 slides only in the direction of the arrow M due to the force received from the contact portion 45*r*.

In conjunction with the movement of the release cam 72 in the direction of arrow M, the urging surface 72*c* as the urging portion (force applying portion) of the release cam 72 urges against the urged surface 38*c* as an urged portion (force receiving portion). As the downstream drive transmission member 38 moves in the direction of the arrow M against the pressing force of the spring 70, the claws 37*a* of the upstream drive transmission member 37 and the claws 38*a* of the downstream drive transmission member 38 are engaged with each other.

The abutment portion 45*r* of the bearing member 45 acts as a cam portion to convert the force for rotationally moving the developing unit 9 relative to the drum unit 8 to a force for urging the release cam 72 and the downstream side drive transmission member 38 in the direction of the arrow M. The force generated by the contact portion 45*r* contacting the contact portion 72*a* moves the downstream drive transmission member 38 to the transmission position.

The release cam 72 also acts as a moving member (urging member) for urging the downstream side drive transmission member 38 and moving it to the drive transmission position against the force of the spring 70. By this, the driving force is transmitted from the main assembly 2 to the developing roller 6, so that the developing roller 6 is rotationally driven. At this time, the developing roller 6 and the drum 4 are kept apart from each other.

Further, by gradually rotating the developing unit 9 in the direction of the arrow H shown in FIG. 7 from the above state, the developing roller 6 and the drum 4 can be brought close to each other or in contact with each other.

The operation of the drive transmission to the developing roller 6 in interrelation with the rotation of the developing unit 9 in the direction of arrow H has been described above. With the above structure, the developing roller 6 contacts the drum 4 while rotating, and can transmit the drive to the developing roller 6 in accordance with the distance between the developing roller 6 and the drum 4.

In the above description, the force receiving portion 72*b* of the release cam 72 is constituted to be engaged with the regulating portion 26*d* of the cleaning container 26, but this is not necessarily required. The force receiving portion 72*b* may be engaged with the driving side cartridge cover member 24, for example. The driving side cartridge cover member 24 is also a member constituting the drum unit 8 like the cleaning container 26.

Embodiment 2

Next, a cartridge according to Embodiment 2 of the present invention will be described. The description of the same structure as in Embodiment 1 will be omitted.

In Embodiment 1, the drive transmission member that moves (translates) along the axial direction between the transmission position and the blocking position is the downstream side transmission member (the downstream side drive transmission member 38). In contrast, in this embodiment, the upstream drive transmission member (the upstream drive transmission member 237) moves between the transmission position (part (a) of FIG. 23) and the blocking position (part (b) of FIG. 23). By this, the upstream side drive transmission member 237 switches the drive connection state and the drive disconnection state relative to the downstream side transmission member (the downstream side drive transmission member 238). Below, the description will be made in detail.

[Structure of Drive Connecting Portion]

Figure 20:
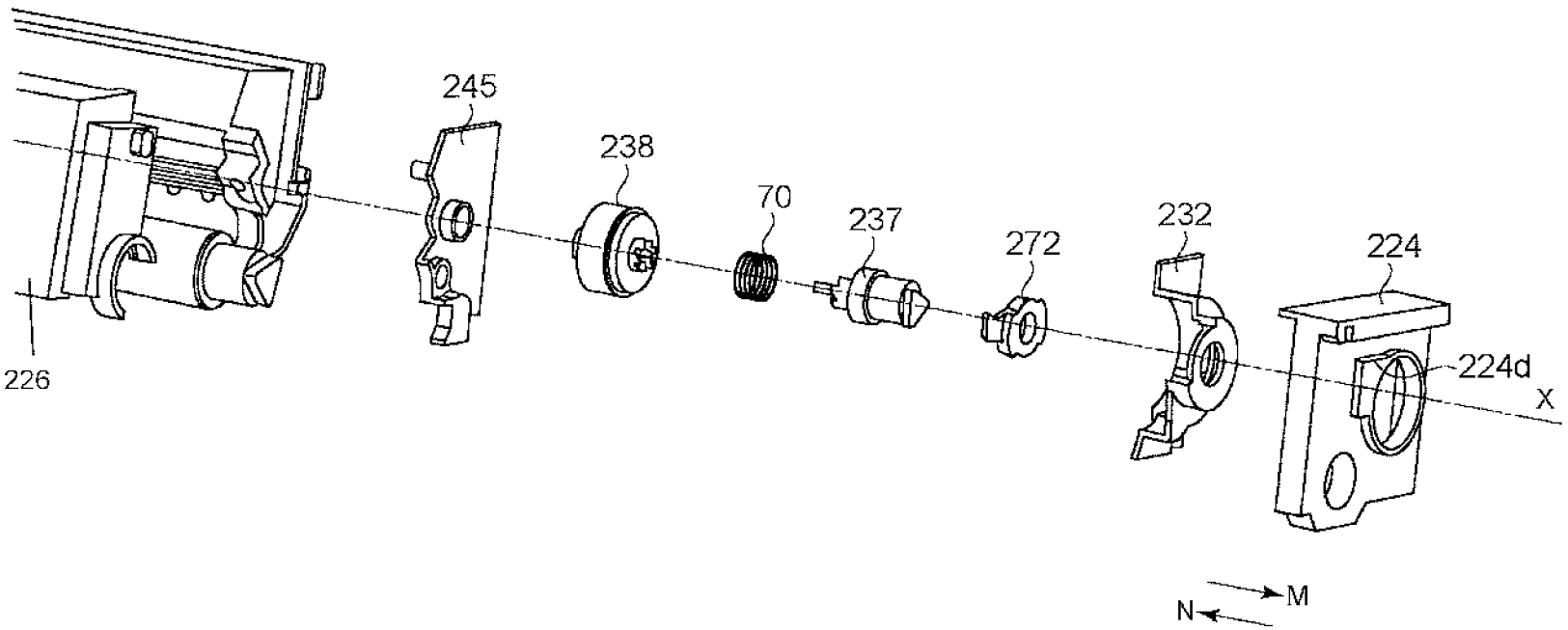
FIG. 20 is a perspective view of a process cartridge according to Embodiment 2.

Referring to FIG. 20, the structure of the drive connecting portion will be described.

First, the outline will be described.

Between the bearing member 245 and the driving side cartridge cover member 224, the following members are provided from the bearing member 245 toward the driving side cartridge cover member 224. They are a downstream side drive transmission member (downstream side transmission member) 238 as a second coupling member, a spring 70 as an elastic member as an urging member, an upstream side drive transmission member (upstream side transmission member) 237, a release cam 272, and a developing cover member 232. These members are provided coaxially with the upstream drive transmission member 237. In this embodiment, the drive connecting portion comprises the bearing member 245, the downstream drive transmission member 238, the spring 70, the upstream side drive transmission member 237, the release cam 272, the development cover member 232, the driving side cartridge cover member 224. The release cam 272 is a part of the release mechanism and is a coupling releasing member and is also an acting member.

Figure 21:
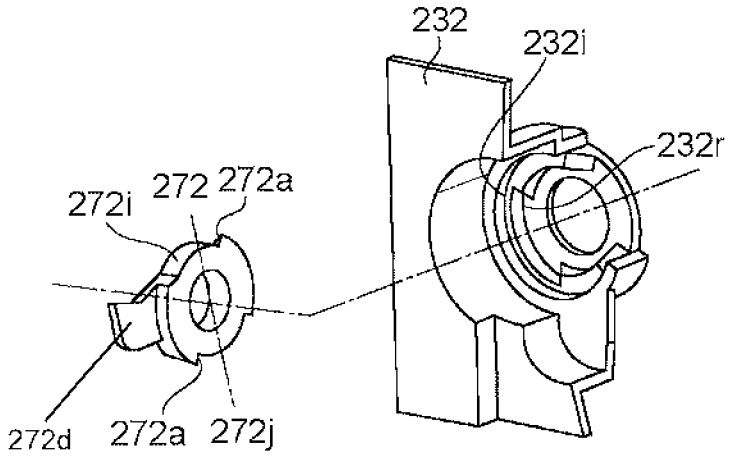
FIG. 21 is a perspective view of a releasing member and peripheral components according to Embodiment 2.

FIG. 21 shows the relationship between the release cam 272 and the developing cover member 232. The release cam 272 has a substantially ring-shaped portion 272*j*. The ring portion 272*j* has an outer peripheral surface 272*i* as a second guided portion, and the developing cover member 232 has an inner peripheral surface 232*i* as a part of the second guide portion. The inner peripheral surface 232*i* is constituted to engage with the outer peripheral surface 272*i*. The outer peripheral surface 272*i* of the release cam 272 and the inner peripheral surface 232*i* of the developing cover member 232 are both disposed on the same straight line (coaxial) as the rotation center X. In other words, the release cam 272 is slidably movable in the axial direction relative to the developing cover member 232 and the developing unit 9, and is supported so as to be rotatable also in the rotational direction around the axis X.

In addition, the ring portion 272*j* of the release cam 272 as a coupling releasing member has a contact portion (inclined surface) 272*a* as a force receiving portion. In addition, the developing cover member 232 has a contact portion (inclined surface) 232*r*. Here, the abutment portion 272*a* of the releasing cam 272 and the abutment portion 232*r* of the developing cover member 232 are contactable to each other.

Figure 22:
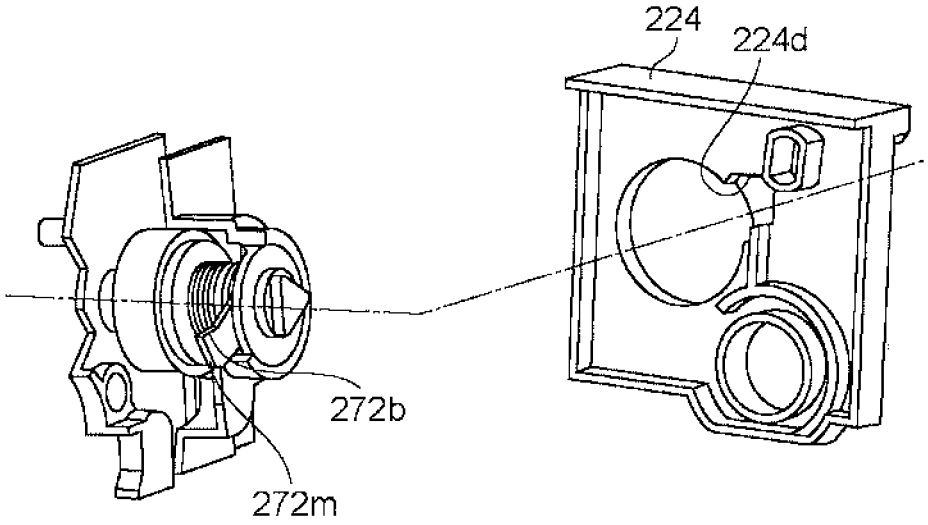
FIG. 22 is a perspective view of a drive connecting portion according to Embodiment 2.

FIG. 22 shows the structure of the drive connecting portion and the driving side cartridge cover member 224. The release cam 272 has a projecting portion 272*m* projecting from the ring portion 272*j*. This projecting portion has a force receiving portion 272*b* as a second guided portion. The force receiving portion 272*b* receives a force from the driving side cartridge cover member 224 through engagement with the regulating portion 224*d* as a part of the second guide portion of the driving side cartridge cover member 224. The force receiving portion 272*b* projects from the opening 232*c* provided in a part of the cylindrical portion 232*b* of the developing device cover member 232 and engages with the regulating portion 224*d* of the driving side cartridge cover member 224. Because of the engagement between the regulating portion 224*d* and the force receiving portion 272*b*, the release cam 272 is slidable (translatable) relative to the driving side cartridge cover member 224 only in the axial direction (the arrow M and N directions). Similarly to Embodiment 1, the outer diameter portion 232*a* of the cylindrical portion 232*b* of the developing device cover member 232 is constituted to slide a sliding portion 224*a* (cylindrical inner surface) of the driving side cartridge cover member 224. In other words, the outer diameter portion 232*a* is rotatably coupled with the sliding portion 224*a*.

From the above, the release cam 272 is engaged with both the inner peripheral surface 232*i* of the developing cover member 232 which is a part of the second guide portion and the regulating portion 224*d* of the driving side cartridge cover member 224 which is a part of the second guide portion. In other words, the release cam 272 is slidable (rotatable) in the rotational direction about the axis X and the axial direction (arrows M and N directions) relative to the developing unit 9. On the other hand, relative to the drive unit cartridge cover member 224 fixed to the drum unit 8 and the drum unit 8, the release cam 272 can slide and move only in the axial direction (arrows M and N directions).

Figure 23:
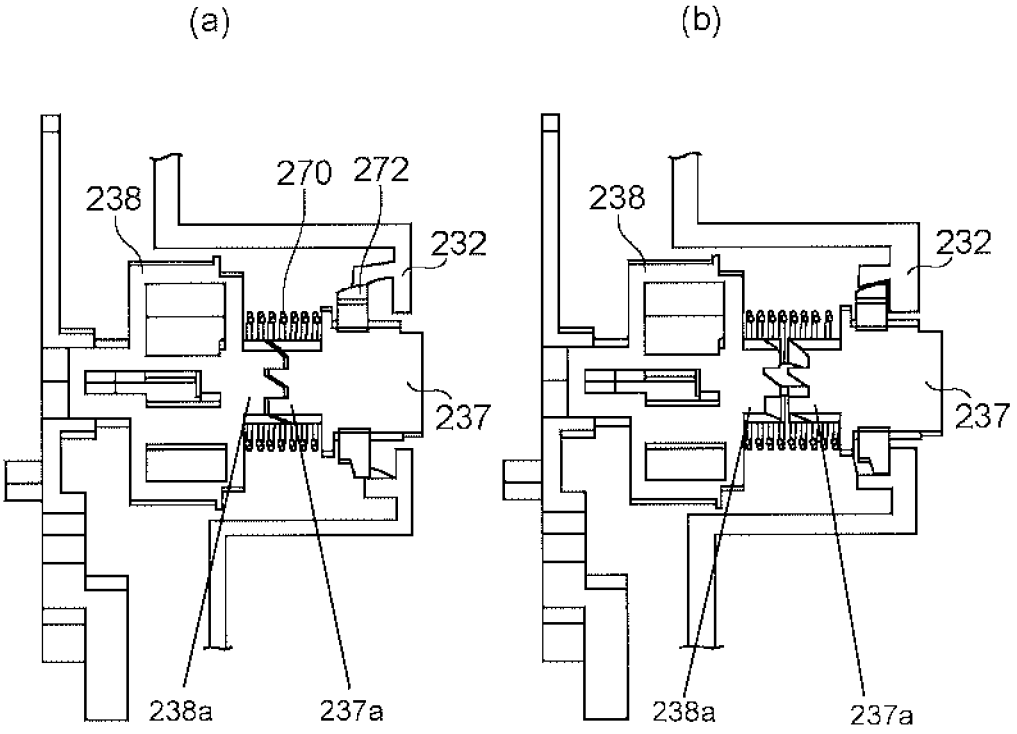
FIG. 23 is a cross-sectional view of the drive connecting portion according to Embodiment 2.

FIG. 23 shows a cross-sectional view of the drive connecting portion.

The downstream side drive transmission member 238 and the first bearing portion 245*p* (cylindrical outer face) of the bearing 245 are engaged with each other. The cylindrical portion 238*q* (cylindrical outer surface) of the downstream side drive transmission member 238 and the inner diameter portion 232*q* of the developing cover member 232 are engaged with each other. In other words, both ends of the downstream side drive transmission member 238 are rotatably supported by the bearing member 245 and the developing cover member 232.

The cylindrical portion 237*p* (cylindrical outer surface) of the upstream side drive transmission member 237 and the hole portion 232*p* of the developing cover member 232 are engaged with each other. By this, the upstream drive transmission member 237 is slidably (rotatably) supported with respect to the developing cover member 232.

Further, the first bearing portion 245*p* (cylindrical outer surface) of the bearing member 245, the inner diameter portion 232*q* of the developing cover member 232, and the hole portion 232*p* are disposed coaxially with the rotation center X of the developing unit 9. In other words, the upstream drive transmission member 237 is supported rotatably about the rotational center X of the developing unit 9. As described above, the cylindrical portion 237*m* of the upstream side drive transmission member 237 and the hole portion 238*m* of the downstream side drive transmission member 238 are engaged with each other. By this, the downstream drive transmission member 238 is also supported so as to be rotatable about the rotational center X of the developing unit 9, as a result.

In the sectional view of the drive connecting portion shown in part (a) of FIG. 23, the claw 238*a* of the downstream side drive transmission member 238 and the claw 237*a* of the upstream side drive transmission member 237 are engaged with each other. In addition, in the cross-sectional view of the drive connecting portion shown in part (b) of FIG. 23, the claw 238*a* of the downstream drive transmission member 238 and the claw 237*a* of the upstream drive transmission member 237 are separated from each other.

[Drive Disconnection Operation]

Hereinafter, the operation of the drive connecting portion when the developing roller 6 and the drum 4 change from the contact state to the separated state will be described.

[State 1]

Figure 24:
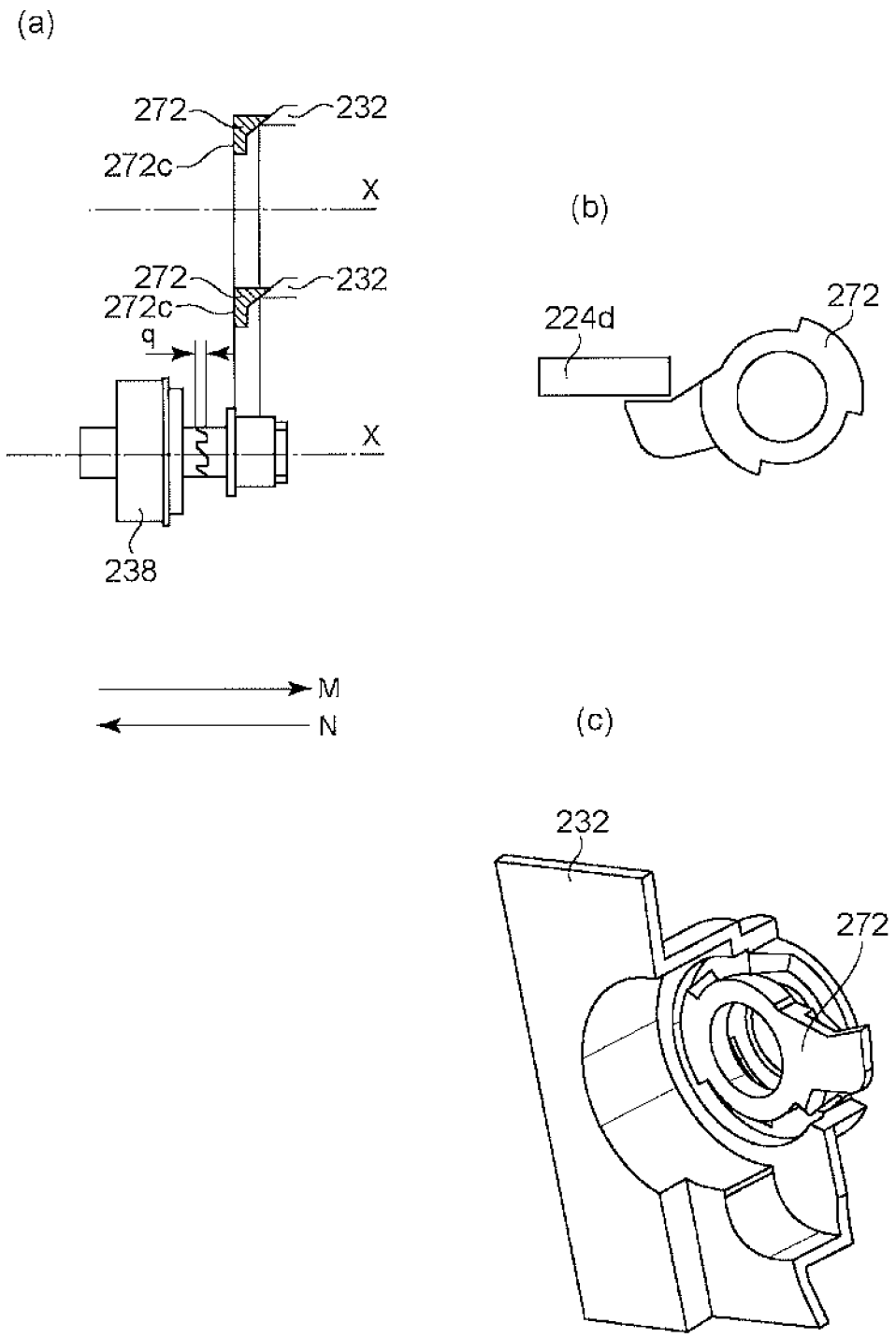
FIG. 24 is a schematic view and a perspective view of the drive connecting portion according to an Embodiment 2.

As shown in part (a) of FIG. 7, the main assembly separating member 80 and the force receiving portion 45*a* of the bearing member 45 are spaced apart with a gap d. At this time, the drum 4 and the developing roller 6 are in contact with each other. This state is defined as the state 1 of the main assembly separating member 80. The structure of the drive connecting portion at this time is schematically shown in parts (a) and part (b) of FIG. 24. In addition, FIG. 24 (*c*) shows a perspective view of the structure of the drive connecting part. For the sake of better illustration, some parts are not shown in FIG. 24. In Part (a) of FIG. 24, a pair of the upstream side drive transmission member 237 and the downstream side drive transmission member 238 and a pair of the release cam 272 and the development cover member 232 are shown separately. In addition, only a part including the abutment portion 232*r* is shown in the developing device cover member 232, and only a part including the regulating portion 224*d* in the driving side cartridge cover member 224 is shown.

At this time, the claws 237*a* of the upstream side drive transmission member 237 and the claws 238*a* of the downstream side drive transmission member 238 are engaged with each other with the engagement amount q so that drive transmission can be effected. As described above, the downstream drive transmission member 238 is engaged with the developing roller gear 69. Therefore, the drive force inputted from the main assembly 2 to the upstream drive transmission member 237 is transmitted to the developing roller gear 69 by way of the downstream drive transmission member 238. By this, the developing roller 6 is driven. The above state of each part is referred to as contact position, and it is called development contact, drive transmission state.

The position of the upstream drive transmission member 237 at this time is particularly referred to as a transmission position (drive transmission position, engagement position). At this time, the release cam 272 is in the maintaining position and urges the upstream drive transmission member 237 against the force of the spring 270. In other words, the release cam 272 keeps the upstream drive transmission member 237 in the transmission position.

[State 2]

Figure 25:
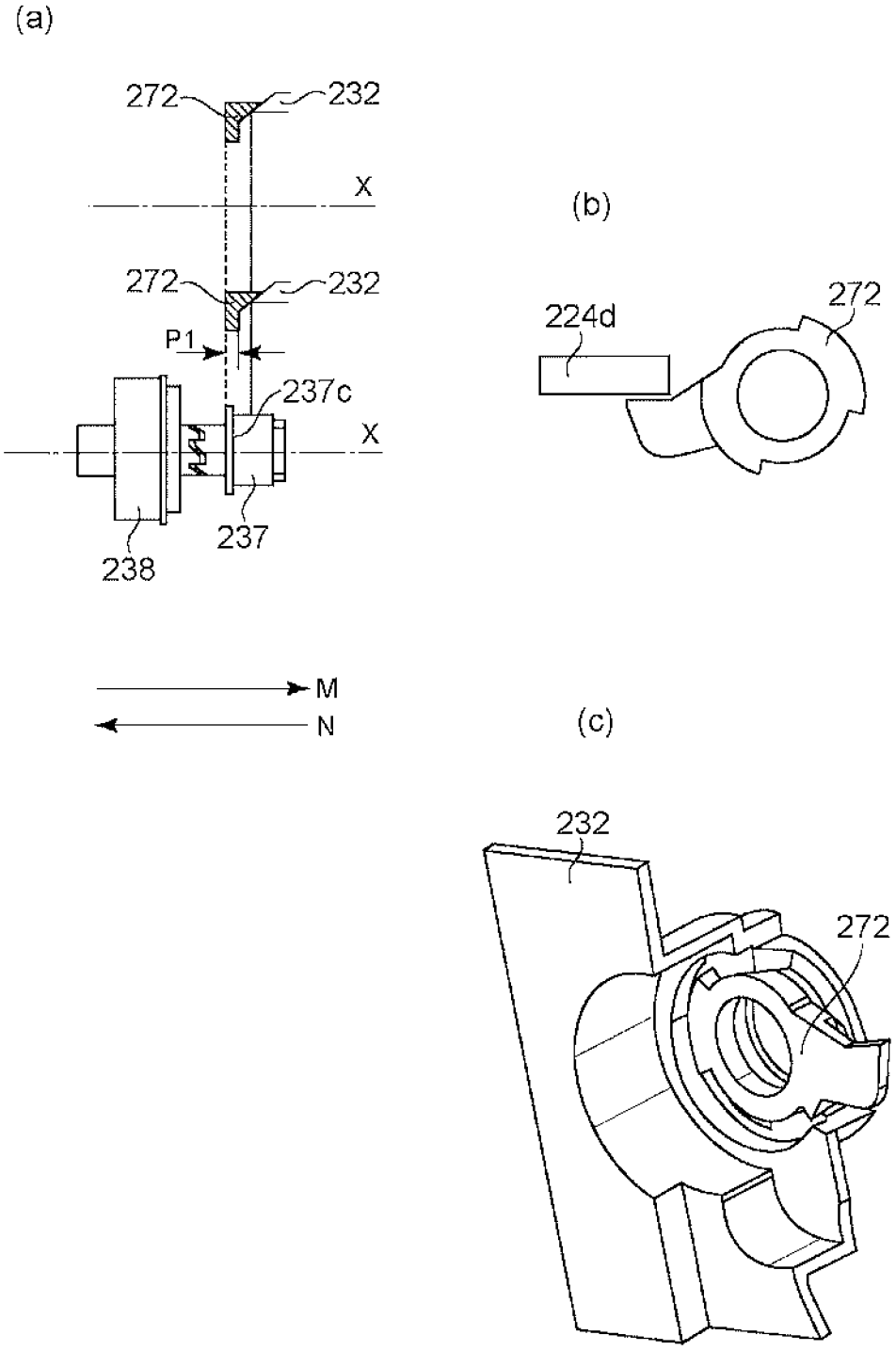
FIG. 25 is a schematic view and a perspective view of the drive connecting portion according to Embodiment 2.

When the main assembly separating member 80 moves by δ1 in the direction of the arrow F1 in the drawing from the developing contact and the driving transmission state as shown in part (b) of FIG. 7, as described above, the developing unit 9 rotates about the rotational center X in the direction of the arrow K by an angle θ1. By this, the developing roller 6 is separated from the drum 4 by a distance ε1. The developing cover member 232 incorporated in the developing unit 9 rotates in the direction of the arrow K by an angle θ1 in interrelation with the rotation of the developing unit 9. On the other hand, the release cam 272 is incorporated in the developing unit 9, but as shown in FIG. 22, the force receiving portion 272*b* is engaged with the engaging portion 224*d* of the driving side cartridge cover member 224. Therefore, the rotation of the release cam 272 relative to the drum unit 8 is restricted. In addition, the release cam 272 is urged by the spring 270. Therefore, when the developing unit 9 rotates, the release cam 272 slides (translates) in the M direction of the X axis without rotating relative to the drum unit 8 like the release cam 72 in Embodiment 1. As shown in part (a) of FIG. 25 and part (b) of FIG. 25, the state in which the contact portion 272*a* of the release cam 272 has moved the contact portion 232*r* of the developing device cover member 232 in the direction of arrow M by p1. At this time, p1 is smaller than q and the claw 237*a* of the upstream drive transmission member 237 and the claw 238*a* of the downstream drive transmission member 238 are kept in engagement with each other (part (a) of FIG. 25). In other words, it can be said upstream drive transmission member 237 is still in the transmission position.

Therefore, the driving force input from the apparatus main assembly 2 to the upstream side drive transmission member 37 is transmitted to the developing roller 6 by way of the downstream side drive transmission member 38 and the developing roller gear 69. The above state of each part is called development separation and drive transmission state. In the state 1 described above, the force receiving portion 272*b* does not necessarily have to be in contact with the engaging portion 224*d* of the driving side cartridge cover member 224. In other words, in the state 1, the force receiving portion 272*b* may be disposed with a gap from the engaging portion 224*d* of the driving side cartridge cover member 224. In this case, the gap between the force receiving portion 272*b* and the engaging portion 224*d* of the driving side cartridge cover member 224 disappears during the operation from the state 1 to the state 2, and the force receiving portion 272*b* comes into contact with the driving side cartridge cover member 224 of the engaging portion 224*d*.

Figure 26:
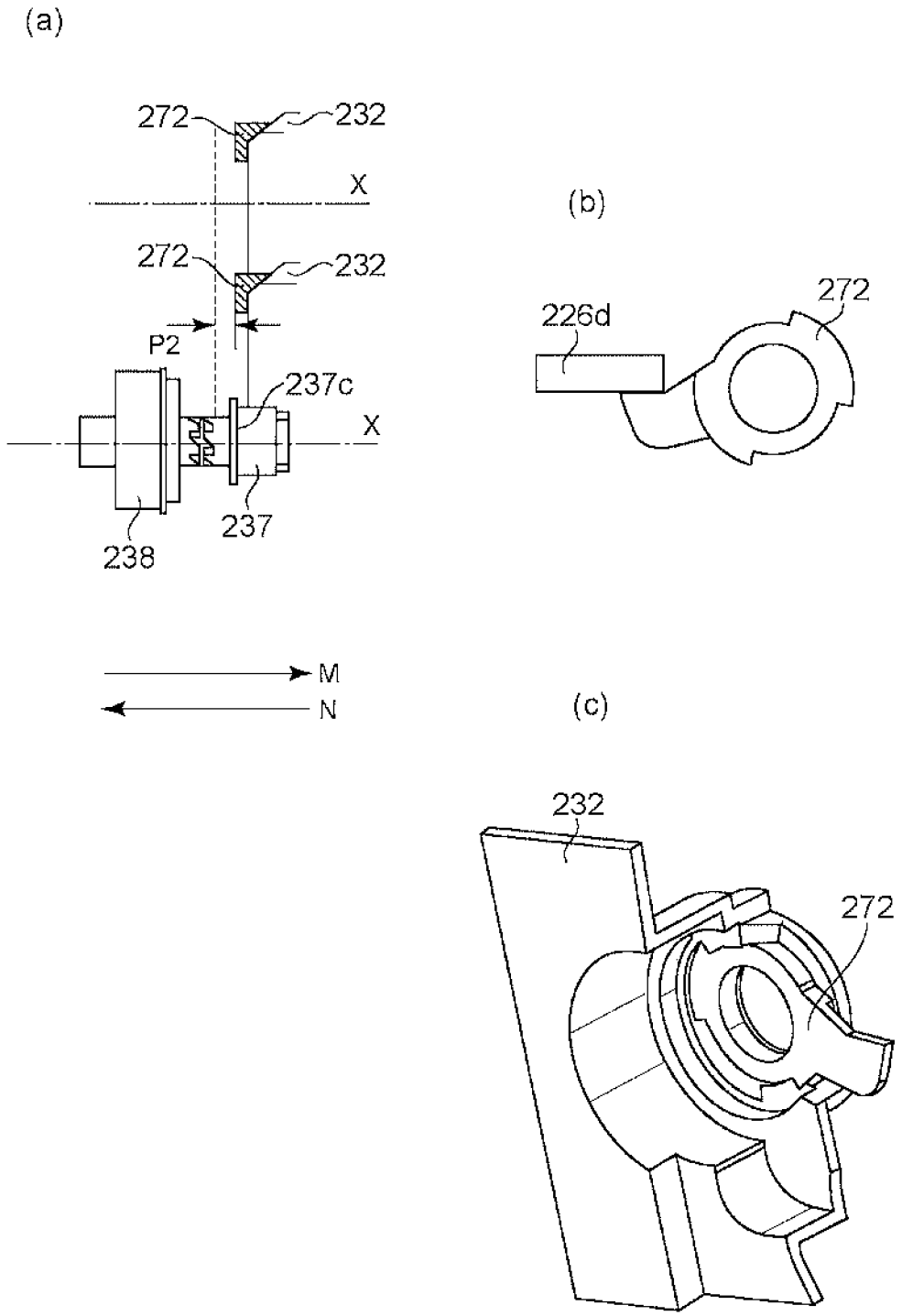
FIG. 26 is a schematic view and a perspective view of the drive connecting portion according to Embodiment 2.

The structure of the drive connection is shown in part (a) of FIG. 26, part (b) of FIG. 26 when the main assembly separating member 80 has moved by δ2 in the direction of the arrow F1 in the Figure as shown in part (c) of FIG. 7 from the developing separation and driving transmission state. The developing cover member 232 rotates in interrelation with the rotation of the developing unit 9 at the angle θ2 (>θ1). At this time, the contact portion 272*a* of the release cam 272 slides against the contact portion 232*r* of the development cover member 232. As described above, the release cam 272 is movable only in the axial direction (the direction of arrows M and N) by engaging the force receiving portion 272*b* with the engaging portion 224*d* of the driving side cartridge cover member 224 (See FIG. 22). Therefore, as a result, the release cam 272 and the upstream side drive transmission member 237 slide by the movement amount p2 in the direction of the arrow M by the pressing force of the spring 70 (FIG. 26 and part (b) of FIG. 26).

At this time, since the moving amount p2 than engagement depth q of the claw 238*a* of the claw 237*a* and the downstream drive transmission member 238 of the upstream drive transmission member 237 is large, the engagement of the claw 237*a* and the claw 238*a* is broken. Following this, the upstream drive transmission member 237 continues to rotate because the driving force is input from the apparatus main assembly 2, whereas the downstream drive transmission member 238 stops. By this, the rotation of the developing roller gear 69 and the developing roller 6 stops. The above-described state of each part is referred to as a separation position and is referred to as development separation and drive shutoff state.

In addition, the position of the upstream side drive transmission member 237 at this time is particularly referred to as a blocking position (drive shut-off position, disengagement position, drive connection cancellation position). The position of the release cam 272 at this time is particularly referred to as a permitting position. The release cam 272 moves from the maintaining position to the permitting position, thereby allowing the upstream drive transmission member 237 to move to the blocking position by the force of the spring 270.

The operation of shutting off the drive to the developing roller 6 in interrelation with the rotation of the developing unit 9 in the direction of the arrow K has been described in the foregoing. By employing the above structure, the developing roller 6 can be separated from the drum 4 while rotating, and the drive to the developing roller 6 can be stopped in accordance with the distance between the developing roller 6 and the drum 4.

[Drive Coupling Operation]

Next, the operation of the drive connecting portion when the developing roller 6 and the drum 4 change from a state in which they are separated from each other to a state in which they are in contact with each other will be described. This operation is the reverse of the above-described operation from the developing contact state to the development separated state.

In the development separated state (the state in which the developing unit 9 is rotated by the angle θ2 as shown in FIG. 7 (*c*)), the engagement between the claw 237*a* of the upstream drive transmission member 237 and the claw 238*a* of the downstream drive transmission member 238 is not established in the drive connecting portion, as shown in FIG. 26.

When the developing unit 9 is gradually rotated in the direction of the arrow H shown in FIG. 7 from the above state, the developing unit 9 is rotated by the angle θ1 (part (b) of FIG. 7 and State). In this state, the force receiving portion 272*d* of the release cam 272 is engaged with the engagement portion 224*d* of the driving side cartridge cover member 224, and the release cam slides only in the direction of the arrow N. In interrelation with the movement of the release cam 272 in the direction of the arrow N, the pressing surface 272*c* as the urging portion of the release cam 272 pushes the pressed surface 237*c* as the urged portion of the upstream drive transmission member 237 (urging). As the upstream drive transmission member 237 moves in the direction of the arrow N against the urging force of the spring 270, the claw 237*a* of the upstream drive transmission member 237 engages with the claw 238*a* of the downstream drive transmission member 238. By this, the driving force from the main assembly 2 is transmitted to the developing roller 6, and the developing roller 6 is rotationally driven. At this time, the developing roller 6 and the drum 4 are kept apart from each other.

Further, by gradually rotating the developing unit 9, from the above state in the direction of the arrow H shown in FIG. 7, the developing roller 6 and the drum 4 can be brought into contact with each other.

The operation of the drive transmission to the developing roller 6 in interrelation with the rotation of the developing unit 9 in the direction of arrow H has been described above. With the above structure, the developing roller 6 contacts the drum 4 while rotating, and can transmit the driving to the developing roller 6 according to the distance between the developing roller 6 and the drum 4.

In the above description, the force receiving portion 272*b* of the release cam 272 is constituted to be engaged with the regulating portion 224*d* of the driving side cartridge cover member 224, but this is not necessarily the case and it may be engaged with the cleaning container 226, for example.

Embodiment 3

Next, a cartridge according to an Embodiment 3 of the present invention will be described. The description of the same structure as in the above embodiment will be omitted. In this embodiment, the drive transmission member (drive input member 90) provided in the cartridge moves from the transmission position (part (a) in FIG. 28) to the blocking position (part (b) in FIG. 28). By this, the drive input member 90 is released from the driving connection with the main assembly side drive transmission member (drum drive output member 61) provided in the image forming apparatus main assembly. Further description will be made in the following.

[Structure of Drive Connecting Portion]

Figure 27:
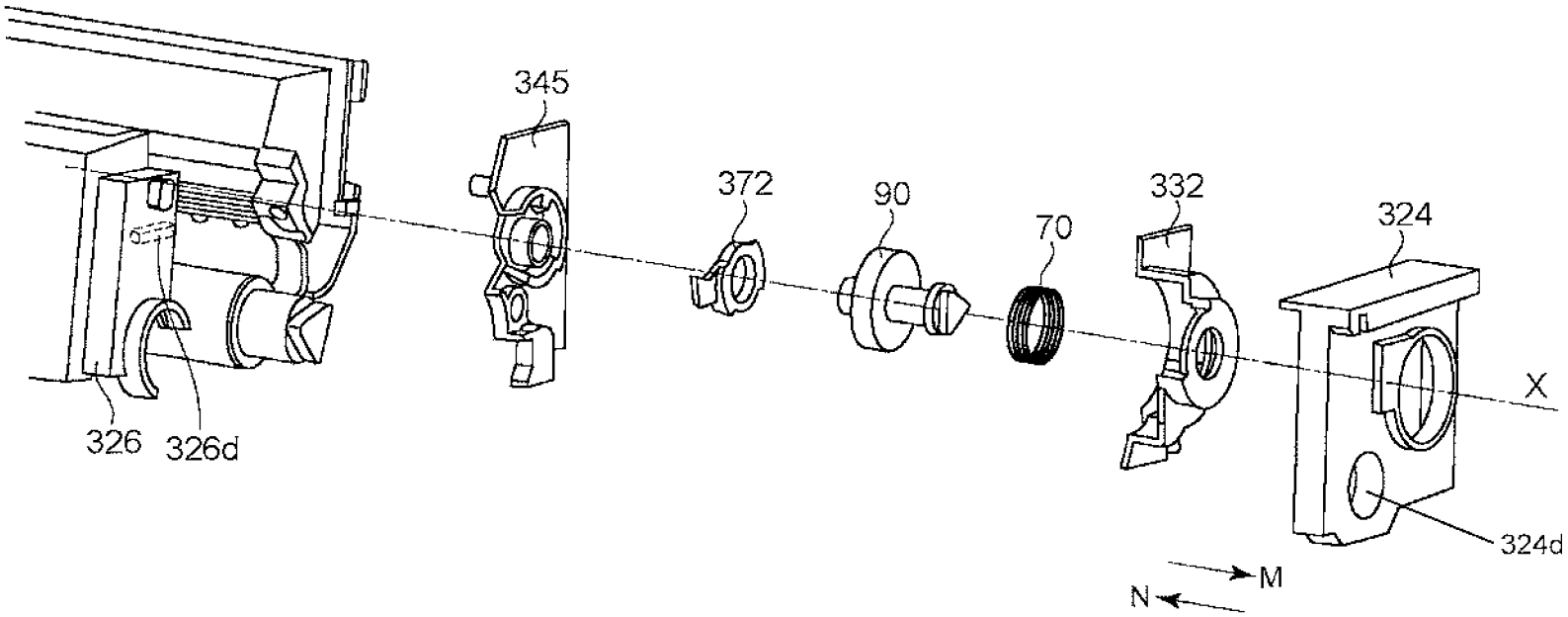
FIG. 27 is a perspective view of a process cartridge according to Embodiment 3.

Referring to FIG. 27, the structure of the drive connecting portion will be described. Although the details will be described hereinafter, the driving input member 90 provided at the driving side end portion of the developing unit 9 includes the developing drive output member 62 (62Y, 62M, 62C, 62K). By this engagement, the driving force from the driving motor (not shown) provided in the main assembly 2 is transmitted.

First, the outline will be described.

FIG. 27 is a perspective view of the process cartridge P as viewed from the driving side, showing a state in which the driving side cartridge cover member 324 and the development cover member 332 are removed. The driving side cartridge cover member 324 is provided with an opening 324*d*. Then, through the opening 324*d*, the coupling member 4*a* provided at the end portion of the photosensitive drum 4 is exposed. As mentioned above, the coupling member 4*a* is engaged with the drum drive output member 61 (61Y, 61M, 61C, 61K) of the main assembly 2 shown in part (b) of FIG. 3 to receive the driving force of the drive motor (not shown) of the main assembly of the device.

A drive input member 90 is rotatably provided at an end portion of the developing unit 9. The gear portion 90 *g* of the drive input member 90 is also engaged with the developing roller gear 69. By this, the drive transmitted to the drive input member 90 is transmitted to the developing roller 6*by* way of the developing roller gear 69.

Between the bearing member 345 and the driving side cartridge cover member 324, the following members are provided from the bearing member 345 toward the driving side cartridge cover member 324. They are a release cam 372 as an acting member which is a part of the release mechanism and a coupling releasing member, a drive input member 90, a spring 70 as an elastic member as an urging member, and a development cover member 332. These members are provided coaxially with the drive input member 90. In this embodiment, the drive connecting portion comprises the bearing member 345, the release cam 372, the drive input member 90, the spring 70, the developing cover member 332, and the driving side cartridge cover member 324.

The relationship between the release cam 372 and the bearing member 345 and the structures of the release cam 372 and the regulating portion 326*d* provided on the cleaning container 326 are the same as those in Embodiment 1, and therefore, they will not be described here.

Figure 28:
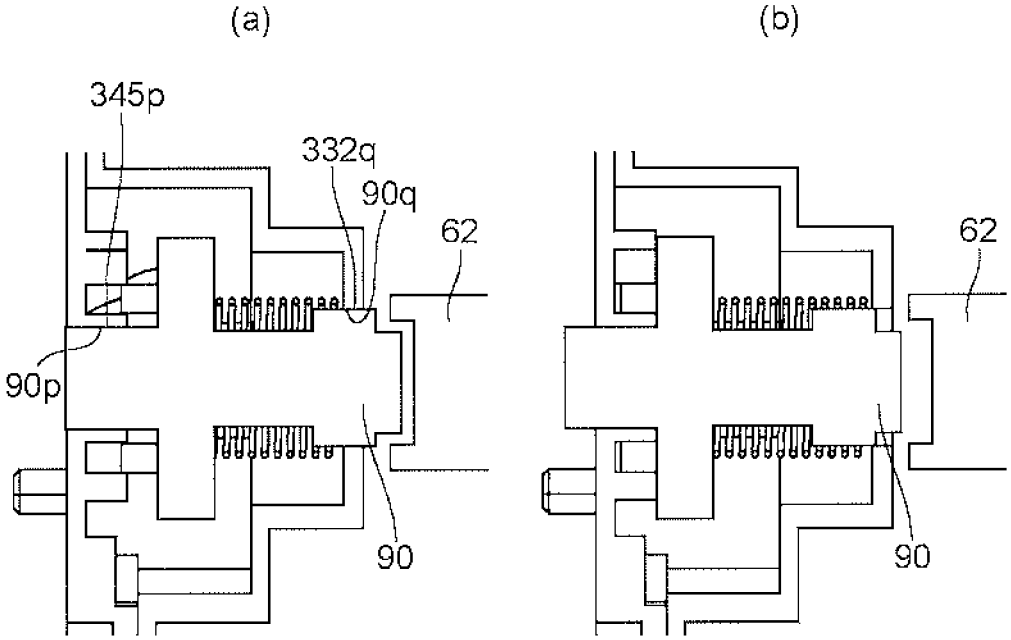
FIG. 28 is a cross-sectional view of a drive connecting portion according to Embodiment 3.

FIG. 28 shows a cross-sectional view of the drive connecting portion.

The cylindrical portion 90*p* (cylindrical inner surface) of the drive input member 90 and the first bearing portion 345*p* (cylindrical outer surface) of the bearing member 345 are engaged with each other. The cylindrical portion 90*q* (cylindrical outer surface) of the drive input member 90 and the inner diameter portion 332*q* of the developing cover member 332 are engaged with each other. In other words, both ends of the drive input member 90 are rotatably supported by the bearing member 345 and the developing cover member 332.

Further, the first bearing portion 345*p* (cylindrical outer surface) of the bearing member 345, the inner diameter portion 332*q* of the developing cover member 332, and a hole portion 332*p* are disposed coaxially with the rotation center axis X of the developing unit 9. In other words, the drive input member 90 is rotatably supported around the rotational center axis X of the developing unit 9.

In the cross-sectional view of the drive connecting portion shown in part (a) of FIG. 28, a state where the drive input member 90 and the development drive output member 62 as the main assembly side drive transmission member of the apparatus main assembly 2 are engaged with each other is shown. In addition, in the cross-sectional view of the drive connecting part shown in part (b) of FIG. 28, the drive input member 90 and the development drive output member 62 of the apparatus main assembly 2 are separated from each other.

[Drive Release Operation]

Hereinafter, the operation of the drive connecting portion at the time when the developing roller 6 and the drum 4 change from the contact state to the separated state relative to each other will be described.

[State 1]

Figure 29:
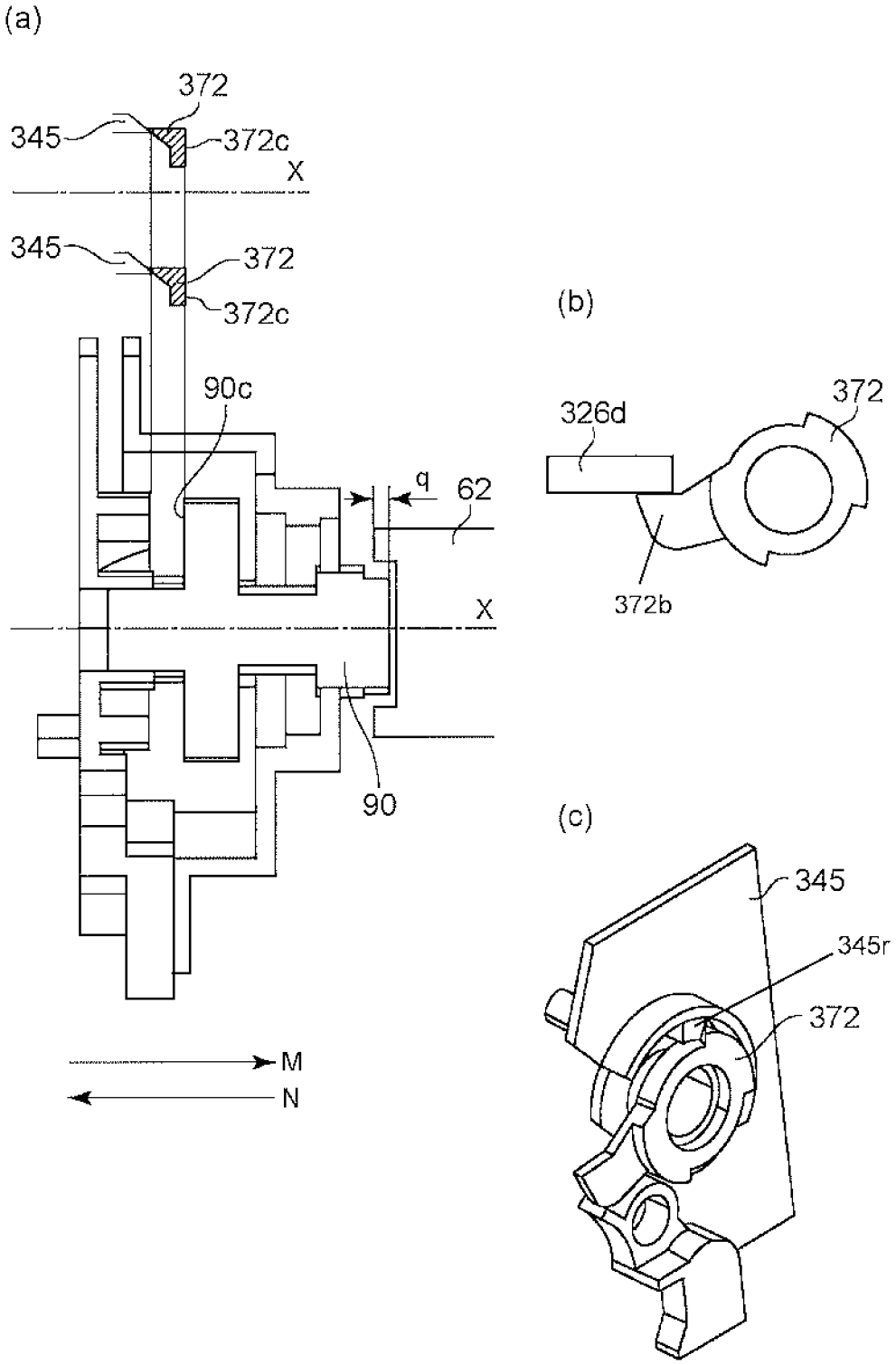
FIG. 29 is a schematic view and a perspective view of the drive connecting portion according to Embodiment 3.

As shown in part (a) of FIG. 7, the main assembly separating member 80 and the force receiving portion 45*a* of the bearing member 345 are separated from each other by the gap d. At this time, the drum 4 and the developing roller 6 are in contact with each other. This state is the state 1 of the main assembly separating member 80. The structure of the drive coupling part at this time is schematically shown in part (a) of FIG. 29. A part (b) of FIG. 29 is a perspective view illustrating the structure of the drive connecting part. Some parts are not shown in FIG. 29 for the sake of better illustration. In Part (a) of FIG. 29, a pair of the drive input member 90 and the development drive output member 62 of the apparatus main assembly 2, and a pair of the release cam 372 and the bearing member 345 are shown separately. In part (b) of FIG. 29, only a part including the abutment portion 345*r* is shown for the bearing member 345 and only a part including the regulating portion 326*d* is shown in the cleaning container 326. The drive input member 90 and the development drive output member 62 of the apparatus main assembly 2 are engaged with each other with an engagement amount q so that the drive inputting operation can be accomplished. As described above, the drive input member 90 is engaged with the developing roller gear 69. Therefore, the driving force inputted from the main assembly 2 to the drive input member 90 is transmitted to the developing roller gear 69, so that the developing roller 6 is driven. The above-described state of each part is referred to as contact position, and it is called development contact, drive transmission state.

The position of the drive input member 90 at this time is particularly referred to as a transmission position (drive transmission position, engagement position). At this time, the release cam 372 is in the maintaining position and urges the drive input member 90 against the force of the spring 70.

In other words, the release cam 372 holds the drive input member 90 in the transmission position.

[State 2]

When the main assembly separating member 80 moves by δ1 in the direction of the arrow F1 in the drawing from the developing contact and the driving transmission state as shown in part (b) of FIG. 7, the developing unit 9 rotates about the rotational center X in the direction of the arrow K by an angle θ1, as described above. By this, the developing roller 6 is separated from the drum 4 by a distance ε1. The bearing member 345 incorporated in the developing unit 9 rotates in the direction of the arrow K by an angle θ1 in interrelation with the rotation of the developing unit 9. On the other hand, the release cam 372 is incorporated in the developing unit 9, but as shown in FIG. 13, the force receiving portion 372*b* is engaged with the engaging portion 326*d* of the cleaning container 326. In addition, it is urged by the spring 70. Therefore, when the developing unit 9 rotates, the release cam 372 does not rotate but slides in the N direction of the X axis, similarly to the release cam 72 of Embodiment 1. As shown in part (a) of FIG. 30 and part (b) of FIG. 30, the contact portion 372*a* of the release cam 372 is in a state that the contact portion 345*r* of the bearing member 345 has moved by p1 in the direction of the arrow Ning. At this time, p1 is smaller than q, and the claw 90*a* of the drive input member 90 and the development drive output member 62 of the device main assembly 2 are kept in a state of engagement with each other (part (a) of FIG. 30). Therefore, the driving force inputted from the main assembly 2 to the driving input member 90 is transmitted to the developing roller 6*by* way of the developing roller gear 69. The above-described state of each part is called development separation and drive transmission state. In the state 1 described above, the force receiving portion 372*b* does not necessarily have to be in contact with the engaging portion 326*d* of the cleaning container 326. In other words, in the state 1, the force receiving portion 372*b* may be disposed with a gap relative to the engaging portion 326*d* of the cleaning container 326. In this case, the gap between the force receiving portion 372*b* and the engaging portion 326*d* of the cleaning container 326 disappears during the operation from the state 1 to the state 2, and the force receiving portion 372*b* comes into contact with the engaging portion 326*d* of the cleaning container 326.

[State 3]

Figure 31:
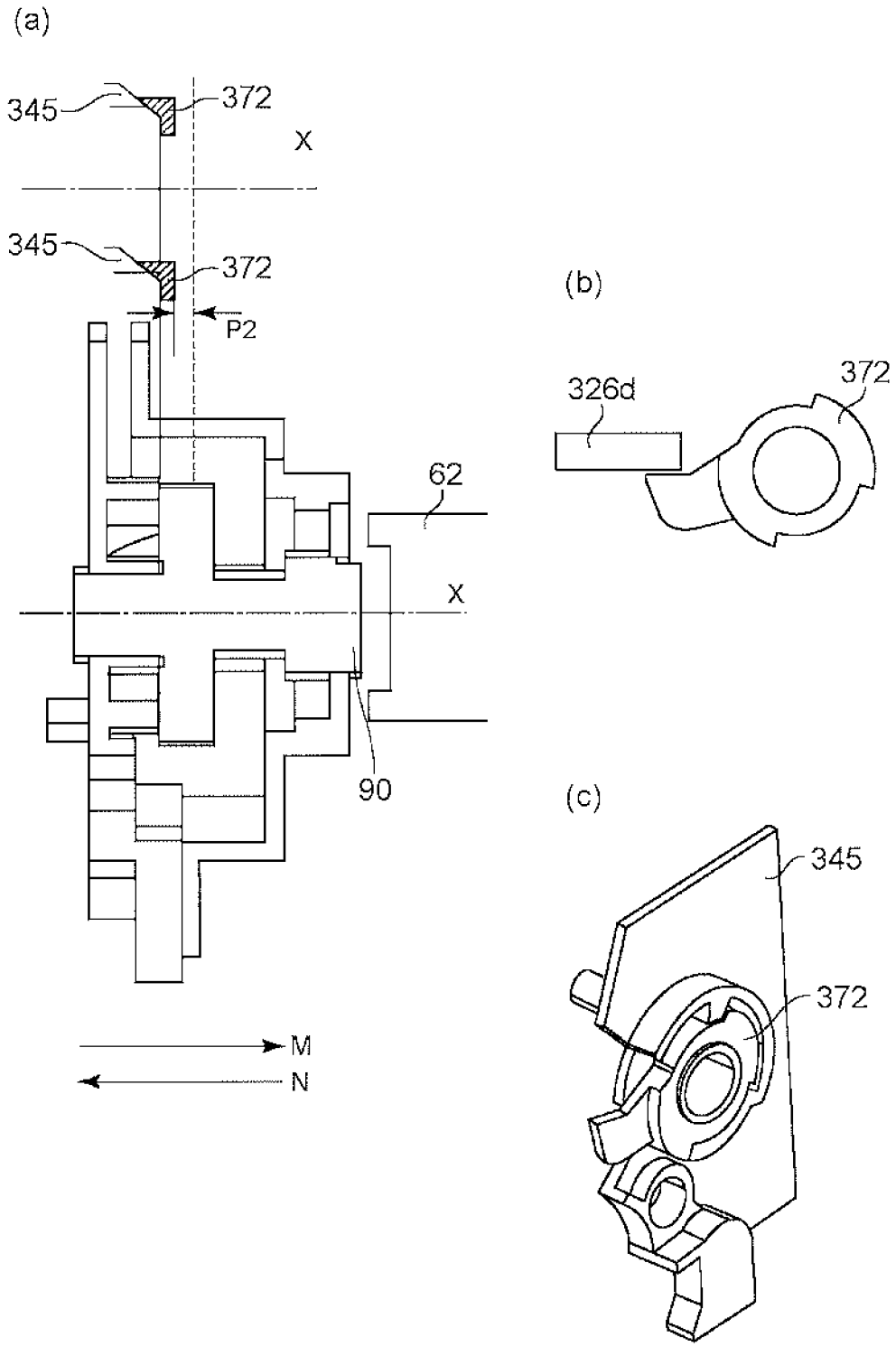
FIG. 31 is a schematic view and a perspective view of the drive connecting portion according to Embodiment 3.

The structure of the drive coupling is shown in part (a) of FIG. 31, part (b) of FIG. 31 at the time when the main assembly separating member 80 moves by δ2 in the direction of the arrow F1 in the Figure from the development separation and drive transmission state, as shown in FIG. 7 (*c*). The bearing member 345 rotates in interrelation with the rotation of the developing unit 9 through the angle θ2 (>θ1). At this time, the contact portion 372*a* of the release cam 372 slides relative to the contact portion 345*r* of the bearing member 345. As described above, the force receiving portion 372*b* is engaged with the engaging portion 326*d* of the cleaning container 326, so that the release cam 372 can move only in the axial direction (arrows M and N directions) (see FIG. 13). Therefore, as a result, the release cam 372 and the drive input member 90 are slid by the movement amount p2 in the direction of the arrow N by the urging force of the spring 70 (FIG. 31 and part (b) of FIG. 28).

At this time, the movement amount p2 is larger than the engagement amount q between the drive input member 90 and the development drive output member 62 of the apparatus main assembly 2, and therefore, the engagement between the drive input member 90 and the development drive output member 62 of the apparatus main assembly 2 is broken. With this, the drive input member 90 is released from the driving force from the main assembly 2 and is stopped. By this, the rotations of the developing roller gear 69 and the developing roller 6 stop. The above-described state of each part is referred to as a separation position and is referred to as development separation and drive shutoff state.

In addition, the position of the drive input member 90 at this time is particularly referred to as a blocking position (a drive shut-off position, a disengagement position, a drive disconnection position). The position of the release cam 372 at this time is particularly referred to as a permitting position. The release cam 372 moves from the maintaining position to the permitting position, thereby permitting the drive input member 90 to move to the blocking position by the force of the spring 70.

The operation of shutting off the drive to the developing roller 6 in interrelation with the rotation of the developing unit 9 in the direction of the arrow K has been described above. By employing the above structure, the developing roller 6 can be separated from the drum 4 while rotating, and the drive to the developing roller 6 can be interrupted in accordance with the distance between the developing roller 6 and the drum 4.

[Drive Coupling Operation]

Next, the operation of the drive connecting portion when the developing roller 6 and the drum 4 change from a state in which they are separated from each other to a state in which they are in contact with each other will be described. This operation is the reverse of the above-described operation from the developing contact state to the development separated state.

As shown in FIG. 31, in the development separated state (the state in which the developing unit 9 has been rotated by the angle θ2 as shown in FIG. 7 (c)), the drive connecting member is such that the engagement between the driving input member 90 and the developing drive output member 62 is broken.

Figure 30:
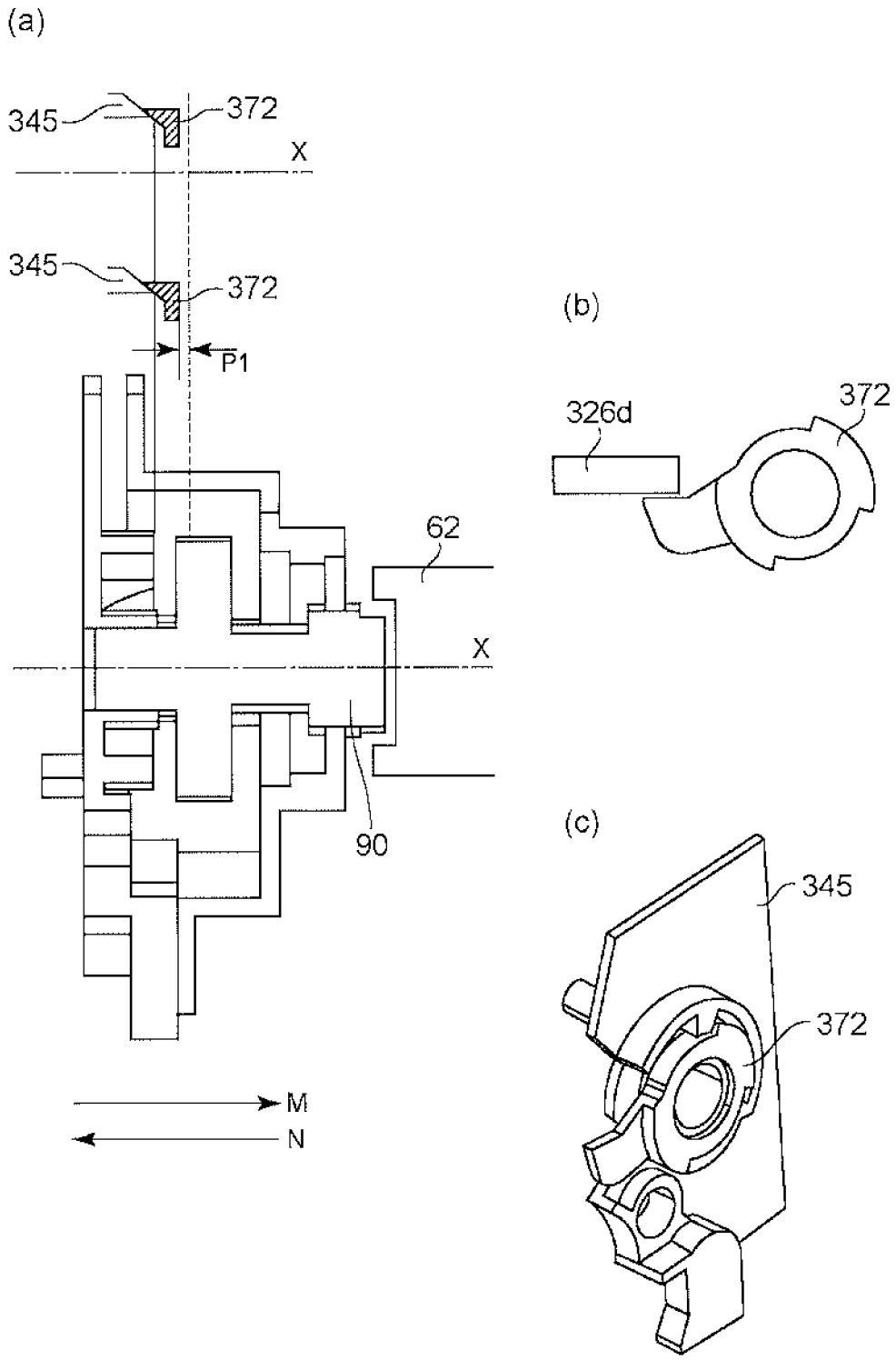
FIG. 30 is a schematic view and a perspective view of the drive connecting portion according to Embodiment 3.

When the developing unit 9 is gradually rotated in the direction of the arrow H shown in FIG. 7 from the above state, the developing unit 9 is rotated by the angle θ1 (the state shown in part (b) of FIG. 7 and FIG. 30). In this state, the force receiving portion 372*d* of the release cam 372 is engaged with the engaging portion 326*d* of the cleaning container 326, and the release cam 372 slides only in the direction of the arrow M. In conjunction with the movement of the release cam 372 in the direction of the arrow M, the pressing surface 372*c* as the urging portion of the release cam 372 urges the urged surface 90*c* as the urged portion of the drive input member 90. By this, the driving input member 90 moves in the direction of the arrow M against the pressing force of the spring 70 so that drive input member 90 and development drive output member 62 of the apparatus main assembly 2 are engaged with each other. By this, the driving force from the main assembly 2 is transmitted to the developing roller 6, and the developing roller 6 is rotationally driven. At this time, the developing roller 6 and the drum 4 are kept apart from each other.

Further, by gradually rotating the developing unit 9 in the direction of the arrow H shown in FIG. 7 from the above state, the developing roller 6 and the drum 4 can be brought into contact with each other.

The operation of the drive transmission to the developing roller 6 in interrelation with the rotation of the developing unit 9 in the direction of arrow H has been described above. With the above structure, the developing roller 6 is brought into contact to the drum 4 while rotating, and can transmit the driving to the developing roller 6 in accordance with the distance between the developing roller 6 and the drum 4.

In the above description, the force receiving portion 372*b* of the release cam 372 is constituted to be engaged with the regulating portion 326*d* of the cleaning container 326. However, the force receiving portion 372*b* of the release cam 372 is not necessarily limited to such a structure, and for example, the force receiving portion 372*b* may be engaged with the driving side cartridge cover member 324.

Embodiment 4

Next, a cartridge according to Embodiment 4 of the present invention will be described. The description of the same structure as in the above embodiments will be omitted.

In this embodiment, the elastic member such as the spring 70 shown in Embodiment 1 is not used to move the drive transmission member (the downstream side drive transmission member 438) and the releasing member (the release cam 472).

[Structure of Drive Connecting Portion]

Figure 32:
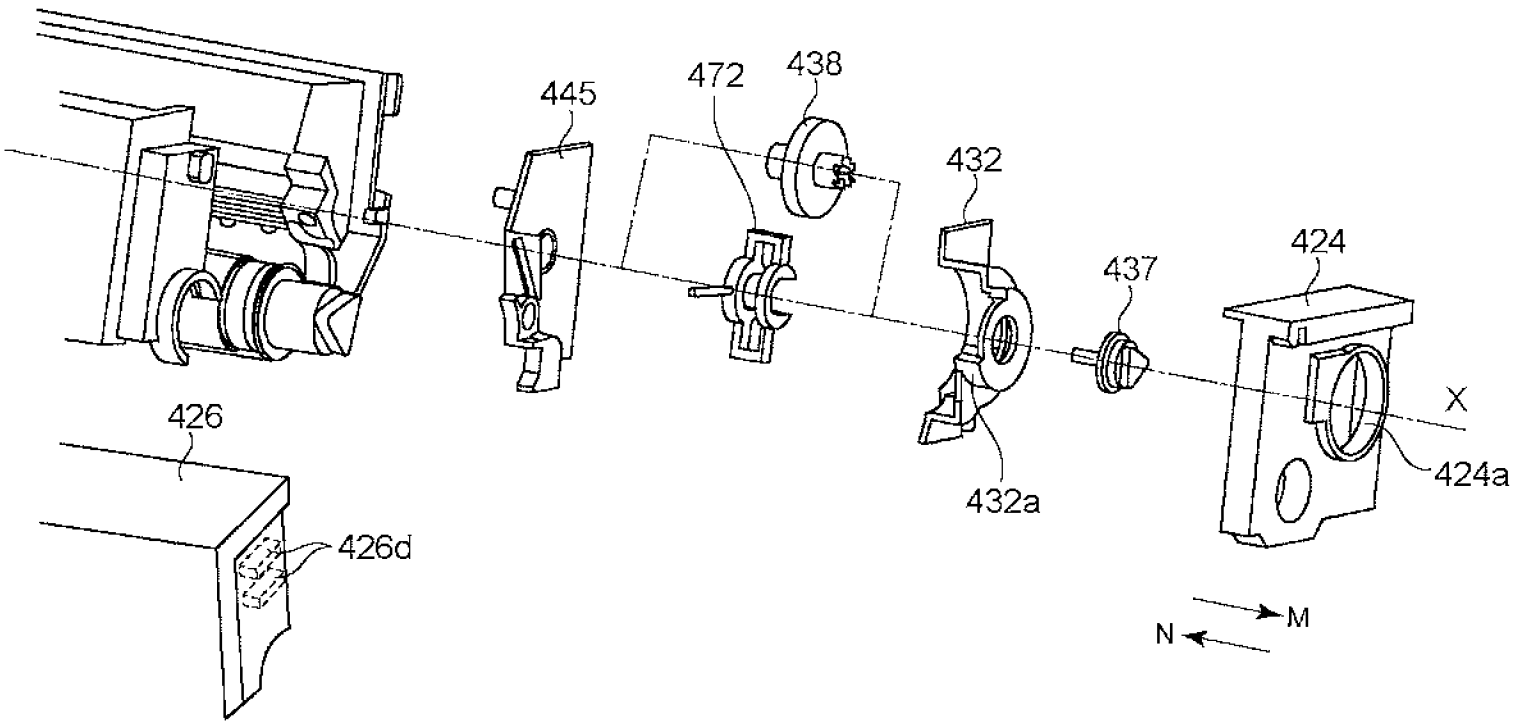
FIG. 32 is a perspective view of a process cartridge according to Embodiment 4.

Referring to FIG. 32, the structure of the drive connecting portion will be described. First, the outline will be explained.

Between the bearing member 445 and the driving side cartridge cover member 424, the following members are provided from the bearing member 445 toward the driving side cartridge cover member 424. They are the release cam 472, the downstream side drive transmission member 438 as the second coupling member which is set inside the release cam 472, the development cover member 432, and the upstream side drive transmission member 437 as the first coupling member. These members are provided coaxially with the upstream drive transmission member 437. In this embodiment, the drive connecting portion is constituted by the bearing member 445, the release cam 472, the downstream side drive transmission member 438, the development cover member 432, the upstream side drive transmission member 437, and the driving side cartridge cover member 424. The release cam 472 is a part of the release mechanism and is a coupling releasing member and further is an acting member.

Figure 33:
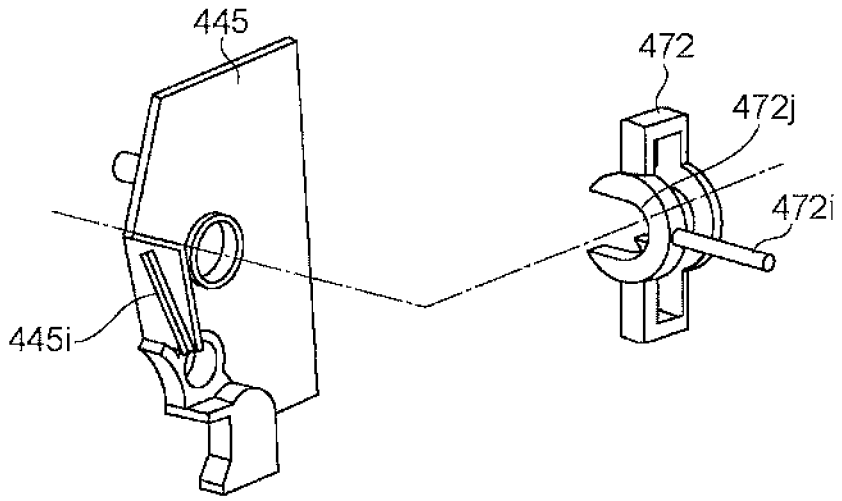
FIG. 33 is a perspective view of a releasing member and peripheral components according to an Embodiment 4.

FIG. 33 shows the relationship between the release cam 472 and the bearing member 445. Even in this embodiment, the release cam 472 and the bearing member 445 constitute a cam mechanism for moving the release cam 472 in accordance with the rotating operation of the developing unit 9.

The release cam 472 has a substantially ring-shaped portion 472*j*. The ring portion 472*j* has a lever portion 472*i* as a second guided portion, and the bearing member 445 has a guide groove 445*i* as a second guide portion. The guide groove 445*i* is slidable relative to the lever portion 472*i*. In addition, the release cam 472 is slidably movable in the axial direction relative to the bearing member 445 and the developing unit 9, and is also supported so as to be rotatable also in the rotational direction about the axis X.

Figure 34:
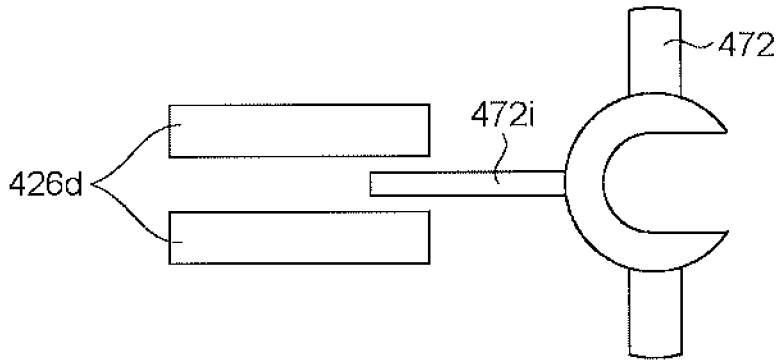
FIG. 34 is a perspective view of the releasing member and the peripheral components according to Embodiment 4.

FIG. 34 shows a structure of the release cam 472 and a regulating portion 426*d* provided in a cleaning container 426. In this embodiment, the regulating portion 426*d* provided in the cleaning container 426 is installed inside the cleaning container, but it may be placed anywhere in the cleaning container 426 depending on the shape of the cleaning container 426. The lever portion 472*i* of the release cam 472 is engaged with the regulating portion 426*d* as a part of the second guide portion of the cleaning container 426, thereby receiving a force from the cleaning container 426. The lever portion 472*i* projects from the developing cover member 432 and engages with the regulating portion 426*d* of the cleaning container 426. Because the regulating portion 426*d* and the lever portion 472*i* are engaged with each other, the releasing cam 472 is slidable relative to the driving side cartridge cover member 424 in the axial direction (the arrow M and the N direction). Also, the outer diameter portion 432*a* of the cylindrical portion 432*b* of the developing cover member 432 slides on the sliding portion 424*a* (cylindrical inner surface) of the driving side cartridge cover member 424. In other words, the outer diameter portion 432*a* is rotatably coupled to the sliding portion 424*a*.

From the above, the release cam 472 is engaged with both of the guide groove 445*i* (cam groove) of the bearing member 445 and the regulating portion 426*d* of the cleaning container 426. In other words, the release cam 472 is slidable (rotatable) in the rotational direction about the axis X and the axial direction (the arrow M and N directions) relative to the developing unit 9. The release cam 472 is slidable (rotatable) in the axial direction (arrow M and N directions) relative to the drum unit 8 and the driving side cartridge cover member 424 fixed to the drum unit 8.

Figure 35:
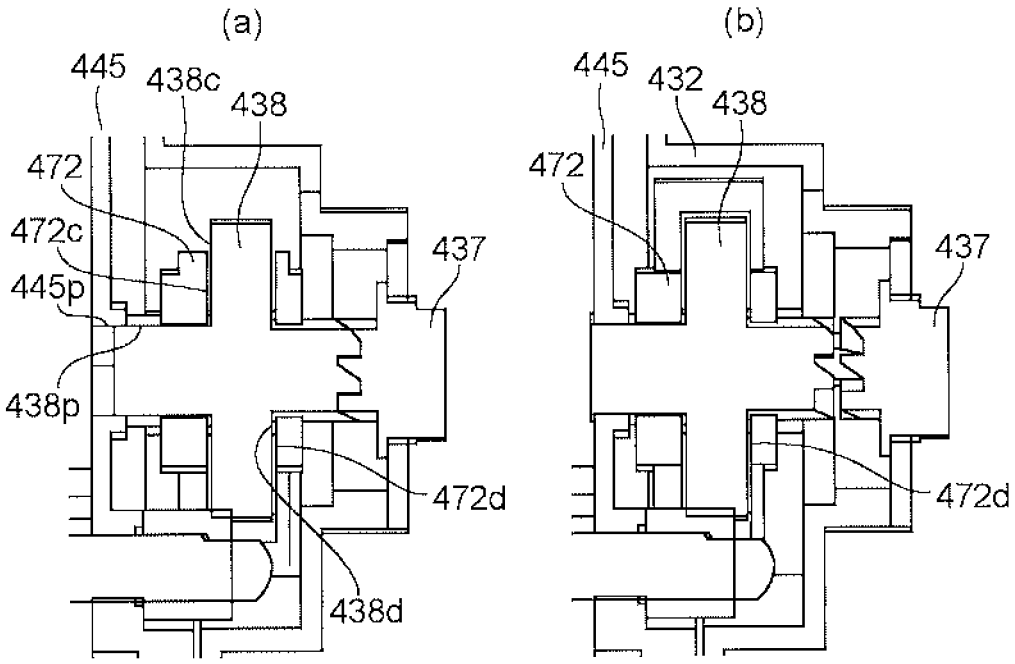
FIG. 35 is a cross-sectional view of the drive connecting portion according to Embodiment 4.

FIG. 35 shows a cross-sectional view of the drive connecting portion.

The cylindrical portion 438*p* (cylindrical inner surface) of the downstream side drive transmission member 438 and the first bearing portion 445*p* (cylindrical outer surface) of the bearing 445 are engaged with each other. The surface 438*c* of the cylindrical portion of the downstream drive transmission member 438 is engaged with the face 472*c* of the release cam 472, and the face 438*d* of the cylindrical portion of the downstream drive transmission member 438 is engaged with the face 472*d* of the release cam 472. By this, the movement of the downstream side drive transmission member 438 in the direction of the axis X is restricted by the release cam 472. The cylindrical portion 438*q* (cylindrical outer surface) of the downstream side drive transmission member 438 and the inner diameter portion 432*q* of the developing cover member 432 are engaged with each other. In other words, both ends of the downstream side drive transmission member 438 are rotatably supported by the bearing member 445 and the developing cover member 432.

The cylindrical portion 437*p* (cylindrical outer surface) of the upstream side drive transmission member 437 and the hole portion 432*q* of the developing cover member 432 are engaged with each other. The main assembly side cylindrical portion 437*q* of the upstream side drive transmission member 437 and the coupling hole 424*e* of the driving side cartridge cover member 424 are engaged with each other. By this, the upstream drive transmission member 437 is supported slidably (rotatably) relative to the image cover member 432 and to the driving side cartridge cover member 424.

Further, the first bearing portion 445*p* (cylindrical outer surface) of the bearing member 445, the inner diameter portion 432*q* of the developing cover member 432, and the coupling hole 424*e* are disposed coaxially with the rotation center X of the developing unit 9. In other words, the upstream drive transmission member 437 is supported so as to be rotatable about the rotational center axis X of the developing unit 9.

In the sectional view of the drive connecting portion shown in part (a) of FIG. 35, the downstream side drive transmission member 438 and the upstream side drive transmission member 437 are engaged with each other. In the cross-sectional view of the drive connecting portion shown in part (b) of FIG. 35, the downstream side drive transmission member 438 and the upstream side drive transmission member 437 are separated from each other.

[Drive Release Operation]

Hereinafter, the operation of the drive connecting portion when the developing roller 6 and the drum 4 change from the contact state to the separated state therebetween will be described.

[State 1]

Figure 36:
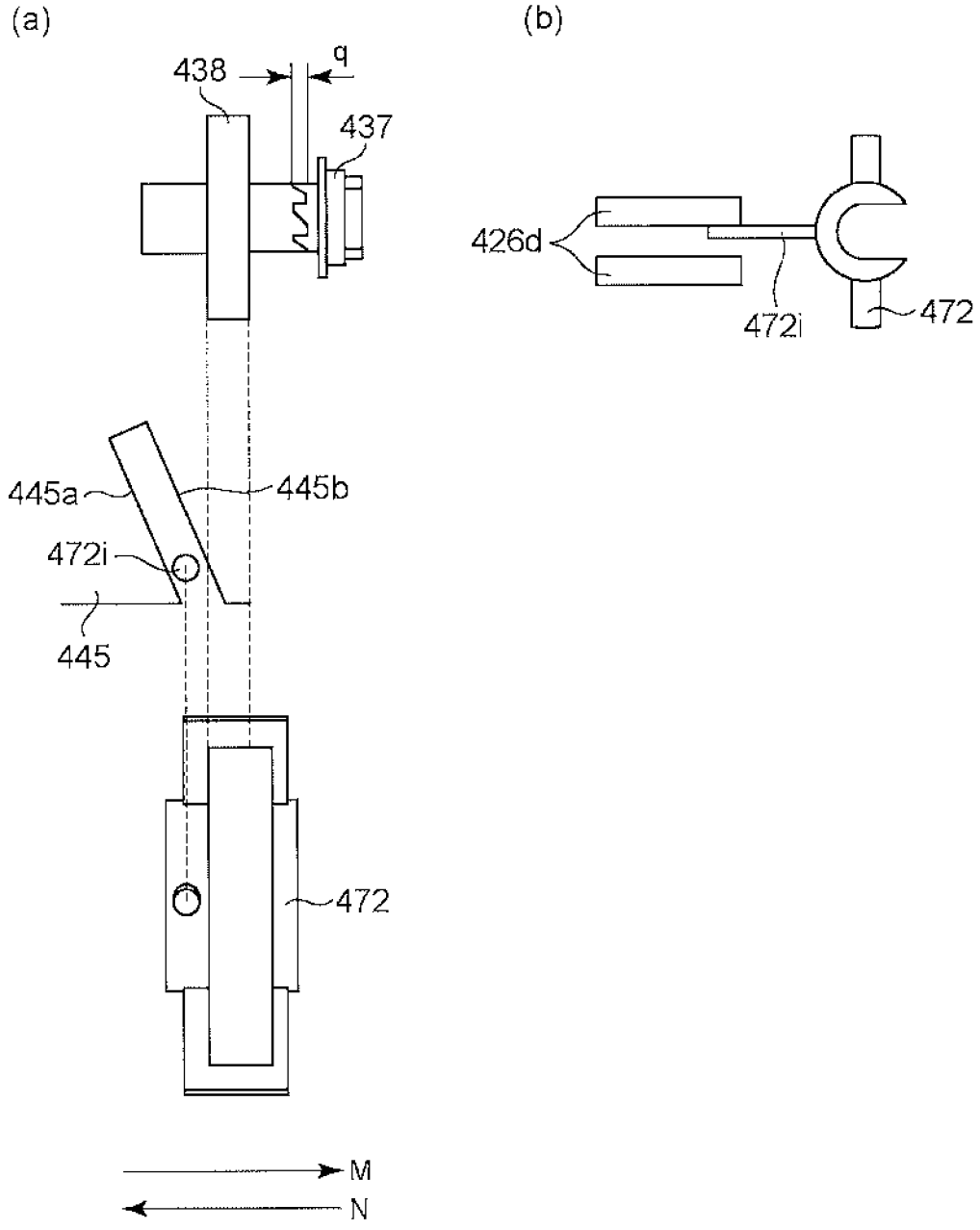
FIG. 36 is a schematic view and a perspective view of the drive connecting portion according to Embodiment 4.

As shown in part (a) of FIG. 7, the main assembly separating member 80 and the force receiving portion 45*a* of the bearing member 45 are spaced apart with the gap d. At this time, the drum 4 and the developing roller 6 are in contact with each other. This state is an state 1 of the main assembly separating member 80. The structure of the drive connecting portion at this time is schematically shown in part (a) of FIG. 36. Also, a part (b) of FIG. 36 is a perspective view of the structure of the drive connecting part. Some parts are not shown in FIG. 36 for the sake of explanation. In part (a) of FIG. 36, the pair of the upstream side drive transmission member 437 and the downstream side drive transmission member 438, and the pair of the release cam 472 and the bearing member 445 are shown separately. In the part (b) of FIG. 36, only a part including the guide groove 445*i* is shown in the bearing member 445, and only a part including the regulating portion 426*d* is shown in the cleaning container 426. At this time, the lever portion 472*i* of the release cam 472 is sandwiched at the position closest to the driving side cartridge cover member 424 among the guide grooves 445*i* of the bearing member 445. At this time, the upstream side drive transmission member 437 and the downstream side drive transmission member 438 are engaged with each other with the engagement amount q, so that the drive transmission can be effected. As described above, the downstream side drive transmission member 438 is engaged with the developing roller gear 69 (FIG. 59).

Further, the position of the downstream side drive transmission member 438 at this time is particularly referred to as a transmission position (drive transmission position, engagement position). The position of the release cam 472 at this time is particularly referred to as a first maintaining position (engaging maintaining position, driving connection maintaining position). When the release cam 472 is in the first maintaining position, the downstream drive transmission member 438 is held in the transmission position by the urging portion (pressing surface 472*c*) of the downstream side drive transmission member 438.

[State 2]

As shown in part (b) of FIG. 7, when the main assembly separating member 80 moves by δ1 in the direction of the arrow F1 in the drawing from the developing contact and the driving transmission state, the developing unit 9 rotates in the direction of the arrow K by an angle θ1, as described above. By this, the developing roller 6 is separated from the drum 4 by a distance ε1. The release cam 472 and the bearing member 445 incorporated in the developing unit 9 rotate in the direction of the arrow K by an angle θ1 in interrelation with the rotation of the developing unit 9. On the other hand, the release cam 472 is incorporated in the developing unit 9, but as shown in FIG. 34, the lever portion 472*i* is engaged with the engaging portion 426*d* of the cleaning container 426. When the developing unit 9 is rotated by the guide groove 445*i* of the bearing member 445, the release cam 472 does not rotate relative to the drum unit. As the lever portion 472*i* slides in the guide grooves 445*i*, the release cam 472 slides in the N direction of the X axis.

More specifically, as the lever portion 472*i* contacts the surface 445*b* of the guide groove 445*i*, when sliding the guide groove 445*i*, the lever portion 472*i* slides in the N direction of the X axis. The surface 445*b* is a force imparting portion for applying a force to release cam 472 in the N direction. On the other hand, the contact portion of the lever portion 472*i* in contact with the surface 455*b* is a force receiving portion receiving a force from the force receiving portion.

The surface 445*b* is an inclined surface (inclined portion) inclined with respect to the moving direction (rotational direction) of the developing unit 9. The surface 445*b* is also a cam surface (cam portion) for converting the force for moving the developing unit 9 relative to the drum unit to a force for urging the release cam 472 and the downstream side drive transmission member 438 in the X-axis direction. In other words, when the groove 445*i* moves relative to the lever portion 472*i* of the release cam 472 in accordance with the rotation of the developing unit, the lever portion 472*i* contacts the surface 445*b* and receives a force. The release cam 472 and the downstream drive transmission member 438 move along the X axis by this force.

Figure 37:
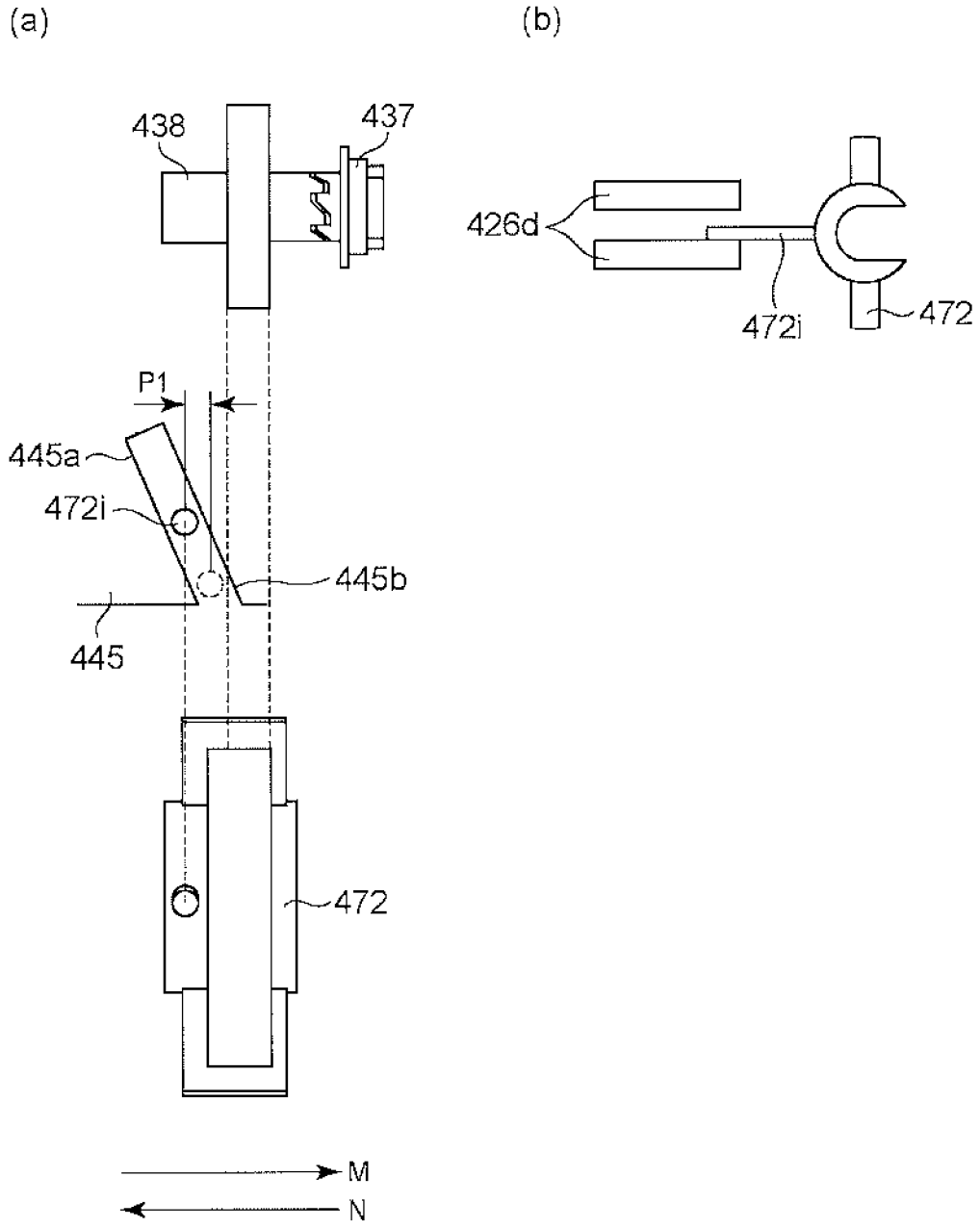
FIG. 37 is a schematic view and a perspective view of the drive connecting portion according to Embodiment 4.

As shown in part (a) of FIG. 37 and part (b) of FIG. 37, the lever portion 472*i* of the release cam 472 is in a state that the guide portion 445*i* of the bearing member 445 has moved by p1 in the arrow N direction.

At this time, the pressing surface (urging portion, force applying portion) 472*d* of the release cam 472 urges the downstream side drive transmission member 438 in the N direction to move it by the distance p1. The distance p1 has a movement amount smaller than q, and therefore, the upstream side drive transmission member 437 and the downstream side drive transmission member 438 are kept in a state of being engaged with each other (part (a) of FIG. 37). Therefore, the driving force inputted from the main assembly 2 to the upstream drive transmission member 437 is transmitted to the developing roller 6*by* way of the downstream drive transmission member 438 and the developing roller gear 69. The above state of each part is called development separation and drive transmission state. In the state 1 described above, the lever portion 472*i* does not necessarily have to be in contact with the engaging portion 426*d* of the cleaning container 426. In other words, in the state 1, the lever portion 472*i* may be disposed with a clearance from the engaging portion 426*d* of the cleaning container 426. In this case, the gap between the lever portion 472*i* and the engaging portion 426*d* of the cleaning container 426 disappears during the operation from the state 1 to the state 2, and the lever portion 472*i* abuts to the engaging portion 426*d* of the cleaning container 426.

[State 3]

Figure 38:
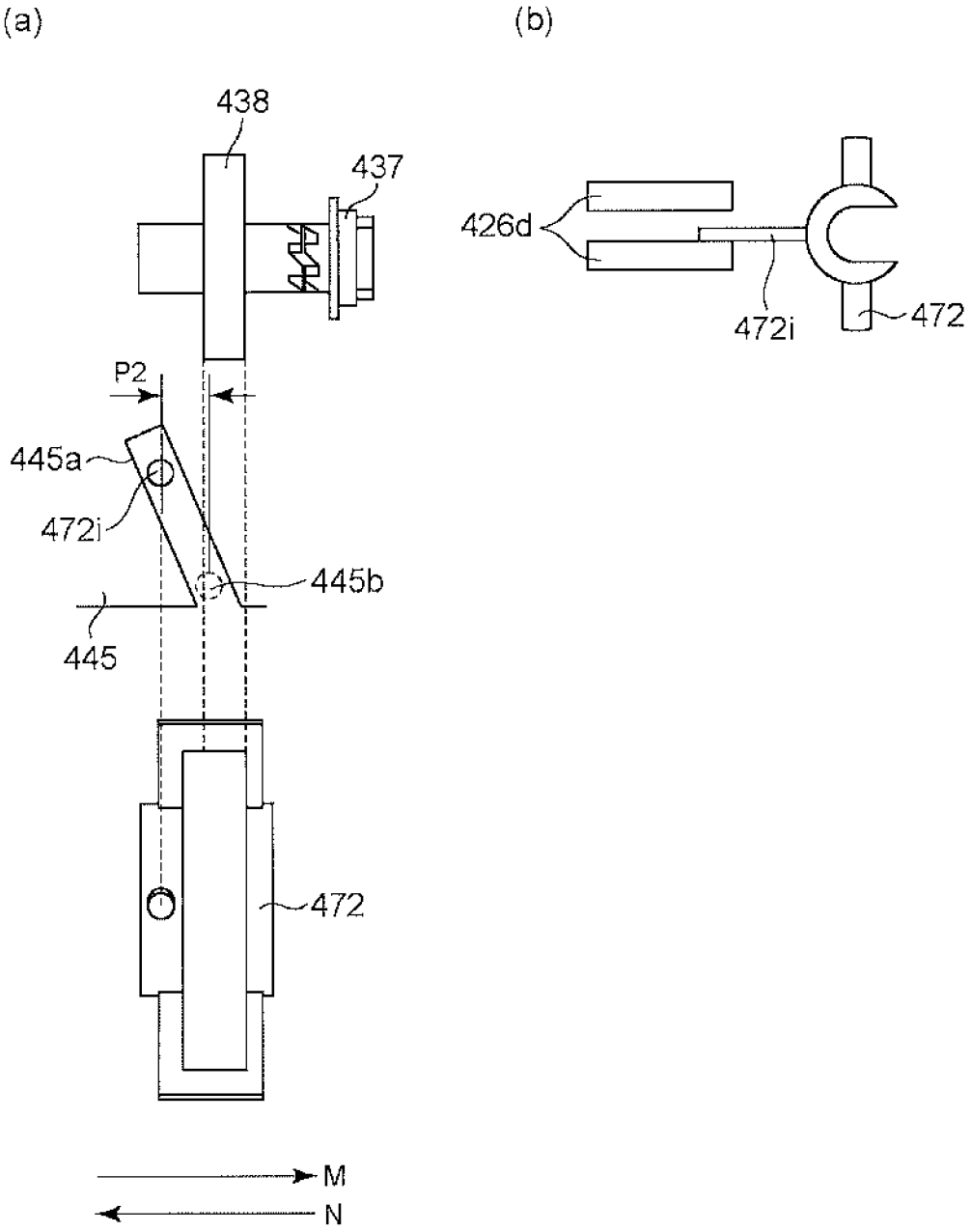
FIG. 38 is a schematic view and a perspective view of the drive connecting portion according to Embodiment 4.

The structure of the drive coupling is shown in part (a) of FIG. 38, part (b) of FIG. 38 at the time when the main assembly separating member 80 moves by δ2 in the direction of the arrow F1 in the Figure from the developing separation and driving transmission state.

As shown in FIG. 7 (*c*), the bearing member 445 rotates in interrelation with the rotation of the developing unit 9 to the angle θ2 (>θ1). At this time, the lever portion 472*i* of the release cam 472 slides against the guide groove portion 445*i* of the bearing member 445. As described above, the lever portion 472*i* of the release cam 472 is engaged with the engagement portion 426*d* of the cleaning container 426 so that the release cam 472 is restricted so as to be movable only in the axial direction (the direction of the arrow M and the direction N) (See FIG. 34). When the lever 472*i* slides in the groove 445*i*, a force is applied in the direction of the arrow N from the surface 445*b* of the groove 445*i*.

For this reason, as a result, the release cam 472 and the downstream side drive transmission member 438 slide in the direction of the arrow N by the movement amount p2 (FIG. 38 and part (b) of FIG. 38). In other words, the pressing surface 472*d* (part (b) of FIG. 35) of the release cam 472 moves the downstream side drive transmission member 438 by the movement amount p2.

At this time, the movement amount p2 is larger than the engagement amount q between the upstream side drive transmission member 437 and the downstream side drive transmission member 438, and therefore, the engagement between the upstream side drive transmission member 437 and the downstream side drive transmission member 438 is broken. Following this, the upstream drive transmission member 437 continues to rotate because the driving force is inputted from the apparatus main assembly 2, while the downstream drive transmission member 438 stops. By this, the rotations of the developing roller gear 69 and the developing roller 6 stop. The above-described state of each part is referred to as a separation position and is referred to as development separation and drive shut-off state.

In addition, the position of the downstream side drive transmission member 438 at this time is particularly referred to as a blocking position (drive blocking position, disengagement position, drive disconnection position). The position of the release cam 472 at this time is particularly called a second maintaining position (permitting position). By moving from the first maintaining position to the second maintaining position, the release cam 472 moves the downstream drive transmission member 438 from the transmission position to the blocking position, using the urging portion (urging surface 472*d*). The urging surface 472*d* holds the downstream side drive transmission member 438 in the blocking position.

The operation of shutting off the drive transmission to the developing roller 6 in interrelation with the rotation of the developing unit 9 in the direction of the arrow K has been described above. When the developing unit 9 rotates, a force for moving the downstream drive transmission member 438 to the blocking position is generated by the engagement (contact) between the face 455*b* and the lever portion 472*i*. By employing the above structure, the developing roller 6 can be separated from the drum 4 while rotating, and the drive to the developing roller 6 can be blocked in accordance with the distance between the developing roller 6 and the drum 4.

[Drive Coupling Operation]

Next, the operation of the drive connecting portion at the time when the developing roller 6 and the drum 4 change from a state in which they are separated from each other to a state in which they are in contact with each other will be described. This operation is the reverse of the above-described operation from the developing contact state to the development separated state.

In the development separated state (the state in which the developing unit 9 has been rotated by the angle θ2 as shown in FIG. 7 (*c*)), the drive connecting portion is in a state in which the engagement between the upstream side drive transmission member 437 and the downstream side drive transmission member 438 is broken as shown in FIG. 38.

When the developing unit 9 is gradually rotated in the direction of the arrow H shown in FIG. 7 from the above state, the developing unit 9 is rotated by the angle θ1 (the state shown in part (b) of FIG. 7 and FIG. 37). In this state, the lever portion 472*i* of the release cam 472 is engaged with the engagement portion 426*d* of the cleaning container 426, and the release cam 472 slides only in the direction of the arrow M along the guide groove 445*i* of the bearing member 445. In other words, in the process that the lever 472*i* of the release cam 472 is sliding in the groove 445*i*, the lever 472*i* receives a force in the direction of the arrow M from the surface 445*a* of the groove 445*i*. The release cam 472 moves in the direction of the arrow M by this force. The surface 445*a* is a force applying portion for applying a force to the release cam 472. The contact portion of the lever 472*i* in contact with the surface 455*a* is a force receiving portion receiving a force from the force applying portion.

The surface 455*a* is a cam portion (cam surface) for converting a force for moving the developing unit 9 relative to the drum unit into a force for urging the release cam 472 and the downstream side transmission member 438. The surface 445*a* is also an inclined surface (inclined portion) inclined relative to the rotational direction of the developing unit.

The surface 445*a* faces the surface 445*b* with a space therebetween. In other words, the cam groove (guide groove 445*i*) is formed by the surface 445*a* and the surface 445*b*.

As the developing unit 9 rotates, a part of the release cam 472 (that is, the lever 472*i*) moves in the space between the surface 445*a* and the surface 445*b*.

In interrelation with the movement of the release cam 472 in the direction of the arrow M, the urging surface 472*c* as the urging portion of the release cam 472 pushes the urged surface 438*c* as the urged portion of the downstream side drive transmission member 438. The pressing surface 472*c* is a second urging portion for urging the downstream side drive transmission member 438. By the downstream side drive transmission member 438 moving in the direction of the arrow M by the urging of the surface 472*c*, the upstream side drive transmission member 437 and the downstream side drive transmission member 438 are engaged with each other.

That is, when the developing unit 9 rotates, a force for moving the downstream drive transmission member 438 to the transmission position is produced by the engagement (contact) between the face 455*a* and the lever portion 472*i*.

Through the above process, the driving force from the apparatus main assembly 2 is transmitted to the developing roller 6, and the developing roller 6 is rotationally driven. At this time, the developing roller 6 and the drum 4 are kept spaced from each other.

Further, by gradually rotating the developing unit 9 in the direction of the arrow H shown in FIG. 7 from the above state, the developing roller 6 and the drum 4 can be brought into contact with each other.

The operation of the drive transmission to the developing roller 6 in interrelation with the rotation of the developing unit 9 in the direction of arrow H has been described above. With the above structure, the developing roller 6 contacts the drum 4 while rotating, and can transmit the drive to the developing roller 6 in accordance with the distance between the developing roller 6 and the drum 4.

In summary, as the developing unit moves (rotates) relative to the photosensitive unit, the moving member (release cam 472) and the guide groove 445*i* move the downstream side drive transmission member 438, whereby the drive transmission state is switched. The release cam 472 and the guide groove 445*i* constitute a cam mechanism which converts the rotating operation of the developing unit 9 into the moving operation of the downstream side drive transmission member 438.

In detail, the force produced by the contact between the surface (cam) 455*b* of the guide groove 445*i* and the lever portion 472*i* moves the downstream side drive transmission member 438 to the blocking position and shut off the transmission of the drive. On the other hand, the force produced by the contact between the surface 455*a* and the lever portion 472*i* moves the downstream side drive transmission member 438 to the transmission position to effect the transmission of the drive.

What actually moves the downstream drive transmission member 438 is the release cam 472. At least a part of the downstream drive transmission member 438 is disposed between the urging face 472*c* of the release cam and the urging face 472*d*. By this, when the release cam 472 moves, the downstream side drive transmission member 438 is urged by the release cam 472 to move.

In the above description, the lever portion 472*i* of the release cam 472 is constituted to be engaged with the regulating portion 426*d* of the cleaning container 426. However, the lever portion 472*i* is not necessarily limited to the structure, and for example, the lever portion 472*i* may engage with the driving side cartridge cover member 424.

Embodiment 5

Next, a cartridge according to Embodiment 5 of the present invention will be described. The description of the same structure as in the above embodiments will be omitted. In Embodiment 4, the release cam 472 moves the downstream drive transmission member to release the connection with the upstream side drive transmission member. In contrast to this, in this embodiment, the release cam 572 moves the upstream side drive transmission member, thereby releasing the connection with the downstream side drive transmission member. Hereinafter, the difference from Embodiment 4 will mainly be explained, and the description of the same structure as in Embodiment 4 may be omitted.

[Structure of Drive Connecting Portion]

Figure 39:
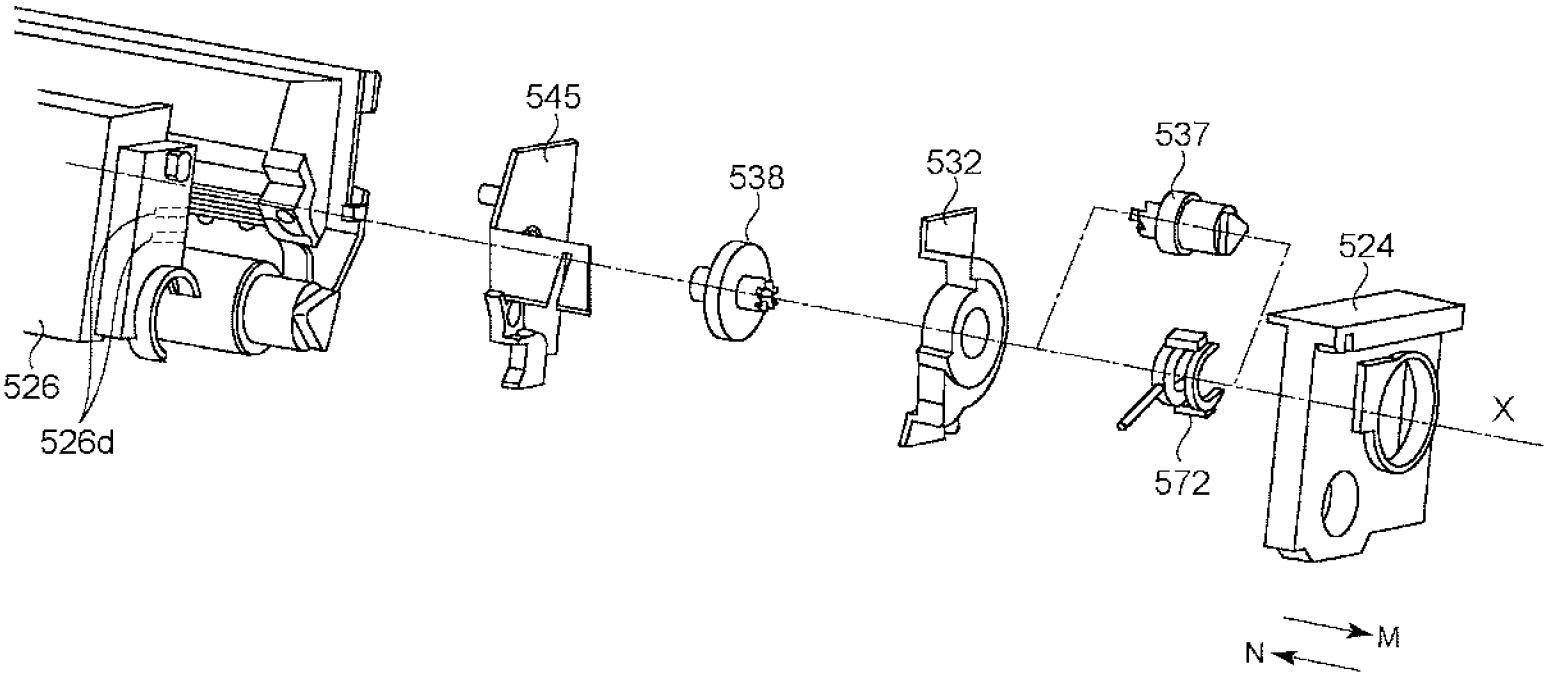
FIG. 39 is a perspective view of a process cartridge according to Embodiment 5.

Referring to FIG. 39, the structure of the drive connecting portion will be described. First, the outline will be explained.

Between the bearing member 545 and the driving side cartridge cover member 524, the following members are provided from the bearing member 545 toward the driving side cartridge cover member 524. They are the downstream drive transmission member 538 as the second coupling member, the development cover member 532, the release cam 572, and an upstream side drive transmission member 437 serving as a first coupling member set inside the release cam 472. These members are provided coaxially with the upstream drive transmission member 537. In this embodiment, the drive connecting portion is constituted by the bearing member 545, the downstream side drive transmission member 538, the development cover member 532, the release cam 572, the upstream side drive transmission member 537, and the driving side cartridge cover member 524. The release cam 572 is a part of the release mechanism and is a coupling releasing member and further is an acting member.

Figure 40:
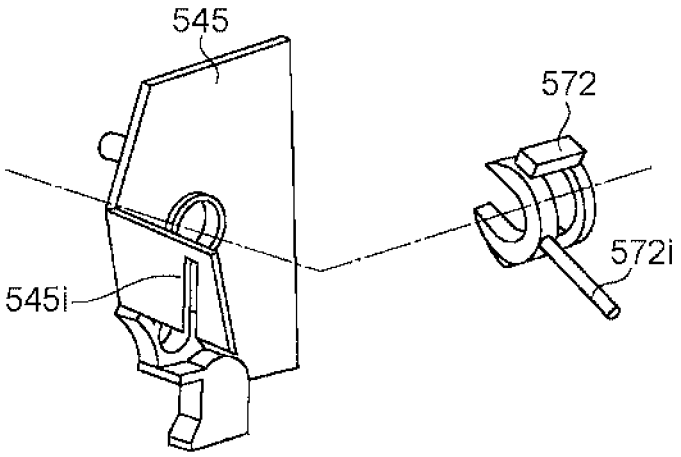
FIG. 40 is a perspective view of a releasing member and peripheral parts according to Embodiment 5.

FIG. 40 shows the relationship between the release cam 572 and the bearing member 545. For the sake of better illustration, parts between release cam 572 and bearing member 545 are not shown. In this embodiment, unlike Embodiment 4, the guide groove 545*i* as the second guide portion of the bearing member 545 is cut so as to direct toward the driving side cartridge cover member 532 upon separation. The guide groove 545*i* is constituted so that the lever portion 572*i* can slide. In addition, the release cam 572 is slidably movable in the axial direction relative to the bearing member 545 and the developing unit 9, and is also supported so as to be rotatable also in the rotational direction about the axis X.

In this embodiment, the bearing member 545 is provided with a guide groove, but it may be provided on the developing cover member 532 or the driving side cartridge cover member 524.

Regarding the regulating portions of the release cam 572 and the cleaning container 526, they are similar to those of Embodiment 4, and therefore, the description thereof will be omitted.

Figure 41:
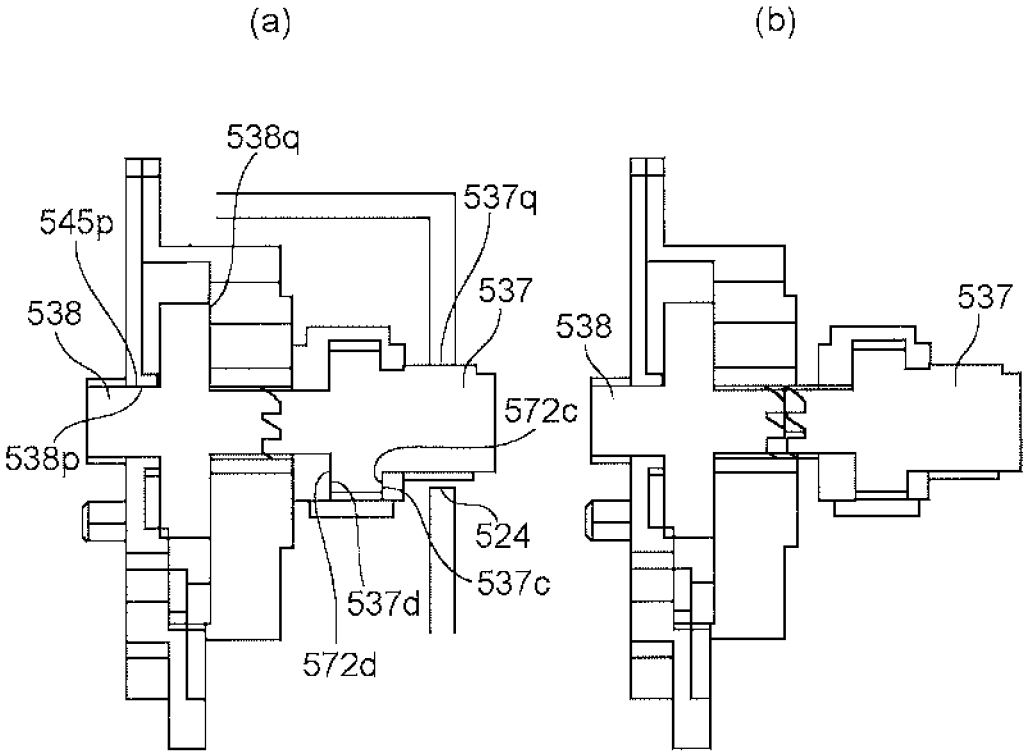
FIG. 41 is a cross-sectional view of a drive connecting portion according to Embodiment 5.

FIG. 41 shows a cross-sectional view of the drive connecting portion.

The cylindrical portion 538*p* (cylindrical inner surface) of the downstream side drive transmission member 538 and the first bearing portion 445*p* (cylindrical outer surface) of the bearing 545 are engaged with each other. The cylindrical portion 538*q* (cylindrical outer surface) of the downstream side drive transmission member 538 and the inner diameter portion 532*q* of the developing cover member 532 are engaged with each other. In other words, both ends of the downstream side drive transmission member 538 are rotatably supported by the bearing member 545 and the developing cover member 532.

Further, the cylindrical portion 537*p* (cylindrical outer surface) of the upstream side drive transmission member 537 and the hole portion 532*q* of the developing cover member 532 are engaged with each other. The surface 537*c* of the cylindrical portion of the upstream drive transmission member 537 is engaged with the surface 572*c* of the release cam 572, and the surface 537*d* of the cylindrical portion of the upstream drive transmission member 537 engages the surface 572*d* of the release cam 572. By this, the movement of the upstream side drive transmission member 537 in the direction of the axis X is regulated by the release cam 572. The main assembly side cylindrical portion 537*q* of the upstream side drive transmission member 537 and the coupling hole 524*e* of the driving side cartridge cover member 524 are engaged with each other. By this, the upstream drive transmission member 537 is slidably (rotatably) supported with respect to the developing cover member 532 and the driving side cartridge cover member 524.

Further, the first bearing portion 545*p* (cylindrical outer surface) of the bearing member 545, the inner diameter portion 532*q* of the developing cover member 532, the release cam 572, and the coupling hole 524*e* are disposed coaxially with the rotation center X of the developing unit 9. In other words, the upstream drive transmission member 537 is supported so as to be rotatable about the rotational center X of the developing unit 9.

In the cross-sectional view of the drive connecting portion shown in part (a) of FIG. 41, the downstream drive transmission member 538 and the upstream drive transmission member 537 are engaged with each other. Also, in the cross-sectional view of the drive connecting portion shown in part (b) of FIG. 41, the state in which the downstream side drive transmission member 538 and the upstream side drive transmission member 537 are separated from each other is shown.

[Drive Release Operation]

Hereinafter, the operation of the drive connecting portion at the time when the developing roller 6 and the drum 4 change from the contact state to the separated state will be described.

[State 1]

Figure 42:
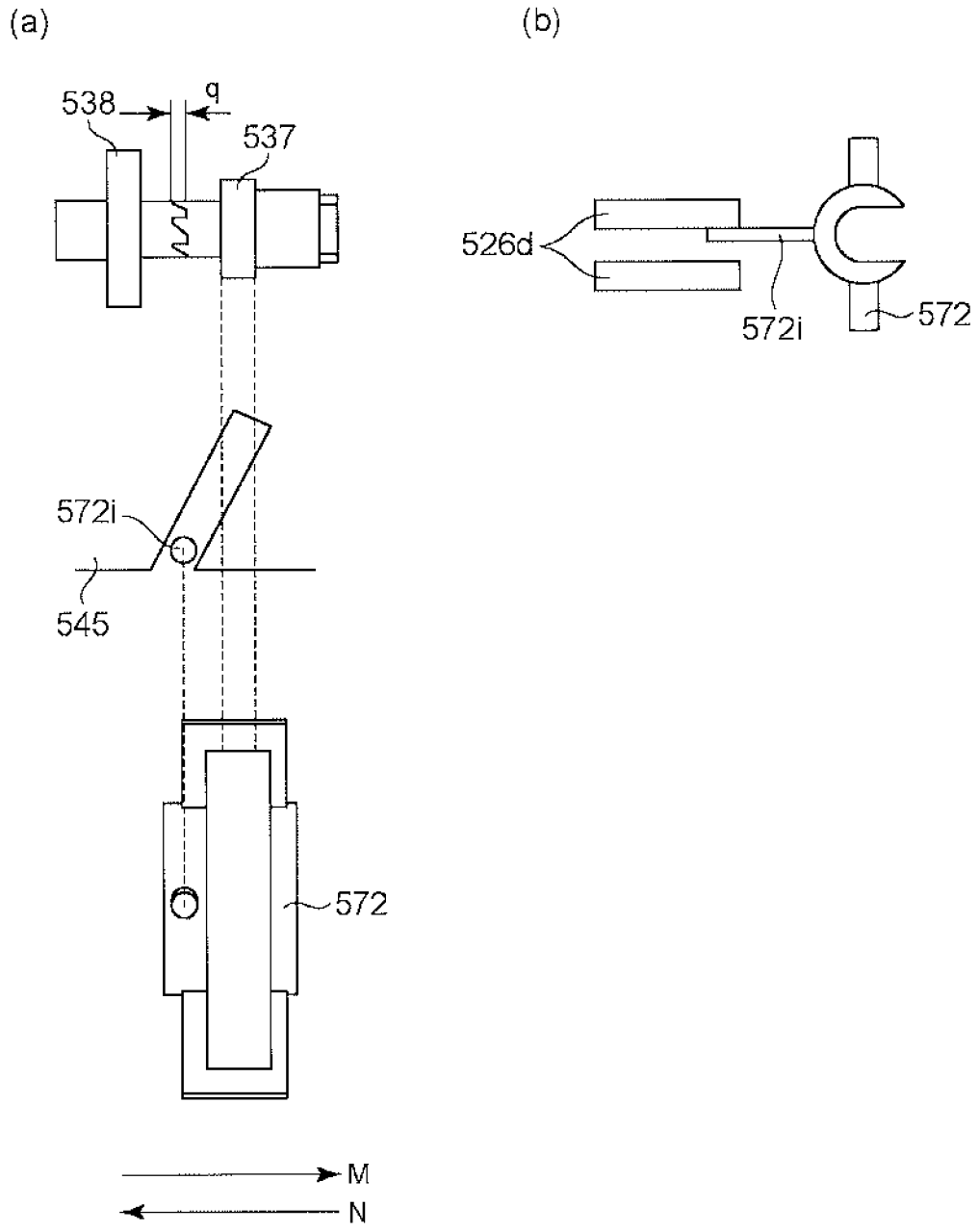
FIG. 42 is a schematic view and a perspective view of the drive connecting portion according to Embodiment 5.

As shown in part (a) of FIG. 7, the main assembly separating member 80 and the force receiving portion 45*a* of the bearing member 45 are spaced apart with a gap d. At this time, the drum 4 and the developing roller 6 are in contact with each other. This state is the state 1 of the main assembly separating member 80. The structure of the drive connecting portion at this time is schematically shown in part (a) of Figure Also, a part (b) of FIG. 42 shows a perspective view of the structure of the drive connecting part. For the sake of better illustration, some parts are not shown in FIG. 42. In Part (a) of FIG. 42, the pair of the upstream side drive transmission member 537 and the downstream side drive transmission member 538, and the pair of the release cam 572 and the bearing member 545 are shown separately. In part (b) of FIG. 42, only a part including the guide groove 545*i* is shown in the bearing member 545 and only a part including the restricting part 526*d* is shown in the cleaning container 526. At this time, the lever portion 572*i* of the release cam 572 is sandwiched between the driving side cartridge cover member 524 and the guide groove 545*i* of the bearing member 545. In addition, at this time, the upstream side drive transmission member 537 and the downstream side drive transmission member 538 are engaged with each other with an engagement amount q so that drive transmission can be effected. As described above, the downstream drive transmission member 538 is engaged with the developing roller gear 69 (FIG. 59). Therefore, the drive force inputted from the main assembly 2 to the upstream drive transmission member 537 is transmitted to the developing roller gear 69 by way of the downstream drive transmission member 538. By this, the developing roller 6 is driven. The above state of each part is referred to as contact position, and it is called development contact, drive transmission state.

[State 2]

Figure 43:
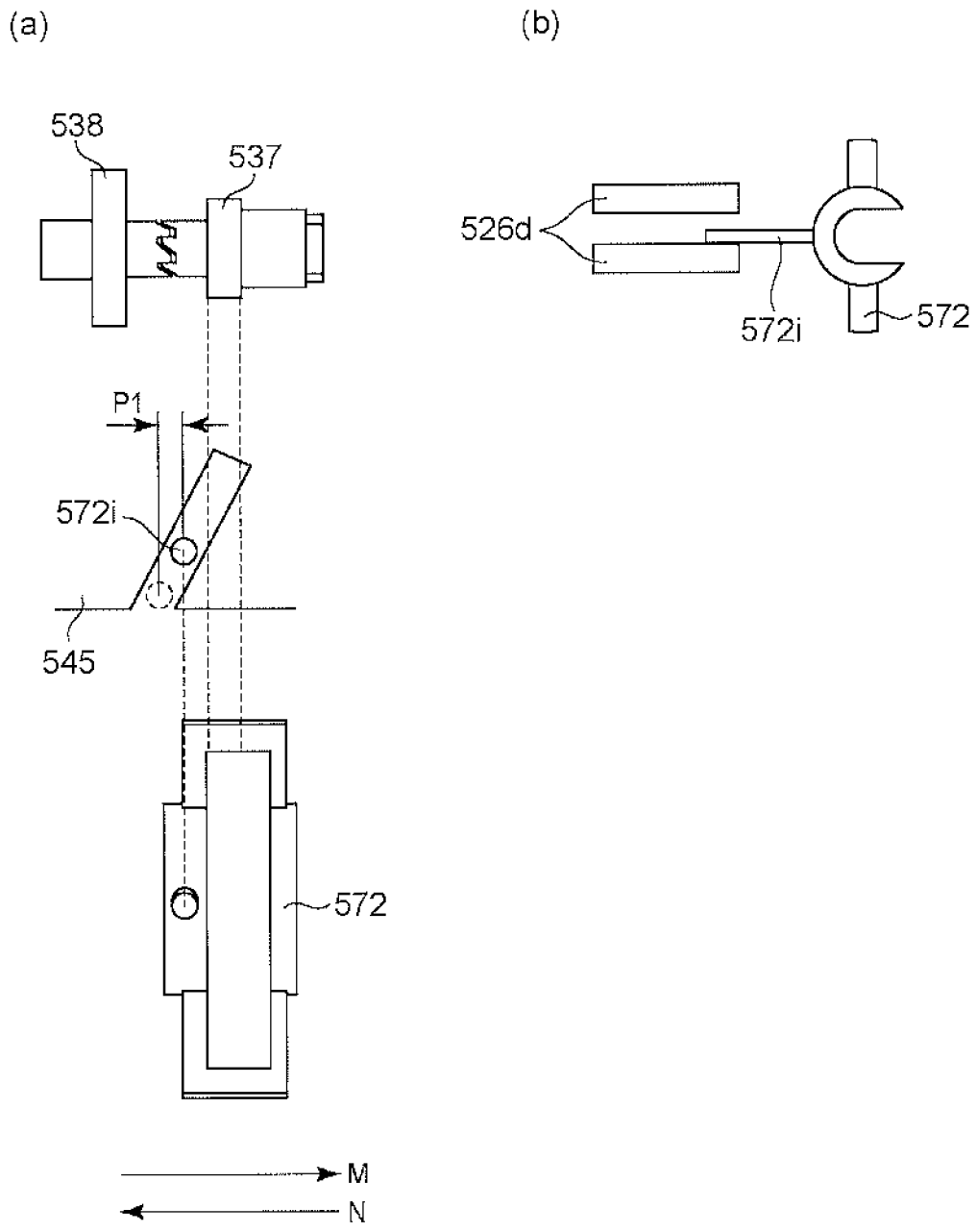
FIG. 43 is a schematic view and a perspective view of the drive connecting portion according to Embodiment 5.

Part (a) of FIG. 43 and part (b) of FIG. 43 show the structure of the drive connecting part at the time when the main assembly separating member 80 has moved by δ1 in the direction of the arrow F1 in the Figure from the developing contact and driving transmission state, As shown in part (b) of FIG. 7. At this time, as described above, the developing unit 9 rotates by the angle θ1 in the direction of the arrow K about the rotation center X. By this, the developing roller 6 is separated from the drum 4 by a distance ε1. The release cam 572 and the bearing member 545 incorporated in the developing unit 9 rotate in the direction of the arrow K by an angle θ1 in interrelation with the rotation of the developing unit 9. On the other hand, the release cam 572 is incorporated in the developing unit 9, but as shown in part (b) of FIG. 43, the lever portion 572*i* is engaged with the engaging portion 526*d* of the cleaning container 526. "$," When the developing unit 9 is rotated by the guide groove 545*i* of the bearing member 545, the release cam 572 does not rotate, and the lever portion 572*i* slides in the guide grooves 545*i* to slide in the M direction of the X axis. At this time, as shown in part (a) of FIG. 43 and part (b) of FIG. 43, the lever part 572*i* of the release cam 572 has moved the guide part 545*i* of the bearing member 545 in the direction of the arrow M by p1. At this time, the distance p1 is smaller than q, and therefore, the upstream drive transmission member 537 and the downstream drive transmission member 538 are kept in a state of being engaged with each other (part (a) of FIG. 43). Therefore, the driving force inputted from the main assembly 2 to the upstream drive transmission member 537 is transmitted to the developing roller 6 by way of the downstream drive transmission member 538 and the developing roller gear 69. The above state of each part is called development separation and drive transmission state. In the state 1 described above, the lever portion 572*i* does not necessarily have to be in contact with the engaging portion 526*d* of the cleaning container 526. In other words, in the state 1, the lever portion 572*i* may be disposed with a gap relative to the engaging portion 526*d* of the cleaning container 526. In this case, during the operation from state 1 to state 2, the gap between the lever portion 572*i* and the engaging portion 526*d* of the cleaning container 526 disappears, and the lever portion 572*i* abuts to the engaging portion 526*d* of the cleaning container 526.

[State 3]

Figure 44:
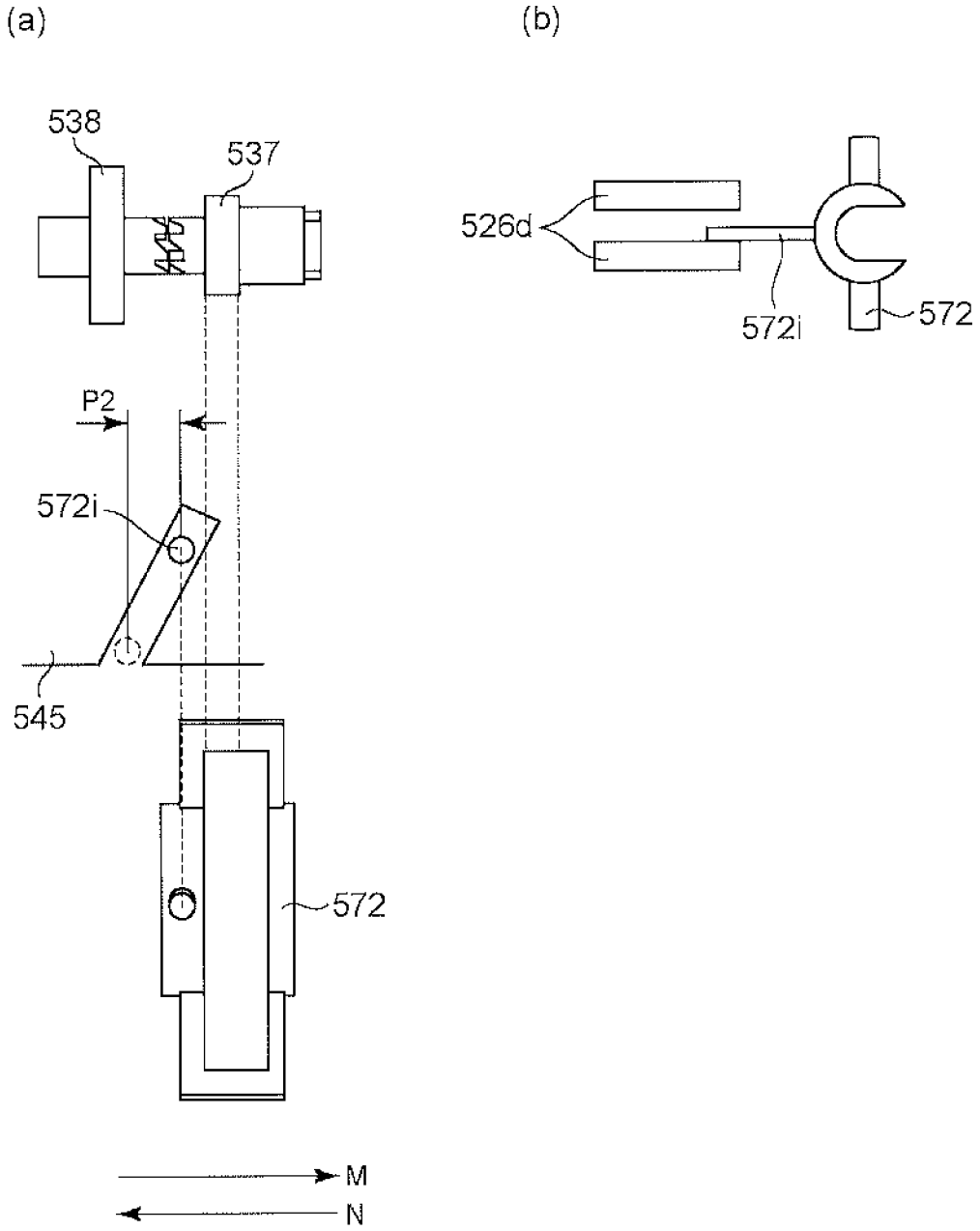
FIG. 44 is a schematic view and a perspective view of the drive connecting portion according to Embodiment 5.

Part (a) of FIG. 44 and Part (b) of FIG. 44 show the structure of the drive connecting portion at the time when the main assembly separating member 80 has moved by δ2 in the direction of the arrow F1 in the Figure from the developing separation and drive transmission state, as shown in FIG. 7 (*c*). The bearing member 545 rotates in interrelation with the rotation of the developing unit 9 by the angle θ2 (>θ1). At this time, the lever portion 572*i* of the release cam 572 slides against the guide groove portion 545*i* of the bearing member 545 and receives a force from the groove portion 544*i*. As described above, the lever portion 572*i* of the release cam 572 is engaged with the engagement portion 526*d* of the cleaning container 526, so that the release cam 572 is restricted so as to be movable only in the axial direction (arrows M and N directions). Therefore, as a result, the release cam 572 and the downstream side drive transmission member 538 slide in the direction of the arrow M by the movement amount p2 (FIG. 44, and part (b) of FIG. 44).

At this time, the movement amount p2 is larger than the engagement amount q between the upstream side drive transmission member 537 and the downstream side drive transmission member 538, and therefore, the engagement between the upstream side drive transmission member 537 and the downstream side drive transmission member 538 is broken. With this, the upstream drive transmission member 537 continues to rotate because the driving force is inputted from the apparatus main assembly 2, whereas the downstream drive transmission member 538 stops. By this, the rotation of the developing roller gear 69 and the developing roller 6 stops. The above state of each part is referred to as a separation position and is referred to as development separation and drive shutoff state.

The operation of shutting off the drive to the developing roller 6 in interrelation with the rotation of the developing unit 9 in the direction of the arrow K has been described above. By employing the above structure, the developing roller 6 can be separated from the drum 4 while rotating, and the drive to the developing roller 6 can be stopped in accordance with the distance between the developing roller 6 and the drum 4.

[Drive Coupling Operation]

Next, the operation of the drive connecting portion when the developing roller 6 and the drum 4 change from a state in which they are separated from each other to a state in which they are in contact with each other will be described. This operation is the reverse of the above-described operation from the developing contact state to the development separated state.

As shown in FIG. 44, in the development separated state (the state in which the developing unit 9 has rotated by the angle θ2 as shown in FIG. 7 (*c*)), the drive connecting portion is connected to the upstream side drive transmission member 537 and the downstream side drive transmission, and the engagement with the member 538 is broken.

When the developing unit 9 is gradually rotated in the direction of the arrow H shown in FIG. 7 from the above state, the developing unit 9 is rotated by the angle θ1 (part (b) of FIG. 7 and FIG. 43). In this state, the lever portion 572*i* of the release cam 572 is engaged with the engagement portion 526*d* of the cleaning container 526, and the release cam 572 slides only in the direction of the arrow N along the guide groove 545*i* of the bearing member 545. In interrelation with the movement of the release cam 572 in the direction of the arrow N, the urging surface 572*c* as the urging portion of the release cam 572 urges the urged surface 537*c* as the urged portion of the upstream side drive transmission member 537. As the upstream drive transmission member 537 moves in the direction of the arrow N thereby, the upstream drive transmission member 537 and the downstream drive transmission member 538 are brought into engagement with each other. By this, the driving force from the main assembly 2 is transmitted to the developing roller 6, and the developing roller 6 is rotationally driven. At this time, the developing roller 6 and the drum 4 are kept spaced from each other.

Further, by gradually rotating the developing unit 9 in the direction of the arrow H shown in FIG. 7 from the above state, the developing roller 6 and the drum 4 can be brought into contact with each other.

The operation of the drive transmission to the developing roller 6 in interrelation with the rotation of the developing unit 9 in the direction of arrow H has been described above. With the above-described structure, the developing roller 6 contacts the drum 4 while rotating, and can transmit the drive to the developing roller 6 in accordance with the distance between the developing roller 6 and the drum 4.

In the above description, the lever portion 572*i* of the release cam 572 is constituted to be engaged with the regulating portion 526*d* of the cleaning container 526. However, the lever portion 572*i* is not necessarily limited such a structure, and for example, the lever portion 572*i* may engage with the driving side cartridge cover member 524.

Embodiment 6

Next, a cartridge according to an Embodiment 6 of the present invention will be described. The description of the same structure as in the above-described embodiments will be omitted. In Embodiment 4, the release cam 472 moves the downstream drive transmission member to switch the drive coupling state between the downstream drive transmission member and the upstream drive transmission member. In contrast to this, in this embodiment, the release cam switches the drive connection state with the drive transmission member (development drive output member 62) on the main assembly side by moving the drive transmission member (drive input member 690) on the cartridge side. Hereinafter, the difference from Embodiment 4 will mainly be explained, and the description of the same structure as in Embodiment 4 will be omitted.

[Structure of Drive Connecting Portion]

Figure 45:
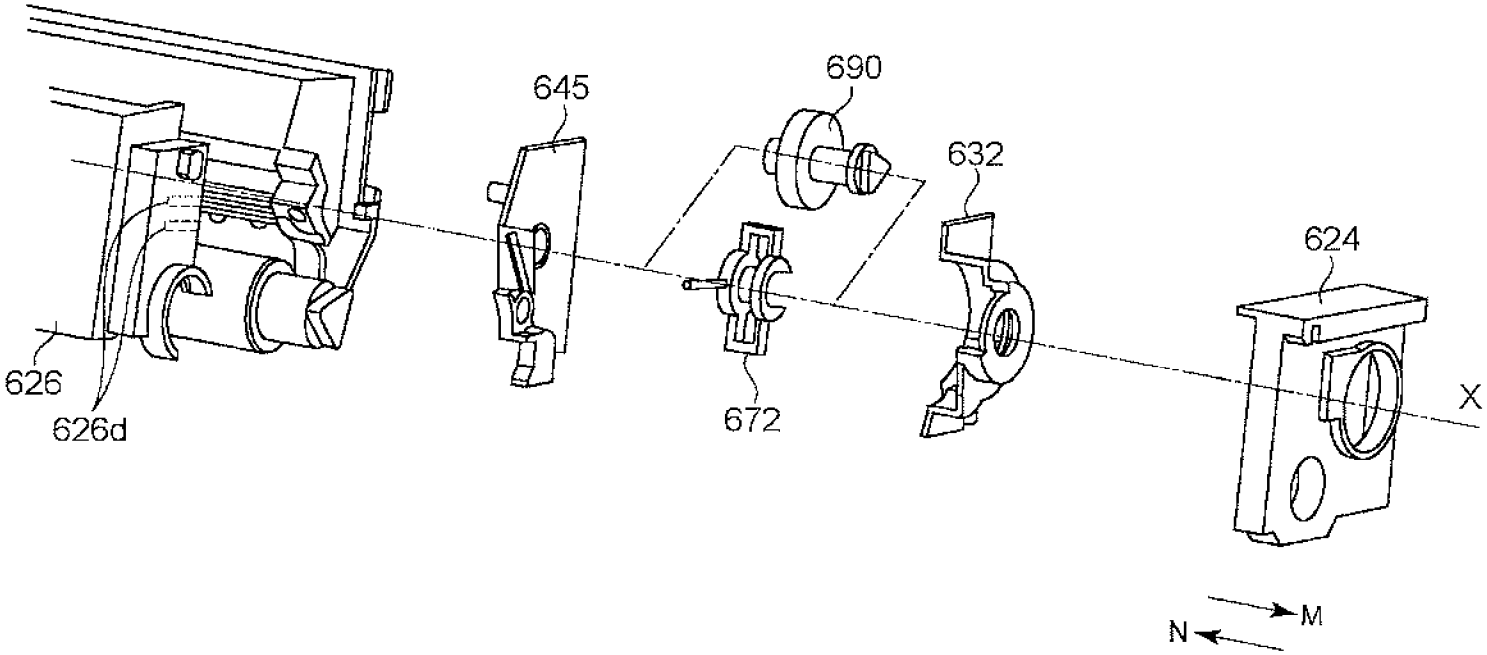
FIG. 45 is a perspective view of a process cartridge according to Embodiment 6.

Referring to FIG. 45, the structure of the drive connecting portion will be described. First, the outline will be explained.

Between the bearing member 645 and the driving side cartridge cover member 624, the following members are provided from the bearing member 645 toward the driving side cartridge cover member 624. They are the release cam 672 which is the coupling releasing member of the release mechanism, the drive input member 690 which is set inside the release cam 672, and the development cover member 632. These members are provided coaxially with the drive input member 690. In this embodiment, the drive connecting portion comprises a bearing member 645, a release cam 672, a drive input member 690, a developing cover member 632, and a driving side cartridge cover member 624.

The relationship between the release cam 672 and the bearing member 645 and the structures of the release cam 672 and the regulating portion 626*d* provided in the cleaning container 626 are the same as those in Embodiment 4 and will not be described here.

Figure 46:
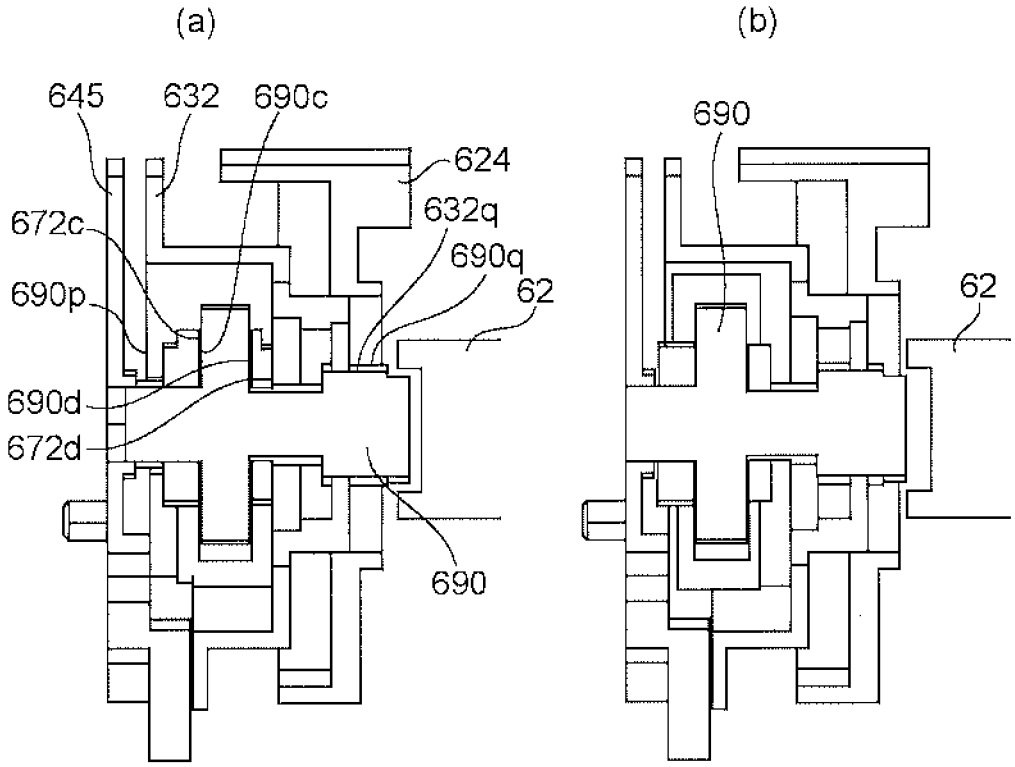
FIG. 46 is a cross-sectional view of a drive connecting portion according to Embodiment 6.

FIG. 46 shows a cross-sectional view of the drive connecting portion.

The cylindrical portion 690*p* (cylindrical inner surface) of the drive input member 690 and the first bearing portion 645*p* (cylindrical outer surface) of the bearing 645 are engaged with each other. The surface 690*c* of the cylindrical portion of the drive input member 690 is engaged with the surface 672*c* of the release cam 672, and the surface 690*d* of the cylindrical portion of the drive input member 690 is engaged with the surface 672*d* of the release cam 672. By this, the movement of the drive input member 690 in the direction of the axis X is restricted by the release cam 672. The cylindrical portion 690*q* (cylindrical outer surface) of the drive input member 690 and the inner diameter portion 632*q* of the developing cover member 632 are engaged with each other. In other words, both ends of the drive input member 690 are rotatably supported by the bearing member 645 and the developing cover member 632.

Further, the first bearing portion 645*p* (cylindrical outer surface) of the bearing member 645 and the inner diameter portion 632*q* of the developing cover member 632 are disposed coaxially with the rotation center X of the developing unit 9. In other words, the drive input member 690 is supported so as to be rotatable about the rotational center X of the developing unit 9.

In the sectional view of the drive connecting portion shown in part (a) of FIG. 46, the drive input member 690 and the development drive output member 62 as the main assembly side drive transmission member of the main assembly 2 are engaged with each other. In the cross-sectional view of the drive connecting portion shown in part (b) of FIG. 46, the drive input member 690 and the development drive output member 62 of the device main assembly 2 are separated from each other.

[Drive Release Operation]

Hereinafter, the operation of the drive connecting portion when the developing roller 6 and the drum 4 change from the contact state to the separated state will be described.

[State 1]

Figure 47:
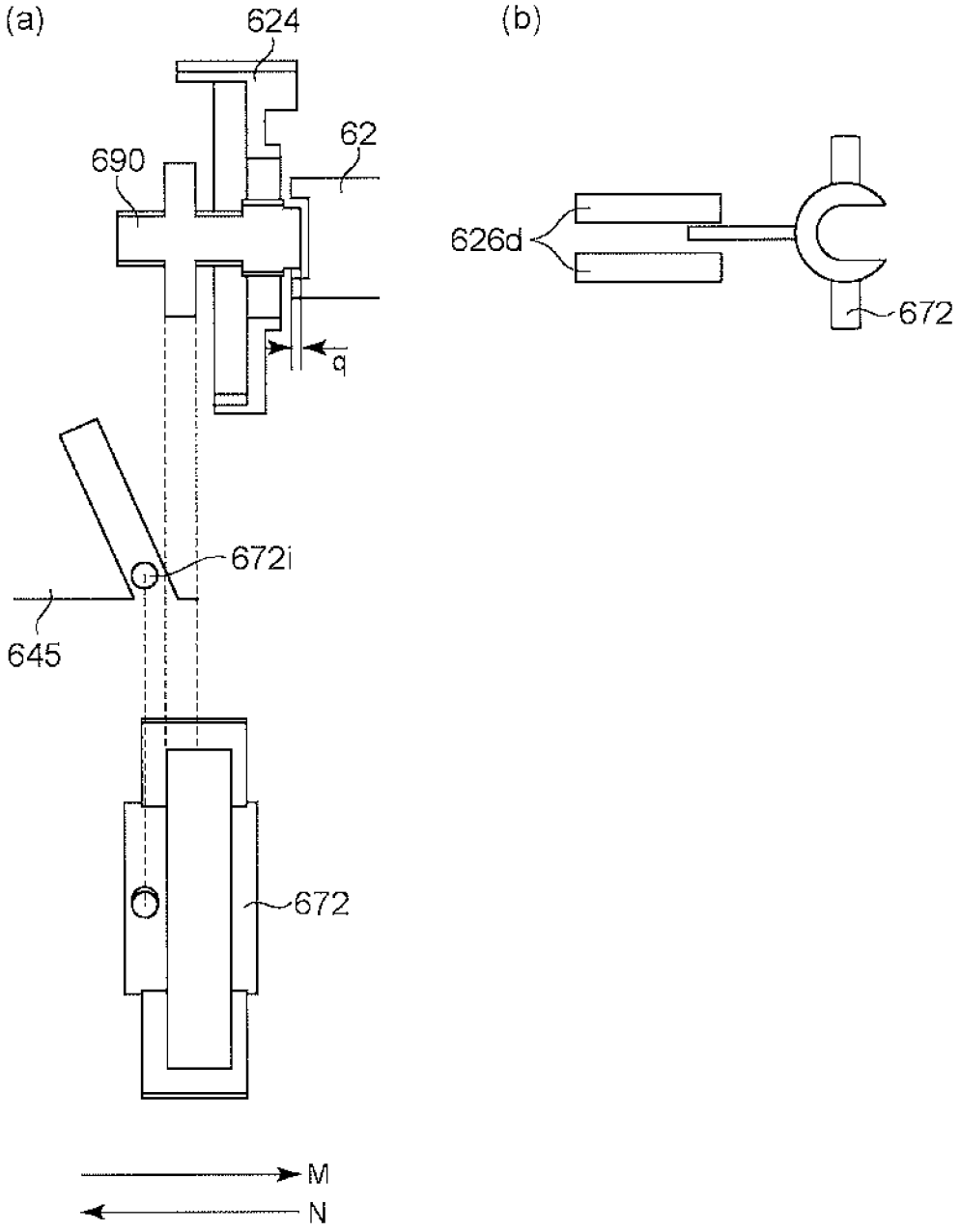
FIG. 47 is a schematic view and a perspective view of the drive connecting portion according to Embodiment 6.

As shown in part (a) of FIG. 7, the main assembly separating member 80 and the force receiving portion 45*a* of the bearing member 45 are separated by a gap d. At this time, the drum 4 and the developing roller 6 are in contact with each other. This state is defined as the state 1 of the main assembly separating member 80. The structure of the drive connecting portion at this time is schematically shown in part (a) of FIG. 47. Also, a part (b) of FIG. 47 is a perspective view of the structure of the drive connection. For the sake of better illustration, some parts are not shown in FIG. 47. In Part (a) of FIG. 47, a pair of the drive input member 690 and the development drive output member 62 of the apparatus main assembly 2, and a pair of the release cam 672 and the bearing member 645 are shown separately. In a part (b) of FIG. 47, only a part including the guide groove 645*i* is shown in the bearing member 645 and only a part including the restricting part 626*d* is shown in the cleaning container 626. At this time, the lever portion 672*i* of the release cam 672 is sandwiched at the position closest to the driving side cartridge cover member 624 among the guide grooves 645*i* of the bearing member 645. At this time, the drive input member 690 and the development drive output member 62 of the apparatus main assembly 2 are engaged with each other with the engagement amount q and drive input can be effected. As mentioned above, the drive input member 690 is engaged with the developing roller gear 69 (FIG. 59). Therefore, the driving force input from the main assembly 2 to the driving input member 690 is transmitted to the developing roller gear 69. By this, the developing roller 6 is driven. The above state of each part is referred to as contact position, and it is called development contact, drive transmission state.

[State 2]

Figure 48:
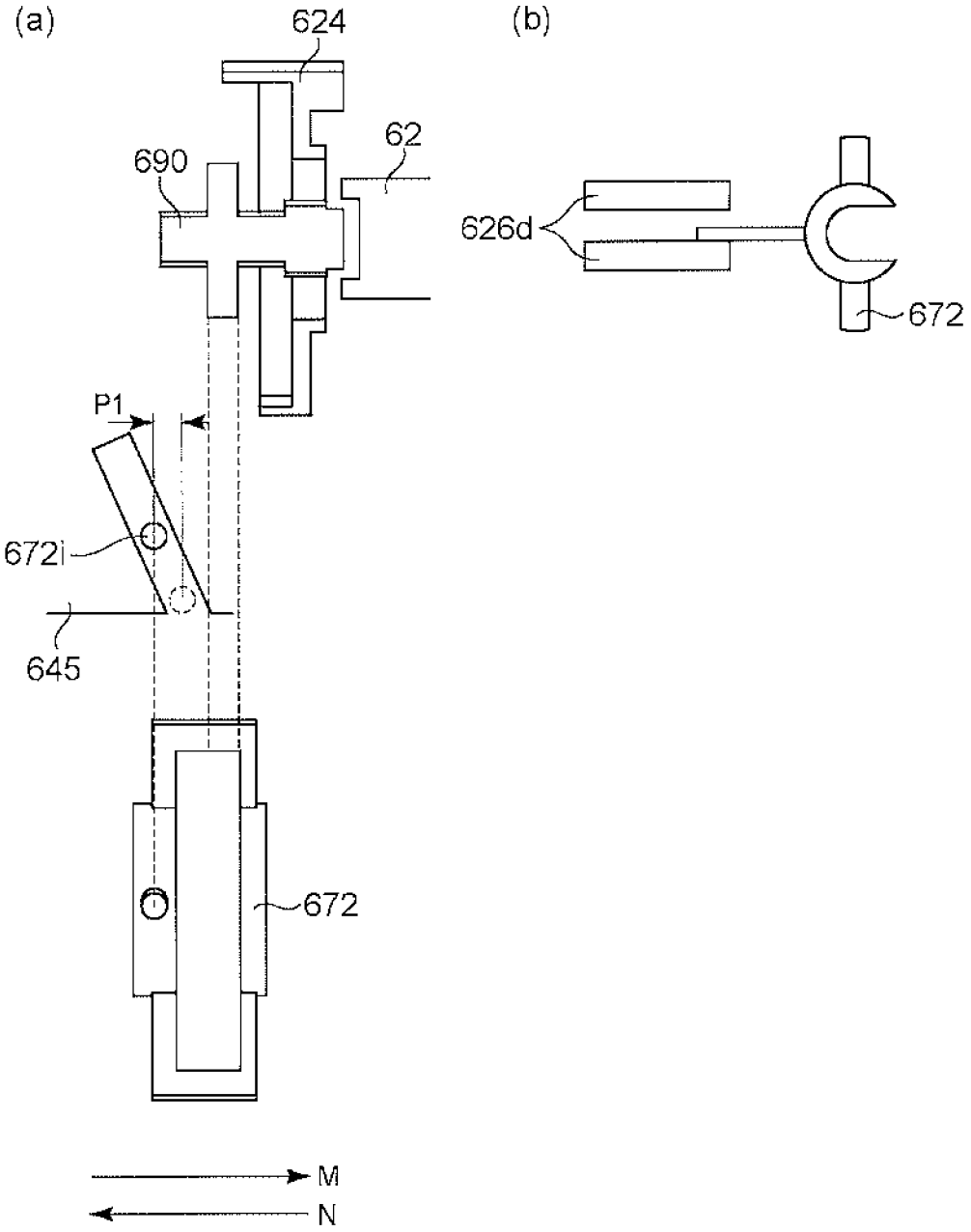
FIG. 48 is a schematic view and a perspective view of the drive connecting portion according to Embodiment 6.

Part (a) of FIG. 48 and part (b) of FIG. 48 show the structure of the drive connecting part at the time when the main assembly separating member 80 moves from the developing contact and driving transmission state by δ1 in the direction of the arrow F1 in the Figure as shown in part (b) of FIG. 7. The release cam 672 is incorporated in the developing unit 9, but as shown in FIG. 48, the lever portion 672*i* is engaged with the engaging portion 626*d* of the cleaning container 626. When the developing unit 9 is rotated by the guide groove 645*i* of the bearing member 645, the release cam 672 does not rotate and the lever portion 672*i* slides in the guide grooves 645*i* to slide in the N direction of the X axis. As shown in part (a) of FIG. 48 and part (b) of FIG. 48, the lever part 672*i* of the release cam 672 has moved the guide part 645*i* of the bearing member 645 by p1 in the direction of the arrow N. At this time, p1 is smaller than q, and the drive input member 690 and the development drive output member 62 of the apparatus main assembly 2 are kept in a state of being engaged with each other (part (a) of FIG. 48). Therefore, the driving force input from the main assembly 2 to the drive input member 690 is transmitted to the developing roller 6 via the developing roller gear 69. The above-described state of each part is called development separation and drive transmission state. In the state 1 described above, the lever portion 672*i* does not necessarily have to be in contact with the engaging portion 626*d* of the cleaning container 626. In other words, in the state 1, the lever portion 672*i* may be disposed with a gap relative to the engaging portion 626*d* of the cleaning container 626. In this case, the gap between the lever portion 672*i* and the engaging portion 626*d* of the cleaning container 626 disappears during the operation from the state 1 to the state 2, so that the lever portion 672*i* abuts to the engaging portion 626*d* of the cleaning container 626.

[State 3]

Figure 49:
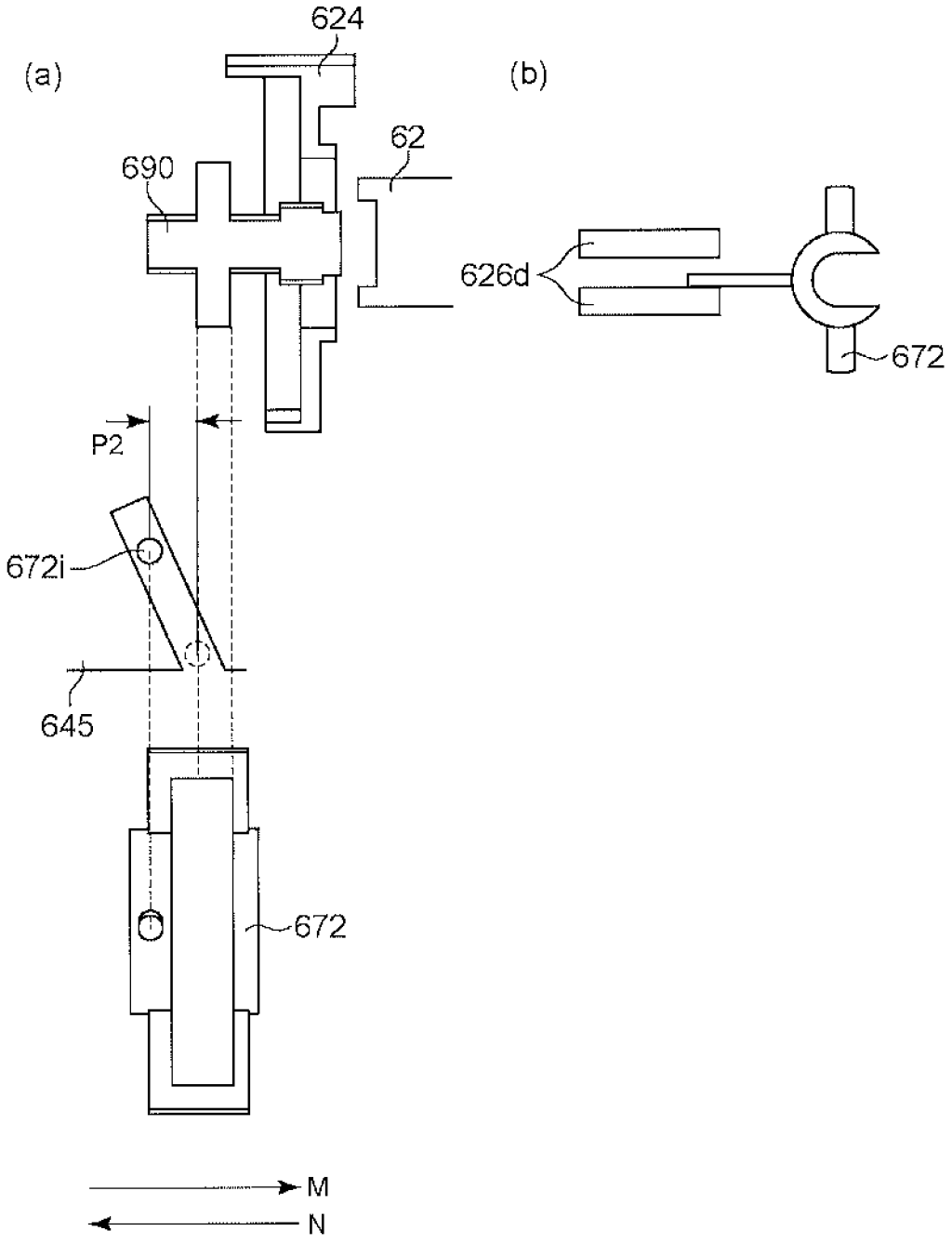
FIG. 49 is a schematic view and a perspective view of the drive connecting portion according to Embodiment 6.

Part (a) of FIG. 49 and part (b) of FIG. 49 show the structure of the drive connecting part at the time when the main assembly separating member 80 has moved by δ2 in the direction of the arrow F1 in the Figure from the developing separation and driving transmission state, as shown in FIG. 7 (*c*). The bearing member 645 rotates in interrelation with the rotation of the developing unit 9 at the angle θ2 (>θ1). At this time, the lever portion 672*i* of the release cam 672 slides on the guide groove portion 645*i* of the bearing member 645 and receives a force from the guide groove portion 645*i*. As described above, the release cam 672 is restricted so the lever portion 672*i* thereof is engaged with the engagement portion 626*d* of the cleaning container 626 so as to be movable only in the axial direction (arrows M and N directions) (FIG. 49). Therefore, as a result, the release cam 672 and the drive input member 690 slide by the movement amount p2 in the direction of the arrow N (part (a) in FIG. 49 and part (b) in FIG. 49).

At this time, the movement amount p2 is larger than the engagement amount q of the drive input member 690 and the development drive output member 62 of the apparatus main assembly 2, and therefore, the engagement between the drive input member 690 and the development drive output member 62 of the apparatus main assembly 2 is broken. With this, the drive input member 690 is released from the driving force of the main assembly 2 to stop. By this, the rotations of the developing roller gear 69 and the developing roller 6 stop. The above state of each part is referred to as a separation position and is referred to as development separation and drive shut-off state.

The operation of shutting off the drive to the developing roller 6 in interrelation with the rotation of the developing unit 9 in the direction of the arrow K has been described above. By employing the above-described structure, the developing roller 6 can be separated from the drum 4 while rotating, and the drive to the developing roller 6 can be stopped in accordance with the distance between the developing roller 6 and the drum 4.

[Drive Coupling Operation]

Next, the operation of the drive connecting portion when the developing roller 6 and the drum 4 change from a state in which they are separated from each other to a state in which they are in contact with each other will be described. This operation is the reverse of the above-described operation from the developing contact state to the development separated state.

In the development separated state (the state in which the developing unit 9 is rotated by the angle θ2 as shown in FIG. 7 (*c*)), the drive connecting portion is such that the driving input member 690 and the developing drive output member 62 of the main assembly 2 are disengaged from each other, as shown in FIG. 49.

When the developing unit 9 is gradually rotated in the direction of the arrow H shown in FIG. 7 from the above state, the developing unit 9 is rotated by the angle θ1 (part (b) of FIG. 7 and FIG. 48). In this state, the lever portion 672*i* of the release cam 672 is engaged with the engagement portion 626*d* of the cleaning container 626, and the release cam 672 slides only in the direction of the arrow M along the guide groove 645*i* of the bearing member 645. In interrelation with the movement of the release cam 672 in the direction of the arrow M, the pressing surface 672*c* as the urging portion of the release cam 672 urges the urged surface 690*c* as the urged portion of the drive input member 690. Therefore, by the drive input member 690 moving in the direction of the arrow M, the drive input member 690 and the development drive output member 62 of the apparatus main assembly 2 are engaged with each other. Therefore, the driving force from the main assembly 2 is transmitted to the developing roller 6, so that the developing roller 6 is rotationally driven. At this time, the developing roller 6 and the drum 4 are kept spaced from each other.

Further, by gradually rotating the developing unit 9 in the direction of the arrow H shown in FIG. 7 from the above state, the developing roller 6 and the drum 4 can be brought into contact with each other.

The operation of the drive transmission to the developing roller 6 in interrelation with the rotation of the developing unit 9 in the direction of arrow H has been described above. With the above-described structure, the developing roller 6 contacts the drum 4 while rotating, and can transmit the driving force to the developing roller 6 in accordance with the distance between the developing roller 6 and the drum 4.

In the above description, the lever portion 672*i* of the release cam 672 is constituted to be engaged with the regulating portion 626*d* of the cleaning container 626. However, the lever portion 672*i* is not necessarily limited to such a structure, and for example, the lever portion 672*i* may engage with the driving side cartridge cover member 624.

Embodiment 7

As shown in FIGS. 1 and 16, in the cartridge of Embodiment 1, one end of the spring 70 contacts the developing cover member 32, and the other end of the spring 70 contacts the downstream side drive transmission member 38. In this case, when the drive force is transmitted to the downstream drive transmission member 38 by way of the upstream drive transmission member 37, the downstream drive transmission member 38 rotates relative to the spring 70. Friction occurs between the end of the spring 70 and the downstream drive transmission member 38. Due to this friction, there is a possibility that the portion of the downstream side drive transmission member 38, which is in contact with the spring 70, is worn (scraped). Therefore, in the structure of Embodiment 1, the downstream drive transmission member 38 is made of a material resistant to wearing, or the downstream drive transmission member 38 and the spring 70 is made of a material which easily reduces the frictional force would be considered. On the other hand, in this embodiment, a measure other than those will be explained.

Figure 50:
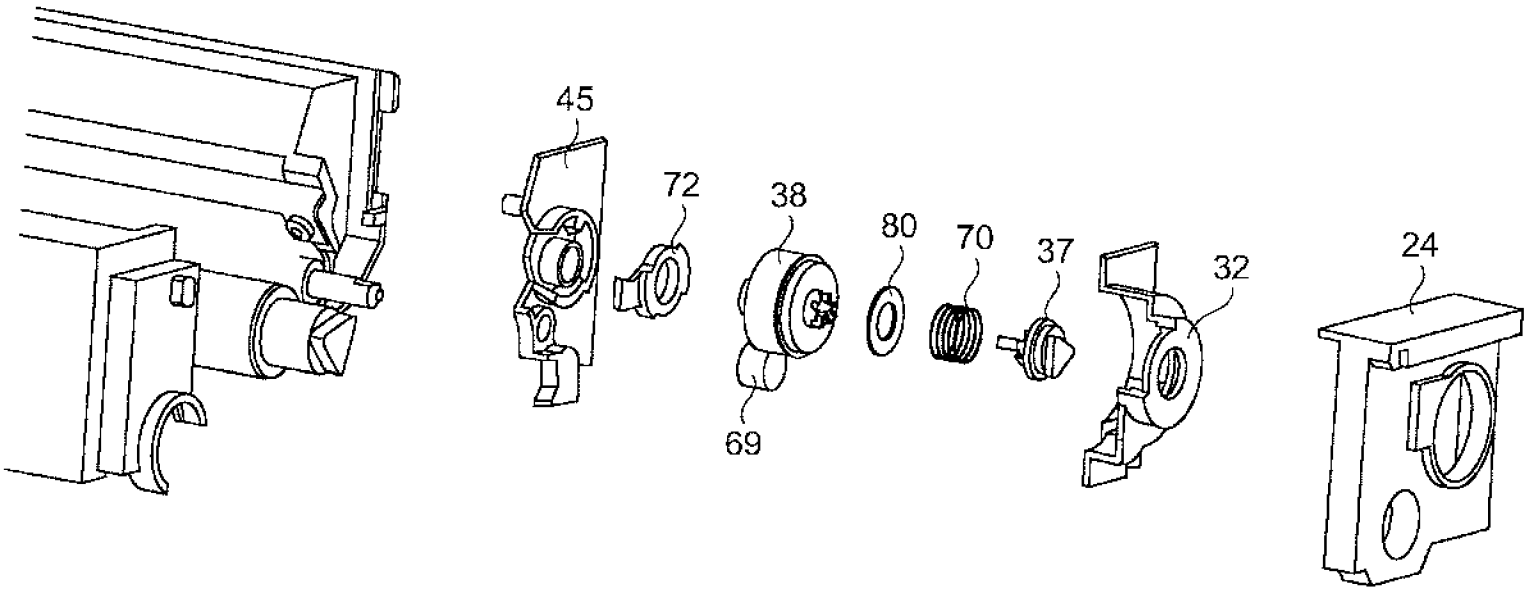
FIG. 50 is a perspective view of a process cartridge according to Embodiment 7.
Figure 51:
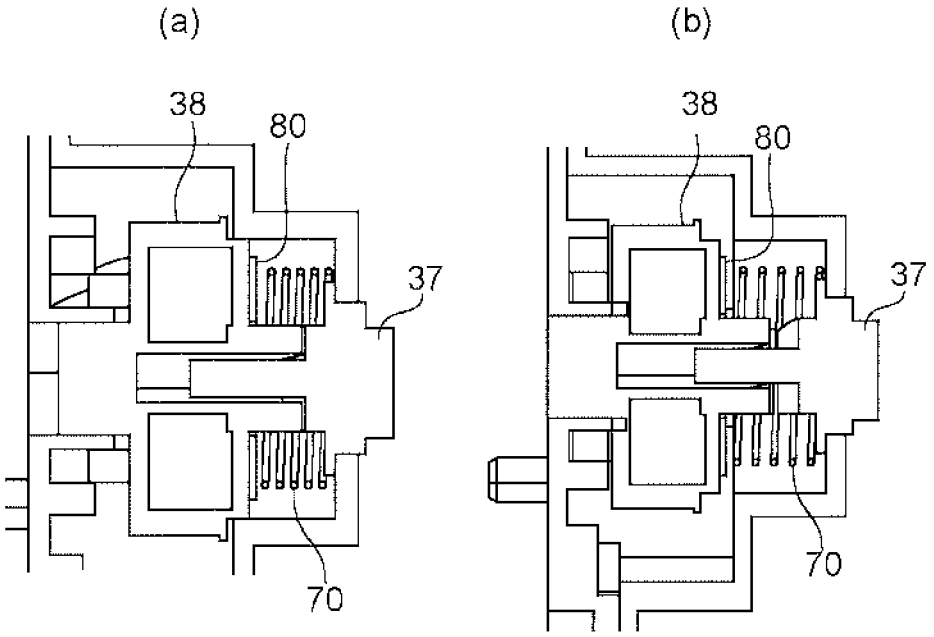
FIG. 51 is a cross-sectional view of a drive connecting portion according to Embodiment 7.

This embodiment shown in FIG. 50 and FIG. 51 is a structure example in which the structure of Embodiment 1 is partially modified. In Part (a) of FIG. 51, the coupling (coupling) of the upstream drive transmission member 37 and the downstream drive transmission member 38 is established and the drive transmission is possible between them. In part (b) of FIG. 51, the coupling between the two is broken, and when the upstream drive transmission member 37 rotates, the drive force (rotational force) is not transmitted to the downstream drive transmission member 38. The cartridge of this embodiment comprises the downstream drive transmission member 38 and the spring 70 described in Embodiment 1. However, in this embodiment unlike Embodiment 1, a plate member (interposed member, buffering member) 80 is sandwiched between the downstream side drive transmission member 38 and the spring 70. The plate member 80 is an intervening member interposed between the downstream side drive transmission member 38 and the spring 70 and is also a buffering member for easing a load applied to the downstream side drive transmission member 38.

By providing the plate member 80, the downstream drive transmission member 38 and the spring 70 do not directly contact each other. Therefore, it is possible to eliminate friction generated between the downstream side drive transmission member 38 and the spring 70 when the downstream side drive transmission member 38 rotates.

On the other hand, the downstream drive transmission member 38 is rotatable relative to the plate member 80. In other words, when the downstream side transmission member 38 receives the driving force from the upstream side drive transmission member 37, the downstream side drive transmission member 38 rotates relative to the plate member 80. At this time, friction occurs between the downstream side drive transmission member 38 and the plate member 80.

However, the load which the downstream drive transmission member 38 receives from the plate member 80 in this embodiment is generally smaller than the load which the downstream side drive transmission member 38 receives from the spring 70 in Embodiment 1. This is because the area of contact between the downstream side drive transmission member 38 and the plate member 80 in this embodiment is larger than the area where the downstream side drive transmission member 38 contacts with the spring 70 in Embodiment 1. As a result, the pressure which the downstream drive transmission member 38 receives from the plate member 80 in this embodiment is smaller than the pressure received by the downstream side drive transmission member 38 from the spring 70 in Embodiment 1. Therefore, even if friction occurs between the downstream side drive transmission member 38 and the plate member 80, the wearing of the downstream side drive transmission member 38 can be reduced.

In order to reduce the friction generated between the plate member 80 and the downstream drive transmission member 38, a lubricant may be applied to the contact portion between the plate member 80 and the downstream drive transmission member 38.

Although this embodiment is a modification of the structure of Embodiment 1, the structure of Embodiment 2 (FIG. 23) and Embodiment 3 (FIG. 28) can be modified in the same manner as in this embodiment. Such a modified example will be explained below referring to FIGS. 52 and 53.

Figure 52:
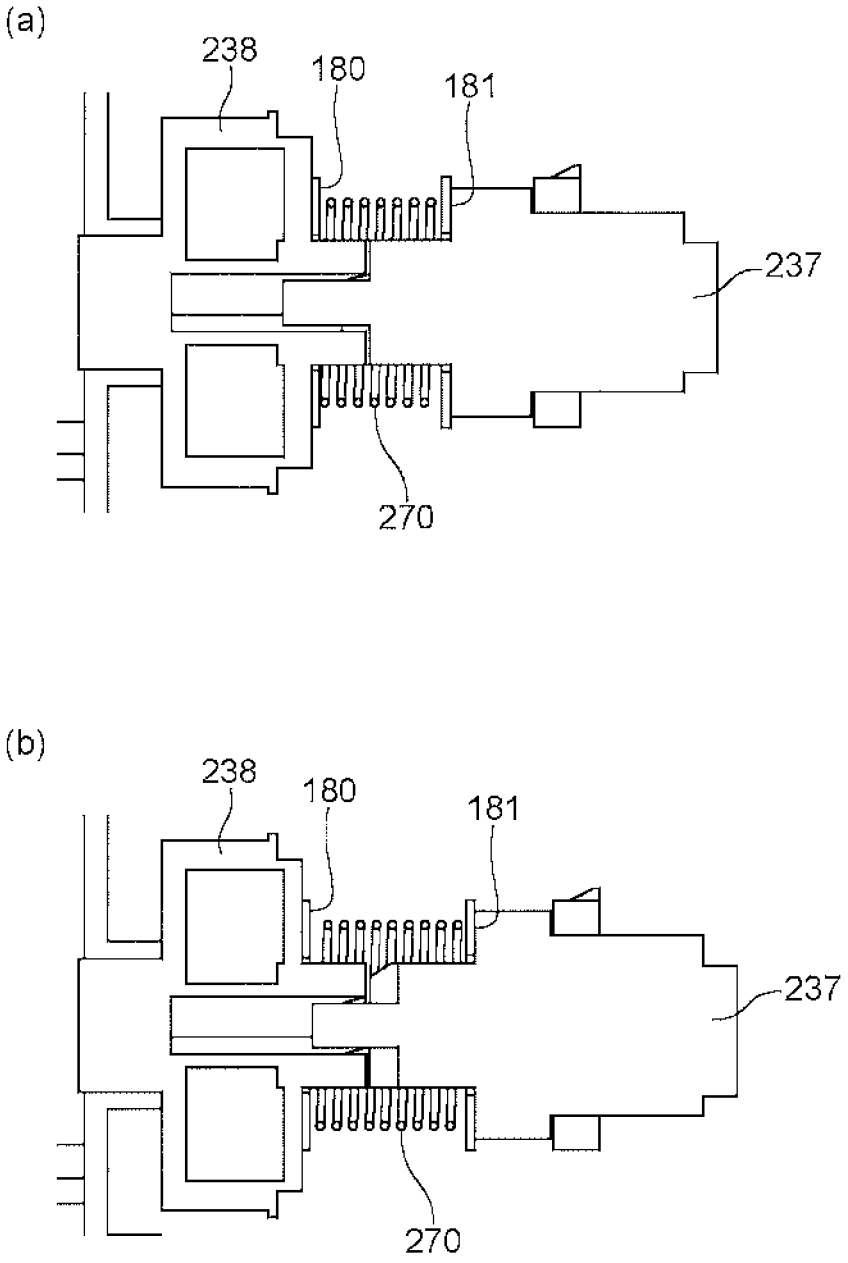
FIG. 52 is a cross-sectional view of the drive connecting portion according to Embodiment 7.

In the structure of Embodiment 2 shown in FIG. 23, one end of the spring 70 is in contact with the upstream drive transmission member 237, and the other end is in contact with the downstream drive transmission member 238. In contrast to this, in FIG. 52, the plate members 180, 181 are sandwiched between the upstream side drive transmission member 237 of Embodiment 2 and the spring 70, and between the downstream side drive transmission member 238 and the spring 70, respectively. In part (a) of FIG. 52, coupling between the upstream drive transmission member 237 and the downstream drive transmission member 238 is established, so that the drive transmission is possible between them. In part (b) of FIG. 52, the coupling between the two has been broken, and when the upstream side drive transmission member 237 rotates, the drive force (rotational force) is not transmitted to the downstream side drive transmission member 238 There. The plate member 180 and the plate member 181 are intevening members (buffering members) similar to the plate member 80 described above. In the structure of FIG. 52, the spring 70 does not directly contact the transmission member 237 or 238.

In the structure shown in FIG. 52, the upstream drive transmission member 237 rotates relative to the plate member 181 when the upstream drive transmission member 237 rotates, in a state (part (b) of FIG. 52) in which the coupling of the upstream drive transmission member 237 and the downstream drive transmission member 238 is broken. At this time, a frictional force is generated between the upstream drive transmission member 237 and the plate member 181, which is smaller than the frictional force generated when the upstream drive transmission member 237 directly contacts the spring 70.

A plate member 181 is also provided between the spring 70 and the downstream drive transmission member 238. In this case, even if the spring 70 rotates relative to the downstream side drive transmission member 238, the frictional force between the downstream side drive transmission member 238 and the plate member 181 is small.

Figure 53:
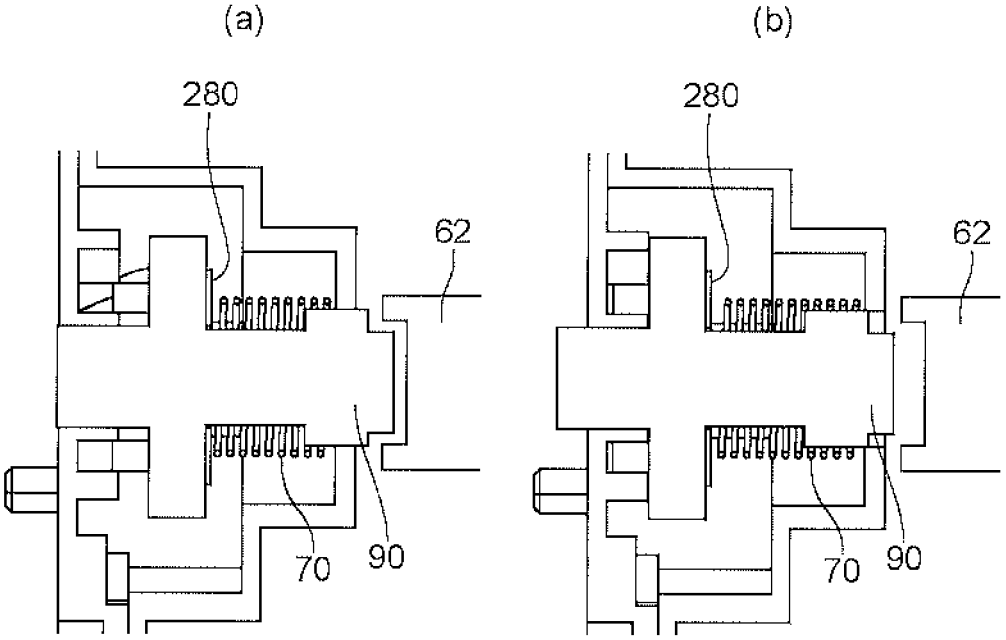
FIG. 53 is a cross-sectional view of the drive connecting portion according to Embodiment 7.

In FIG. 53, the plate member 280 is sandwiched between the drive input member 90 and the spring 70 in Embodiment 3 (FIG. 28). In part (a) of FIG. 53, at the advance position (transmission position) where the transmission member (drive input member 90) advances toward the outside of the cartridge, it couples (couples) with the drive output member 62. In part (b) of FIG. 53, the coupling with the drive output member 62 is broken at the retracted position (blocking position) where the drive input member 90 is retracted inside the cartridge.

As shown in FIG. 28, in Embodiment 3, one end portion of the spring 70 is in contact with the developing cover member 332 of the developing unit, and the other end portion of the spring 70 is in contact with the driving input member 90. In contrast, in the structure shown in FIG. 53, the spring 70 does not contact the drive input member 90 but contacts the plate member 280.

This plate member 280 has substantially the same structure as the plate member 80. When the drive input member 90 receives the driving force from the main assembly of the apparatus to rotate, the drive input member 90 rotates relative to the plate member 280. The load received by the drive input member 90 from the plate member 280 is relatively small.

Similarly to the structure of FIG. 50, also in the structures of FIG. 52 and FIG. 53, wearing of the transmission member (the downstream side drive transmission member, the upstream side drive transmission member, the drive input member) produced by the spring 70 can be suppressed. Also in the structures shown in FIGS. 52 and 53, a lubricant may be applied between the plate member and the drive transmission member. In each of the structures shown in this embodiment, although a thin plate-like member is employed as the interposing member, it is not necessary to have such a shape as long as wearing of the transmission member can be suppressed. If the intervening member is formed in a plate shape, however, the thickness of the intervening member can be suppressed, and the size of the cartridge and the main assembly of the image forming apparatus to which the cartridge is mounted can be reduced.

INDUSTRIAL APPLICABILITY

According to the present invention, there is provided a process cartridge and an image forming apparatus capable of suitably performing drive switching to a developing roller.

REFERENCE NUMERALS

1: Photoconductive drum
6: Developing roller
72: Release cam

The invention claimed is:

1. A process cartridge comprising:
a photosensitive member;
a developing roller for supplying developer to the photosensitive member, the developing roller being movable between a proximate position close to the photosensitive member and a spaced position where the developing roller is more spaced from the photosensitive member than when the developing roller is in the proximate position;
an upstream side transmission member configured to transmit a driving force;
a downstream side transmission member movable between (i) a connected position where the downstream side transmission member is connected to the upstream side transmission member to transmit the driving force from the upstream side transmission member toward the developing roller, and (ii) a released position where the connection between the upstream side transmission member and the downstream side transmission member is released;
a first cam portion configured to produce a force for moving the downstream side transmission member from the released position to the connected position in response to movement of the developing roller from the spaced position to the proximate position;
a second cam portion configured to produce a force for moving the downstream side transmission member from the connected position to the released position in response to movement of the developing roller from the proximate position to the spaced position; and
a movable member configured to move the downstream side transmission member between the released position and the connected position in response to the movement of the developing roller by engaging with a groove defined by the first cam portion and the second cam portion.

2. A process cartridge according to claim 1, wherein the movable member includes a lever engaging with the groove.

3. A process cartridge comprising:
a photosensitive member;
a developing roller for supplying developer to the photosensitive member, the developing roller being movable between a proximate position close to the photosensitive member and a spaced position where the developing roller is more spaced from the photosensitive member than when the developing roller is in the proximate position;
a downstream side transmission member configured to transmit a driving force toward the developing roller;
an upstream side transmission member movable between a connected position for connecting to the downstream side transmission member to transmit the driving force to the downstream side transmission member, and a released position for releasing the connection; and
a first cam portion configured to produce a force for moving the upstream side transmission member from the released position to the connected position in response to movement of the developing roller from the spaced position to the proximate position;
a second cam portion configured to produce a force for moving the upstream side transmission member from the connected position to the released position in response to movement of the developing roller from the proximate position to the spaced position; and
a movable member configured to move the upstream side transmission member between the released position and the connected position in response to the movement of the developing roller by engaging with a groove defined by the first cam portion and the second cam portion.

4. A process cartridge according to claim 3, wherein the movable member includes a lever engaging with the groove.

5. A process cartridge comprising:
a photosensitive member;
a developing roller for supplying developer to the photosensitive member, the developing roller being movable between a proximate position close to the photosensitive member and a spaced position where the developing roller is more spaced from the photosensitive member than when the developing roller is in the proximate position;
a coupling member for receiving a driving force from outside of the process cartridge for rotating the developing roller, the coupling member being movable between an advanced position where the coupling member is advanced toward outside of the process cartridge and a retracted position where the coupling member is retracted toward inside of the process cartridge;

a first cam portion configured to produce a force for moving the coupling member from the retracted position to the advanced position in response to movement of the developing roller from the spaced position to the proximate position;

a second cam portion configured to produce a force for moving the coupling member from the advanced position to the retracted position in response to movement of the developing roller from the proximate position to the spaced position; and a movable member configured to move the coupling member between the released position and the advanced position in response to the movement of the developing roller by engaging with a groove defined by the first cam portion and the second cam portion.

6. A process cartridge according to claim 5, wherein the movable member includes a lever engaging with the groove.

* * * * *